US005464964A

United States Patent [19]

Okuda et al.

[11] Patent Number: 5,464,964

[45] Date of Patent: Nov. 7, 1995

[54] IMAGE HEATING APPARATUS CHANGING SET TEMPERATURE IN ACCORDANCE WITH TEMPERATURE OF HEATER

[75] Inventors: Kouichi Okuda; Shunji Nakamura; Toshio Yoshimoto; Yasumasa Ohtsuka, all of Yokohama; Yohji Tomoyuki, Ichikawa; Daizo Fukuzawa, Tokyo; Tomoko Nanbu; Hidenobu Suzuki, both of Kawasaki, all of Japan

[73] Assignee: Canon Kabushiki Kaisha, Tokyo, Japan

[21] Appl. No.: 986,788

[22] Filed: Dec. 8, 1992

[30] Foreign Application Priority Data

| | | | |
|---|---|---|---|
| Dec. 11, 1991 | [JP] | Japan | 3-327614 |
| Mar. 31, 1992 | [JP] | Japan | 4-108637 |
| Apr. 10, 1992 | [JP] | Japan | 4-118393 |

[51] Int. Cl.[6] ..... H05B 1/02

[52] U.S. Cl. ..... 219/497; 219/216; 219/505; 219/492; 340/589; 323/369

[58] Field of Search ..... 219/216, 497, 219/499, 501, 506, 505; 323/369, 235, 236; 340/588, 589

[56] References Cited

U.S. PATENT DOCUMENTS

| | | | |
|---|---|---|---|
| 4,493,984 | 1/1985 | Yamauchi | 219/501 |
| 4,598,195 | 7/1986 | Matsuo | 219/497 |
| 4,853,519 | 8/1989 | Tanaka et al. | 219/497 |
| 4,868,368 | 9/1989 | Araki | 219/216 |
| 4,878,092 | 10/1989 | Arai . | |
| 4,914,476 | 4/1990 | Nishitsuji et al. | 355/208 |
| 4,920,250 | 4/1990 | Urban . | |
| 5,026,971 | 6/1991 | Payne | 219/483 |
| 5,179,263 | 1/1993 | Koh et al. | 219/216 |
| 5,278,394 | 1/1994 | Morino | 219/497 |

FOREIGN PATENT DOCUMENTS

| | | |
|---|---|---|
| 043913 | 1/1982 | European Pat. Off. . |
| 162619 | 11/1985 | European Pat. Off. . |
| 222120 | 5/1987 | European Pat. Off. . |
| 59-68769 | 4/1984 | Japan . |
| 3-33881 | 2/1991 | Japan . |
| 3-209492 | 12/1991 | Japan . |

*Primary Examiner*—Mark H. Paschall

*Attorney, Agent, or Firm*—Fitzpatrick, Cella, Harper & Scinto

[57] ABSTRACT

An image heating apparatus includes a heater; temperature detector for detecting a temperature of the heater; electric power supply controller for controlling electric power supply to the heater during image heating, so that the temperature detector detects a predetermined set temperature; and a temperature determining device for determining the set temperature on the basis of a change of the temperature detected by the temperature detector when electric power supply to the heater is stopped.

27 Claims, 54 Drawing Sheets

(a)

(b)

| TIME | RISING SPEED | SET TEMP. |
|---|---|---|
| >1sec | <10°C/sec | 210°C |
| 0.5~1sec | 10~20°C/sec | 200°C |
| 0.33~0.5sec | 20~30°C/sec | 190°C |
| <0.33sec | >30°C/sec | 180°C |

(a)

(b)

| TEMP. DWN | DWN SPEED | SET TEMP. |
|---|---|---|
| >25°C | >50°C/sec | 210°C |
| 20~25°C | 40~50°C/sec | 200°C |
| 15~20°C | 30~40°C/sec | 190°C |
| <15°C | <30°C/sec | 180°C |

(a)

(b)

| REACHED TEMP | SET TEMP. |
|---|---|
| <120°C | 210°C |
| 120~140°C | 200°C |
| 140~150°C | 190°C |
| >150°C | 180°C |

(a)

(b)

| TIME | RISING SPEED | SET TEMP. |
|---|---|---|
| >1sec | <10°C/sec | 210°C |
| 0.5~1sec | 10~20°C/sec | 200°C |
| 0.33~0.5sec | 20~30°C/sec | 190°C |
| <0.33sec | >30°C/sec | 180°C |

(a)

(b)

| TEMP UP | SET TEMP. |
|---|---|
| <10°C | 210°C |
| 10~15°C | 200°C |
| 15~20°C | 190°C |
| >20°C | 180°C |

| UP SPEED | POWER | | |
|---|---|---|---|
| | 475~525 | 525~575 | 575~625 |
| <5°C/sec | 210 | 210 | 210 |
| 5~10 | 200 | | |
| 10~15 | | 200 | |
| 15~20 | 190 | | 200 |
| 20~25 | | 190 | |
| 25~30 | 180 | | 190 |
| 30~35 | | 180 | |
| >35 | | | 180 |

T1 : TIME FROM TRAILNG EDGE DETECTION TO TRAILING EDGE ARRIVAL AT FIXING DEVICE

T2: TIME FROM / TOP SIG TO Xmm POSITION (TABLE 6)

IMAGE HEATING APPARATUS CHANGING SET TEMPERATURE IN ACCORDANCE WITH TEMPERATURE OF HEATER

FIELD OF THE INVENTION AND RELATED ART

The present invention relates to an image heating apparatus for heating an image on a recording material by heat from heater maintained at a predetermined temperature. The image heating apparatus is used for fixing an unfixed image or for improving surface property of an image.

Widely used conventional image fixing apparatus uses heat roller or the like maintained at the predetermined temperature, and the heat from a heater is used to fix an image on the recording material.

Recently, a film fixing type has been proposed which uses a thin film and a thermal head instantaneously increasing in temperature upon electric power supply thereto.

Referring first to FIG. 14, an example of such a heating and fixing apparatus is shown. Reference numeral 21 designates a heater; 27, a holder for insulatively supporting the heater; 28, a stay for supporting the holder 27; and 22, a fixing film.

A driving roller functioning also as a pressing or back-up roller 23 comprises a rubber elastic layer made of silicone rubber or the like having a good parting property, and is effective to press the fixing film 22 to the heater 21 with a force required for the fixing in a direction of an arrow D by an unshown pressure means. Reference numerals 24 and 25 designate confining guides for confining lateral ends of the fixing film 22; 26, a guiding shaft in the form of a central shaft of the confining guides 24 and 25. The confining guides 24 and 25 are rotatably mounted at the opposite ends with a space therebetween which is slightly longer than the width of the fixing film 22. The fixing film is trained around the heater 21 and the guiding shaft 26.

Reference numerals 29, 30 and 31 designate an inlet guide, a separation guide and a discharging roller, respectively.

When the driving roller 23 also functioning as a pressing roller rotates in the direction E, the fixing film 22 is conveyed in a direction of an arrow F with the aid of the pressure to the heater 21. At this time, the image on the recording material fed by the nip between the fixing film 22 and the pressing roller 23, is heated and fixed. FIG. 15 shows change with time of the heater temperature, the film temperature and back-up roller surface temperature during the fixing operation. With the start of the fixing operation, the heater is maintained at a constant temperature 200° C. On the other hand, since the back-up roll has a large thermal capacity, the surface temperature thereof gradually increases. At this time, the film temperature gradually increases between the heater temperature and the back-up roller surface temperature, and the degree of the change is as high as approximately 40° C.

If the film temperature is lower than $\beta$° C., the insufficient image fixing occurs, whereas if it is higher than $\alpha$° C., a high temperature offset occurs.

If the heater temperature is set in an attempt to prevent the insufficient image fixing, so that the film temperature becomes higher than $\beta$° C. at the first sheet, the high temperature offset occurs in the seventh and subsequent sheets since the apparatus becomes warmer. If, on the contrary, the heater temperature is decreased in order to prevent the high temperature offset after the seventh sheet, the image fixing is insufficient for the first sheet in which the apparatus is cold.

It would be considered to decrease the heater temperature in the case where a predetermined number of printing operations are carried out in a continuous printing mode. However, depending on the warming degree of the apparatus, the heater temperature for the first sheet for providing the proper film temperature and the proper number of sheets to decrease the heater temperature, are different, and therefore, the high temperature offset and/or low temperature offset are still produced.

SUMMARY OF THE INVENTION

Accordingly, it is a principal object of the present invention to provide an image heating apparatus in which insufficient image fixing and high temperature offset are avoided.

It is another object of the present invention to provide an image heating apparatus in which the setting temperature for image heating can be determined on the basis of temperature change of the heater.

It is a further object of the present invention to provide an image heating apparatus in which the temperature rise in the non-sheet-passage portion is prevented.

It is a further object of the present invention to provide an image heating apparatus in which the electric power supply to the heater can be stopped in the recording material absent period during the continuous image heating mode operation.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 36 is a graph of temperature changes of a heater and a film for each number of sheets passed through.

DESCRIPTION OF THE PREFERRED EMBODIMENTS

Referring to the accompanying drawings, the embodiments of the present invention will be described.

Figure 1:
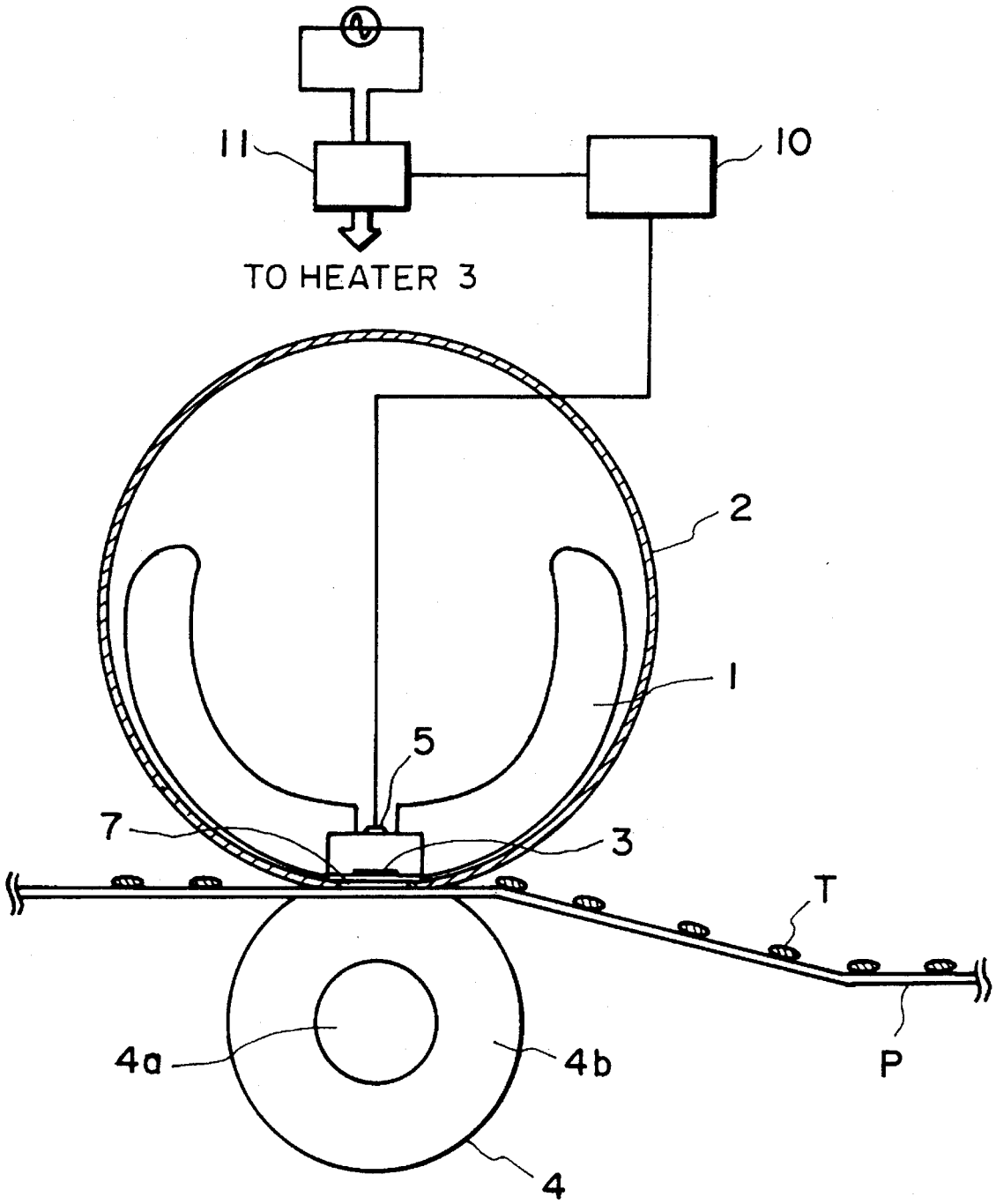
FIG. 1 is a sectional view of an image heating apparatus according to an embodiment of the present invention.

FIG. 1 is a sectional view of an image heating apparatus according to an embodiment of the present invention.

A heat resistive endless film 2 is extended around a stay 1 which functions as a guiding member together with the heater. The relationship between an internal circumferential length of the endless heat resistive film and the outer peripheral length of the guiding member including the heater and the stay, is such that the former is slightly larger, by 3 mm, for example. Therefore, the film 2 is loosely extended relative to the stay 1.

In order to increase the quick start property by decreasing the thermal capacity of the film 2, the film has preferably a thickness not more than 100 microns, further preferably not less than 50 microns and not less than 20 microns. It may be a heat resistive single layer of PTFE, PFA or FEP, or a multi-layer film having a polyimide, polyamide imide, PEEK, PES, PPS or the like resin material coated with PTFE, PFA, FEP or the like material. In this embodiment, a polyimide film coated with PTFE material was used.

The heater 3 comprises a base plate of aluminum or the like, and an electric resistor material of Ag/Pd (silver palladium) or the like having a thickness of approx. 10 microns and a width of 1–3 mm by screen printing or the like. It further comprises a protection layer 7 of fluorinated resin material or the like. A pressing or back-up roller 4 is cooperative with the heater 3 to form a nip with the film 2 interposed therebetween. It is effective to rotate the film. It comprises a core metal 4-*a*, and a good heat resistive rubber 4-*b* of silicone rubber or the like having a good parting nature. It is driven by an unshown means at one end of the core metal 4-*a*.

For the temperature control, an output of a thermistor 5 on the heater 3 is A/D-converted, and is introduced into CPU 10. On the basis of the information, a phase and/or a number of waves of an AC voltage to be supplied is controlled by a Triac, thus controlling the electric power supply to the heater. More particularly, the electric power supply is controlled so as to increase the heater temperature when the temperature detected by the thermistor 5 is lower than a predetermined set temperature and so as to decrease the heater temperature when it is higher than that, by which the heater temperature is maintained at a constant level during the fixing operation.

The powdery toner image not fixed on the recording material, is fixed by the heat and pressure applied in the nip.

The image heating apparatus is used as a fixing device for an image forming apparatus such as a copying machine, printer or the like. During the continuous printing operation as a result of plural image forming operation instruction, the fixing operation is carried out continuously.

During the stand-by period waiting for the printing instructions, the electric power supply to the heater is shut-off and upon actuation of the main switch, and after the printing instructions are produced, the electric power supply to the heater is started.

Figure 2:
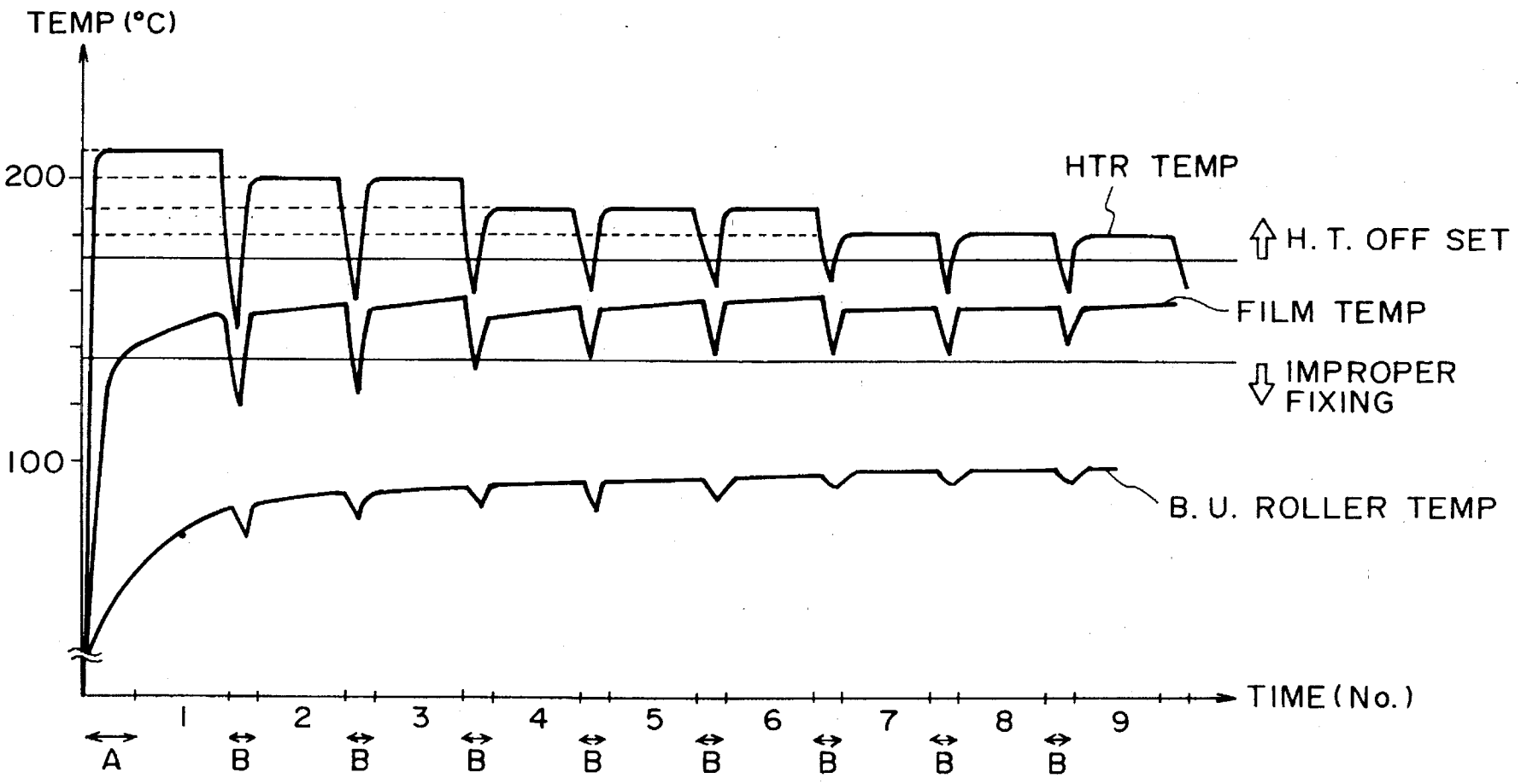
FIG. 2 shows temperature changes of a heater, a film and a back-up roller.

FIG. 2 shows temperatures of the heater, the film and the back-up roller, during continuous printing operation.

Figure 3:
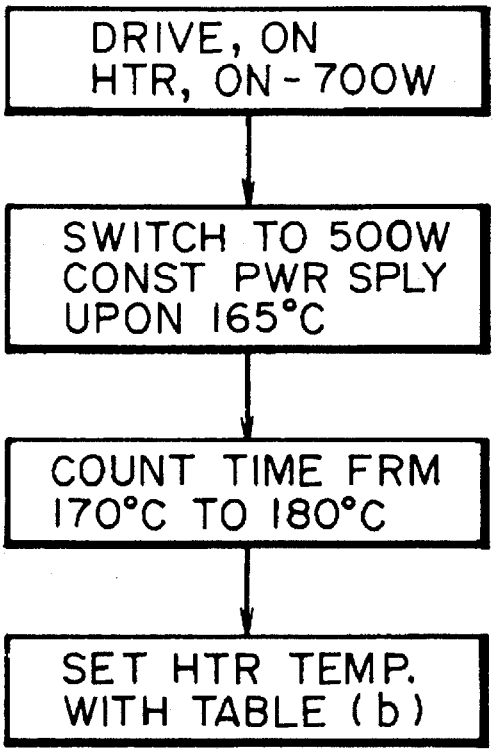
FIG. 3 shows an algorithm for determining the set temperature in an embodiment of the present invention at (a), and a control table at (b).

When the continuous printing operation is started, the fixing temperature is first determined in accordance with the algorithm shown in FIG. 3 in the heater starting up operation A. If the printing instruction is produced during the stand-by period, the heater is energized by a low electric power supply of 700 W. When the thermister 5 detects the temperature of 165° C., the power supply control is switched to 500 W constant power supply.

In the constant power control, the phase and the number of waves are controlled in accordance with the voltage of the AC voltage source and the resistance of the electric resistor material.

In this embodiment, a heater of 700 W supplied with 100% power with the frequency of 50 Hz and the AC voltage of 100 V, is used. It is alternately actuated with 100 msec on and 40 msec off to provide a constant electric power supply of 500 W.

At this time, if the entire apparatus is cold, the temperature rising speed of the heater is not steep. If, on the contrary, the entire apparatus is warm, the temperature rising speed is higher. Therefore, if the temperature rising speed of the heater is considered, the temperatures of the back-up roller and the stay can be predicted. In response to it, the heater set temperature for the first sheet is changed, by which the insufficient image fixing or the high temperature offset can be prevented despite the temperature state of the apparatus.

With the increase of the printing operations, the apparatus temperature increases. Therefore, in this embodiment, the heater set temperature is determined during a sheet absent period in the continuous printing operation.

Figure 4:
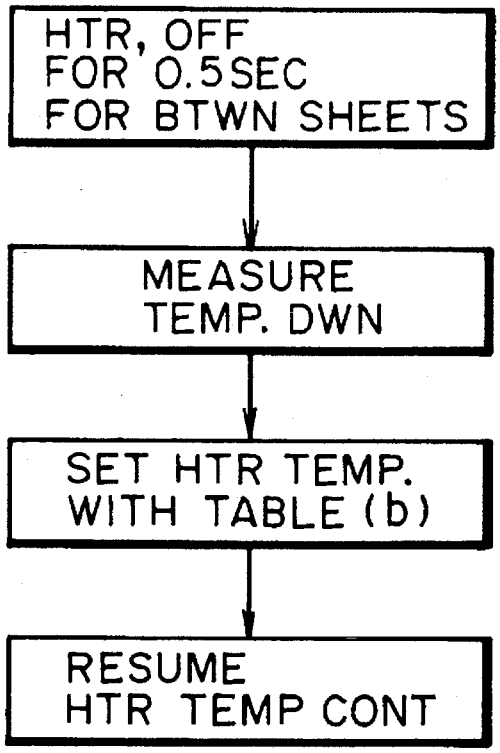
FIG. 4 shows an algorithm for determining of another set temperature according to an embodiment of the present invention at (a), and a control table at (b).

FIG. 4 shows an algorithm for determination of the set temperature during the sheet absent period. Simultaneously with or after passage of the recording material through the nip, the electric power supply to the heater is forcedly shut-off for 0.5 sec. Then, the temperature decrease of the heater in the 0.5 sec in which the power supply to the heater is not carried out, is measured. If the entire apparatus is warm, the temperature lowering speed is low. If, on the other hand, the entire apparatus is cold, the temperature rising speed of the heater is high.

Accordingly, if the temperature decreasing speed is considered, the temperatures of the back-up roller or the stay can be predicted. In accordance with the prediction, the heater set temperature is changed to provide a constant film temperature, thus preventing insufficient or improper image fixing or the high temperature offset can be prevented.

Thus, the heater set temperature can be changed at proper timing even if a cold start or even in a hot start, so that the film temperature is made constant.

The determination of the set temperature may be carried out for a predetermined number of sheets, for example for every other sheets, for every other three sheets or the like. However, it is preferable that the determination is carried out for each of the sheets.

However, with the continuation of the continuous printing operation, the apparatus temperature saturates, and therefore, it is not necessary after a predetermined number of prints are produced.

Figure 5:
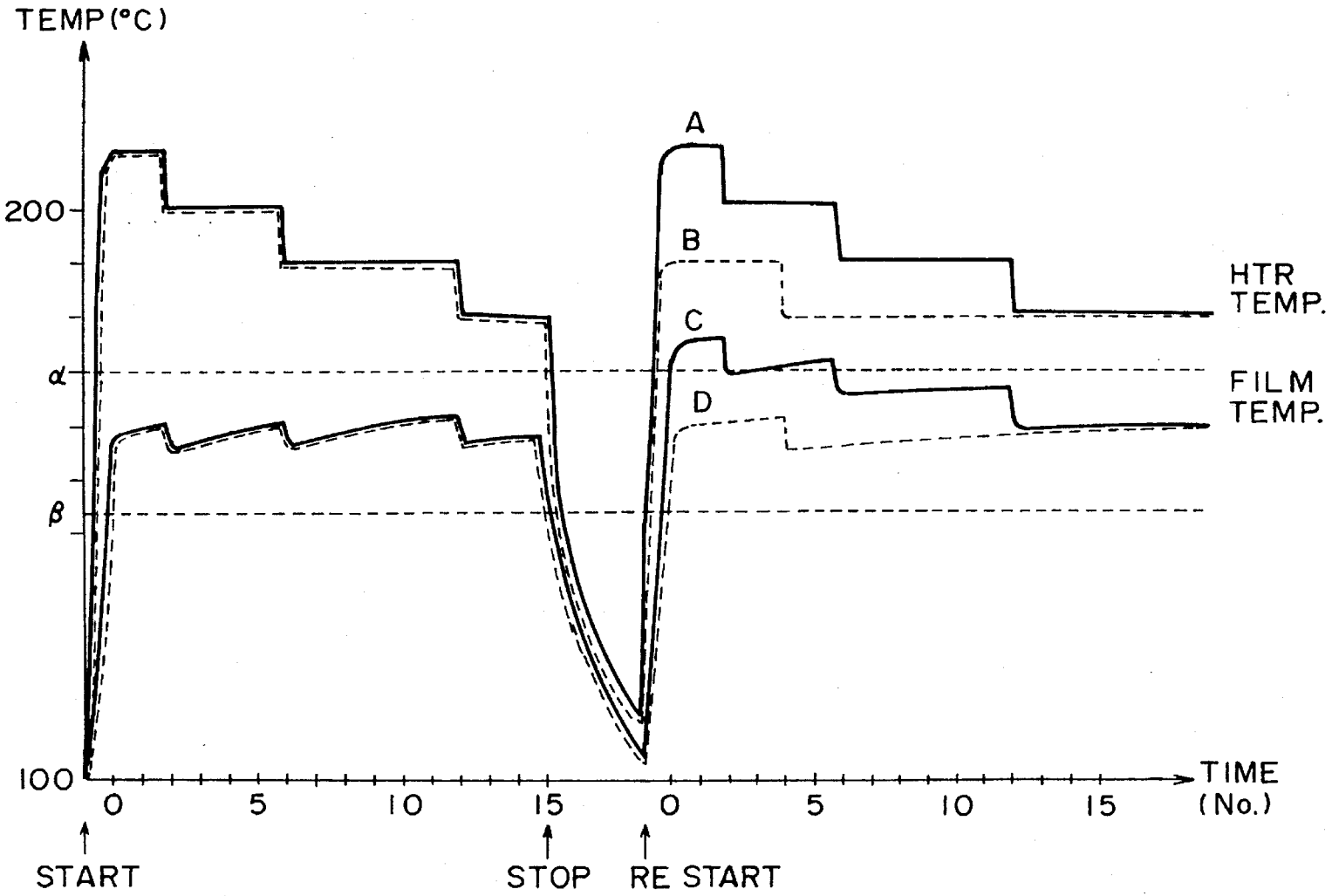
FIG. 5 shows temperature changes of heater and film in an embodiment of the present invention and in a comparison example.

FIG. 5 shows temperature changes, with time, of the heater and the film in the embodiment of the present invention and a comparison example in which the heater set temperature is decreased after a predetermined number of prints are produced.

Solid lines A and C represent the comparison example, in which A designates the heater temperature; and C, the film temperature.

Broken lines B and D represent the embodiment of the present invention, in which B designates the heater temperature; and D, the film temperature.

In this embodiment, the electric power supply to the heater is shut off for a predetermined period in the sheet absent period, and therefore, the heater and film temperatures actually decrease, but the decrease is omitted for simplicity, here.

When 15 sheets are printed with the cold start, the set temperature is correct, and therefore, the solid line C, similarly to the broken line D (this embodiment), is between the high temperature offset limit temperature $\alpha$ and the insufficient or improper limit temperature $\beta$ and the temperature change of the film is small.

However, if the operation is re-started immediately after 15 continuous printing operations, the heater set temperature is 210° C. despite the apparatus is warm even for the first sheet, in the comparison example. For this reason, the film temperature exceeds the high temperature offset limit temperature $\alpha$ with the result of offset produced. However, in this embodiment, the warm condition of the apparatus is detected, and therefore, the heater temperature for the first sheet is 190° C. From the fifth sheet, the heater temperature is switched to 180° C., thus providing substantially constant film surface temperature despite the ambient condition of the apparatus.

Figure 6:
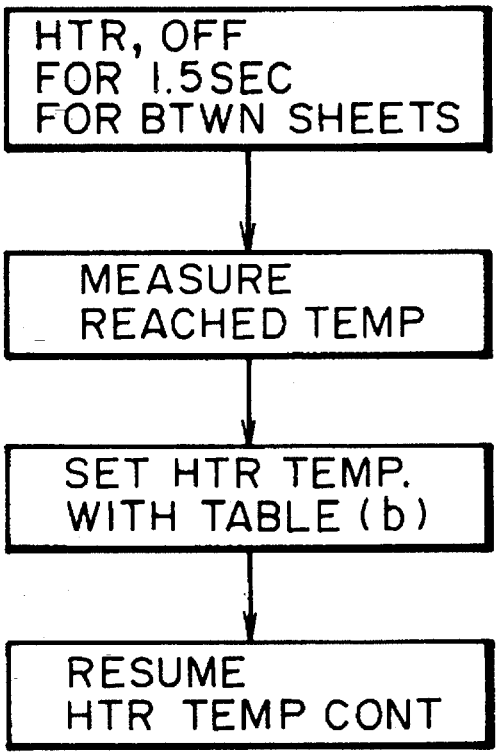
FIG. 6 shows an algorithm for determining a set temperature according to a further embodiment of the present invention at (a), and a control table at (b).

FIG. 6 shows an algorithm for determination of the set temperature in an embodiment of the present invention.

Simultaneously with the passage of the recording material through the nip, the heater is shut-off for 1.5 sec, and the temperature reached after 1.5 sec is detected. In accordance with the temperature reached, the set temperature for the heater is determined.

Figure 7:
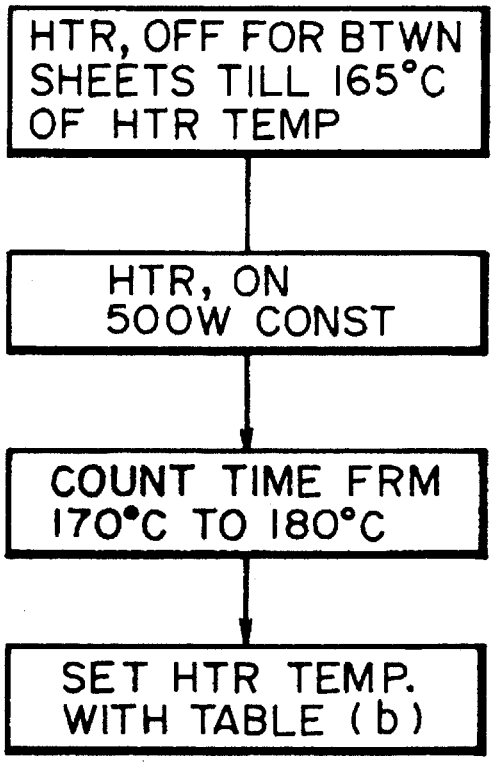
FIG. 7 shows an algorithm for determining a set temperature according to a further embodiment of the present invention at (a), and a control table therefor at (b).

FIG. 7 shows another algorithm for determination of the set temperature in an embodiment of the present invention. Simultaneously with the passage of the recording material through the nip, the heater is deenergized, and simultaneously with the heater temperature reached 165° C., the power supply is resumed. Subsequently, similarly to the example of FIG. 3, the set temperature is determined on the basis of the time period required by the temperature rise from 170° C. to 180° C.

According to this embodiment, the same data table is usable for the start-up A or for the sheet absent period B, and therefore short program is usable.

Figure 8:
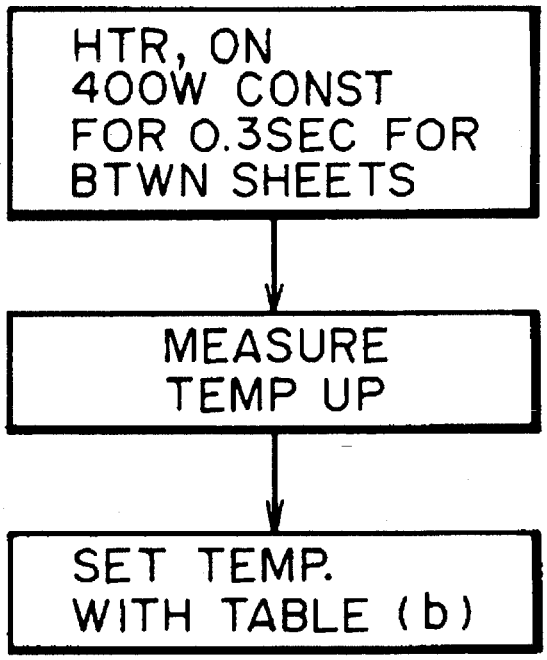
FIG. 8 shows an algorithm for determining a set temperature according to a further embodiment of the present invention at (a), and a control table therefor at (b).

FIG. 8 shows a further algorithm for the determination of the set temperature. Simultaneously with the start of the sheet absent period B, 400 W constant electric power is forcedly supplied for 0.3 sec, and the temperature rise in 0.3 sec is detected, and the heater set temperature is changed in accordance with the temperature rise detected. The 400 W constant electric power supply is effected by repeating 40 msec on and 30 msec off alternately, using 700 W heater (100% power supply) with the frequency of 50 Hz and the AC voltage of 100 V.

Figure 9:
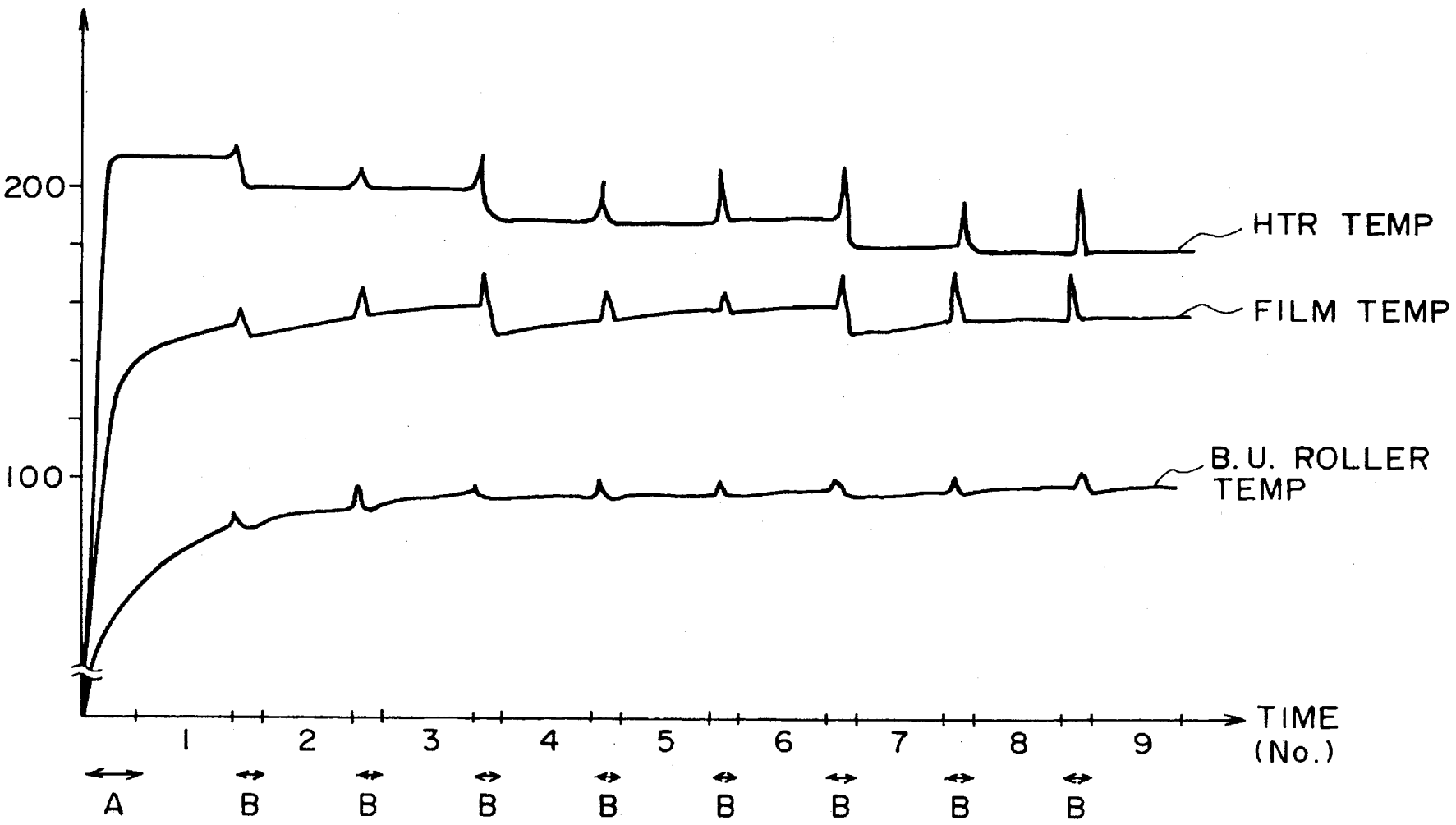
FIG. 9 shows temperature changes of a heater, a film and a back-up roller, according to an embodiment of the present invention.

FIG. 9 shows the temperature changes, with time, of the heater, the film and the back-up roller, when the set temperature is determined in the sheet absent period, shown in FIG. 8. For the start-up period A, the method of FIG. 3 is used. By changing the heat set temperature in accordance with the apparatus condition, as shown in FIG. 9, the film temperature can be maintained substantially constant.

For the determination of the heater set temperature for the first sheet, in FIG. 3 example, the temperature rising speed during the constant electric power supply is detected. However, this example requires highly accurate constant power control circuit.

Figure 10:
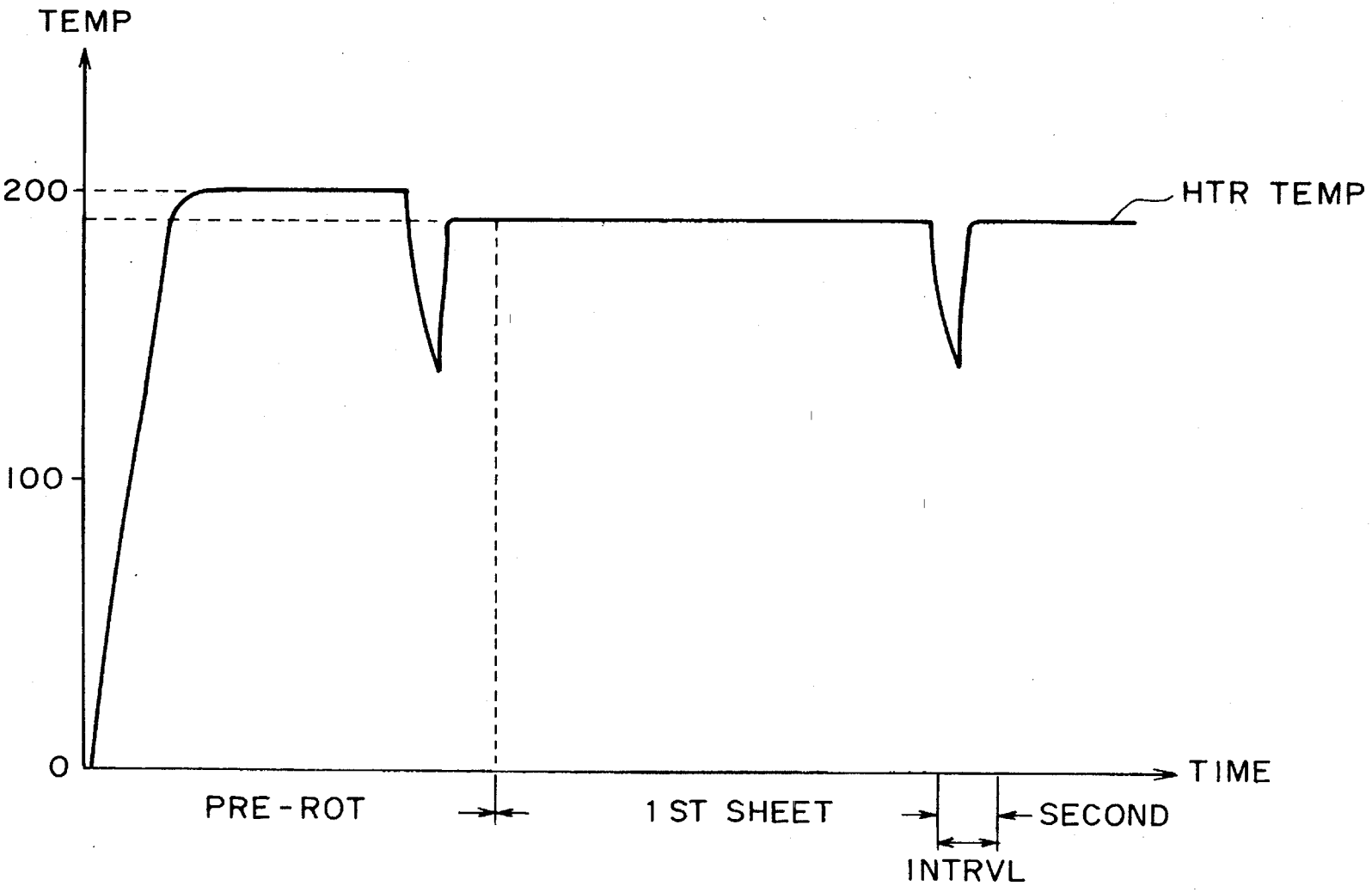
FIG. 10 shows a heater temperature in an apparatus according to a further embodiment of the present invention.

In view of this, FIG. 10 example, the electric power supply to the heater is forcedly shut-off immediately before entrance of the first recording material to the nip in a later part of a pre-rotation period in which the film and the pressing roller cooperatively rotate at the heater start-up period. The temperature decrease at this time or the temperature reached, is used to determine the heater set temperature.

This example does not require a particular constant electric power control circuit. The time required for a predetermined temperature decrease, may be detected.

When the heater set temperature is determined on the basis of heater temperature decrease, such a small electric power as to decrease the temperature of the heater may be supplied, rather than completely stopping the electric power supply to the heater.

For example, when the heater is maintained about 200° C. by 250 W power supply to the heater, the usable temperature change can be detected even if 100 W is supplied.

When the heater temperature is determined using the increasing speed when the heater is energized, the temperature setting is possible even if the apparatus is not driven. It is a possible alternative, as shown in FIG. 11, that the temperature is set during the apparatus being at rest, and thereafter, the apparatus is driven.

In this embodiment, it is a possible alternative that when the temperature rising speed is detected while a constant electric power is supplied, the electric power supply is detected, and the deviation from the target power supply is calculated, in response to which deviation, the heater temperature setting is corrected.

Figures 11, 12:
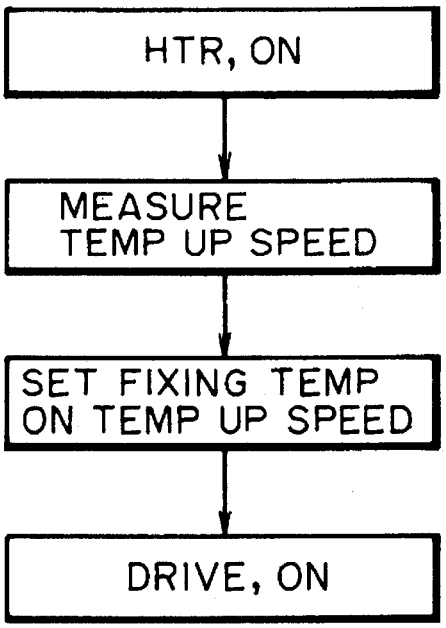
FIG. 11 shows an algorithm for determination of a set temperature in an apparatus according to a further embodiment of the present invention.
FIG. 12 shows a control table used for determination of a set temperature according to a further embodiment of the present invention.

For example, in the algorithm shown in FIG. 3, the temperature setting table when 500 W constant power is supplied is changed and corrected in accordance with the electric power supply, as shown in FIG. 12. By correcting the set temperature in accordance with the electric power supply, the necessity for the highly accurate constant power control circuit, is eliminated.

In a preferred form, when the apparatus is cold immediately after actuation of the main switch or upon start of the printing operation, the heater setting temperature is determined while warming the apparatus during the sheet absent period, using the method shown in FIG. 8; and when the apparatus becomes warm as a result of a predetermined number of printing operations, the method shown in FIG. 4 is used to determine the heater set temperature while cooling the apparatus during the sheet absent period.

When the heater is forcedly actuated or deactuated during the sheet absent period, the heater temperature temporarily deviates from the set temperature. Therefore, an operation for returning the heater to the set temperature is desired. Then, on the basis of the ripple during the constant temperature control, the heater set temperature can be determined.

Figure 13:
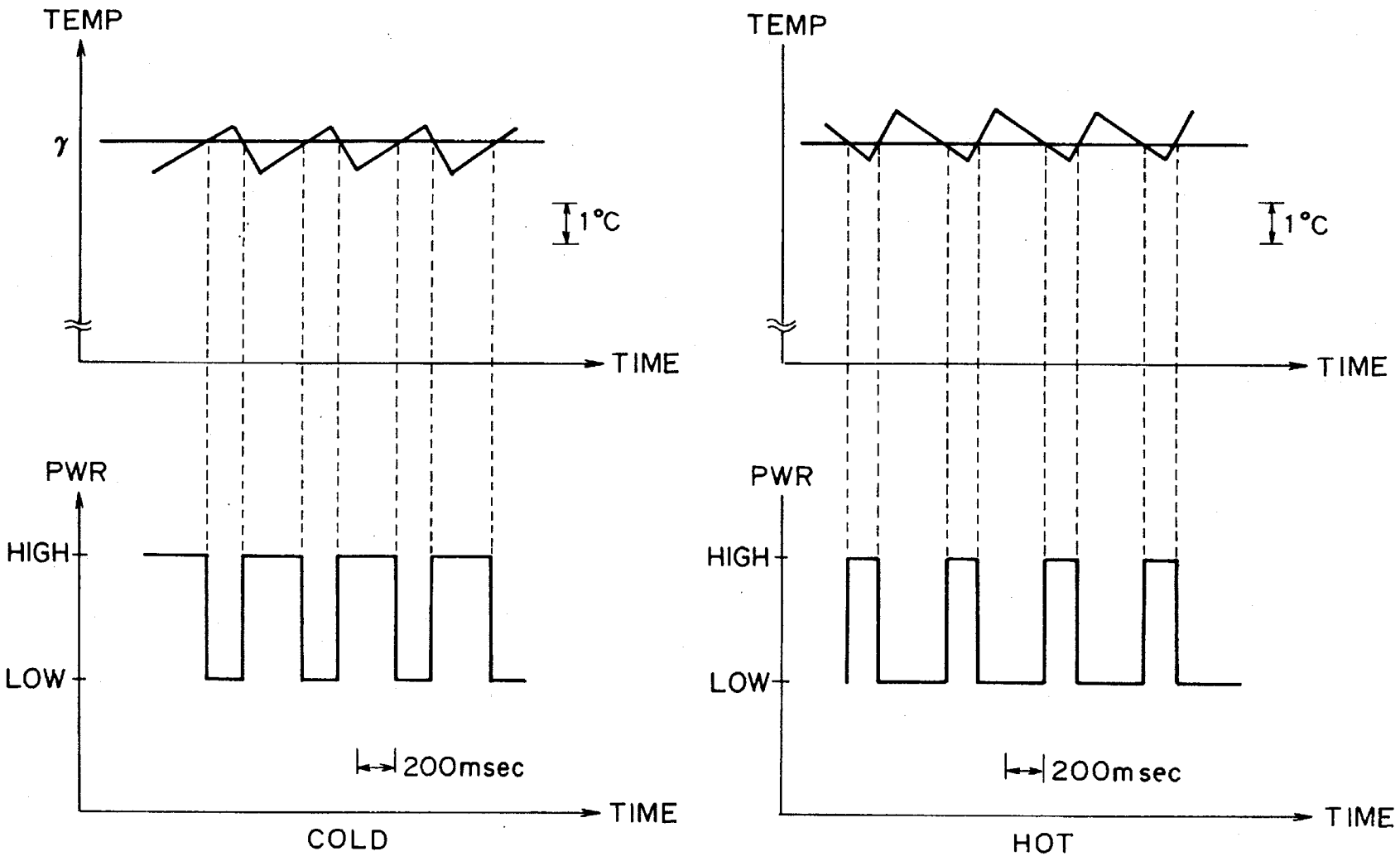
FIG. 13 shows a relationship between a heater temperature and an electric power supply.
Figure 14:
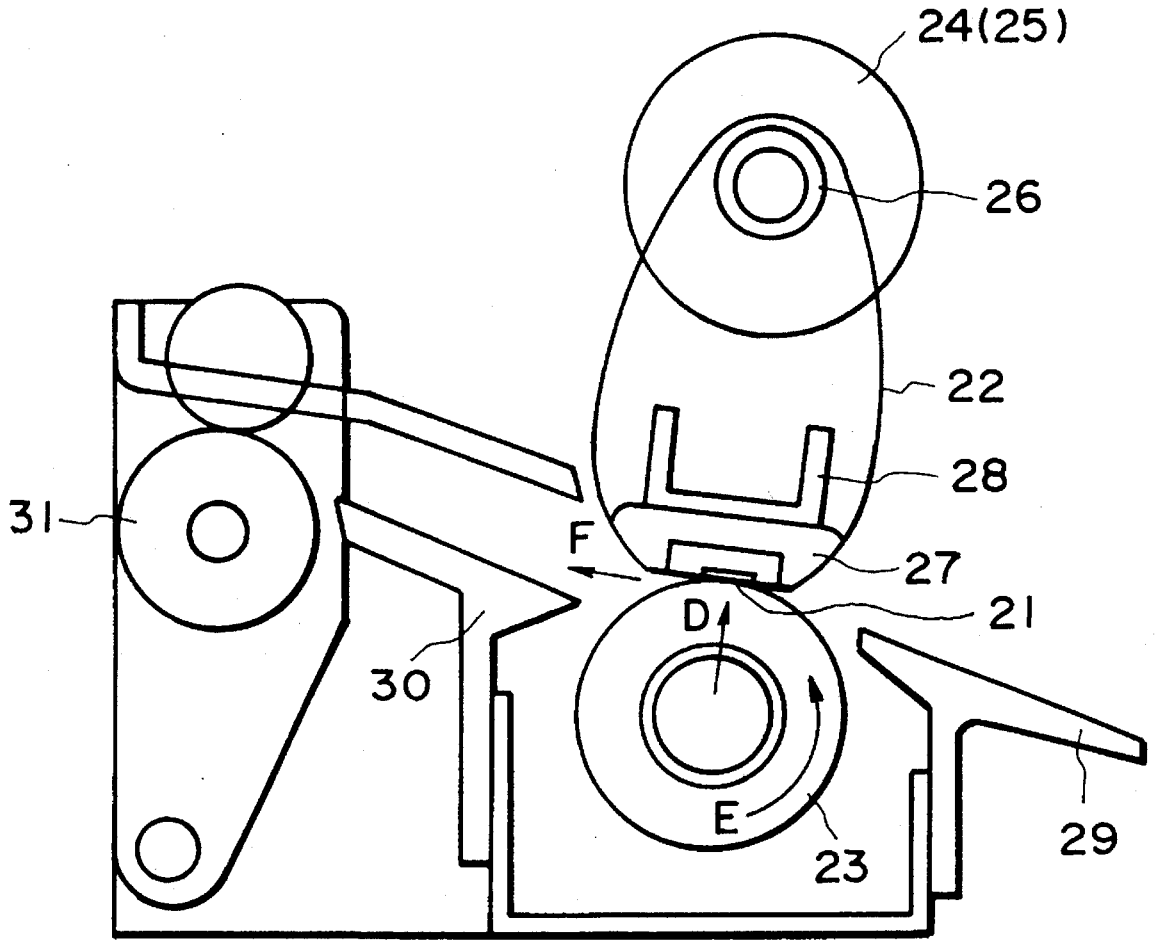
FIG. 14 is a sectional view of an image fixing apparatus not using the present invention.
Figure 15:
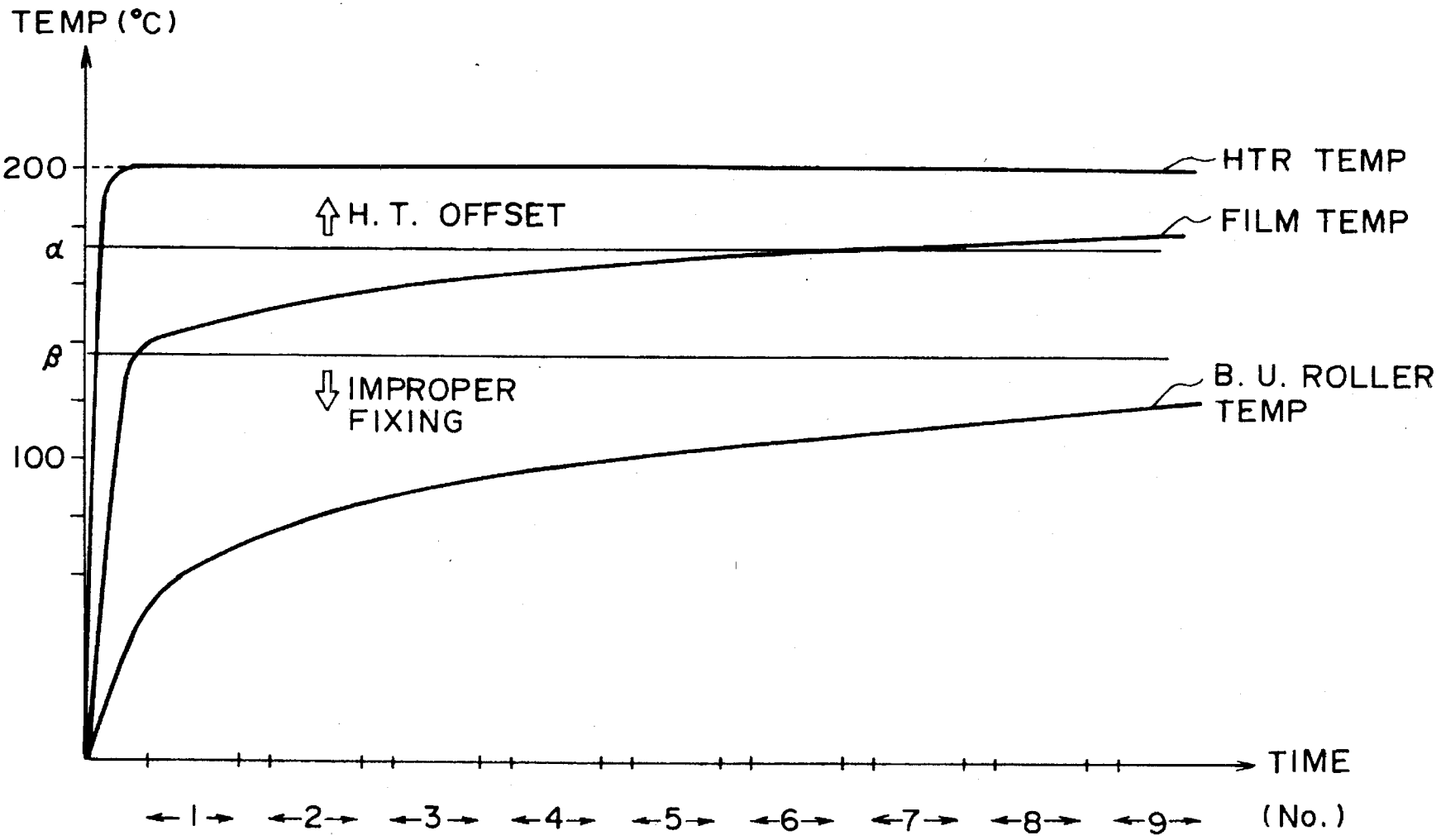
FIG. 15 shows a temperature changes of the heater, the film and the back-up roll in the apparatus of FIG. 14.

FIG. 13 shows changes, with time of the heater temperature and the electric power supply when the apparatus is cold, and the changes, with time, of the heater temperature and the electric power supply when the apparatus is warm.

When the heater temperature exceeds a temperature level $\gamma$, the low temperature LOW is applied; and when the temperature decreases beyond the temperature $\gamma$, the high power HIGH is applied. The low power LOW may be 0 W.

Since the temperature rising or decreasing speed is different depending on whether the apparatus is cold or hot, the heater temperature setting can be determined on the basis of the temperature rising speed of the temperature ripple and the change of the temperature decreasing speed.

The description will be made as to a further embodiment.

Figure 16:
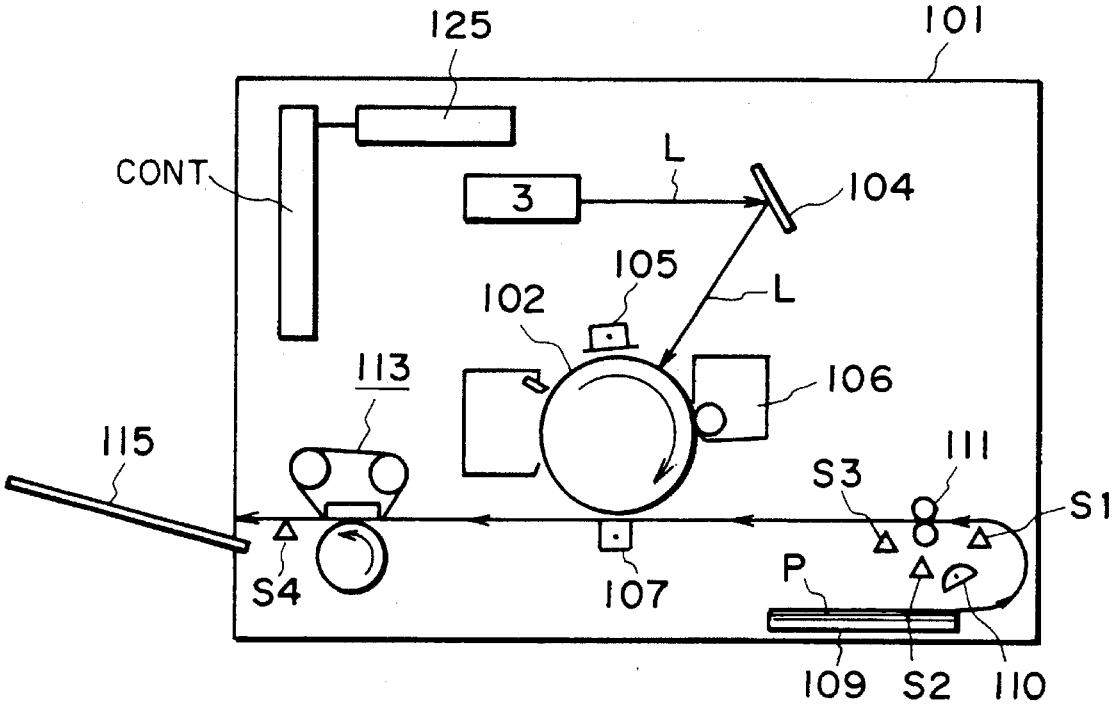
FIG. 16 shows an image forming apparatus in the form of a laser beam printer using an image heating apparatus according to an embodiment of the present invention.

In FIG. 16, an image forming apparatus is shown which uses as a fixing device the image heating apparatus according to a further embodiment of the present invention. Reference numeral 101 designates a casing of a main assembly of the image forming apparatus in the form of a printer. It comprises a photosensitive drum which is rotated in the clockwise direction (arrow) at a predetermined peripheral speed (process speed).

The outer peripheral surface of the rotatable photosensitive drum 102 is uniformly charged by a charger 105. Then, it is exposed to a scanning laser beam L emitted from an optical unit (laser scanner unit) 103, so that an electrostatic latent image corresponding to the intended image information is formed on the outer peripheral surface of the photosensitive drum. The laser beam is folded by mirror 104.

The optical unit 103 modulates the laser beam in accordance with the video data representing the desired image information supplied from a controller CONT through a video interface 124 (FIG. 18) to a printer engine controller 125. The modulated laser beam is incident on a polygonal mirror to scan the photosensitive drum 102.

The electrostatic latent image thus formed on the surface of the photosensitive drum 102 is developed into a toner image by a developing device 6.

The toner image is transferred onto a transfer material (recording material) fed to a transfer position which is between the photosensitive drum 102 and the transfer charger 107. The transfer sheet P is fed out of a cassette 109 by a pick-up roller 110 in seriatim. Reference S1 is a sheet sensor for detecting presence or absence of the sheet fed out.

A registration roller pair 111 functions to feed the sheet at a timed relation to the transfer position, more particularly, the registration rollers are stopped in response to sheet direction by the resist sensor S2, and the sheet leading edge is abutted to the nip of the registration roller pair 111 to temporarily stop the sheet. Reference S3 designates a top sensor disposed at a sheet outlet side of the registration roller pair 111, and it is effective to determine the timing for producing a sub-scan synchronization signal indicative of the print start to the controller.

The sheet having received the toner image transferred thereto at the transfer position, is separated from the surface of the photosensitive drum 102, and is conveyed to a heat fixing device (fixing unit) 113, where the toner image is fixed thereon. Finally, it is discharged out to a sheet discharge tray 115 as a print. A discharge sheet sensor S4 detects presence or absence of the sheet discharged from the heat fixing device 113.

Figure 17:
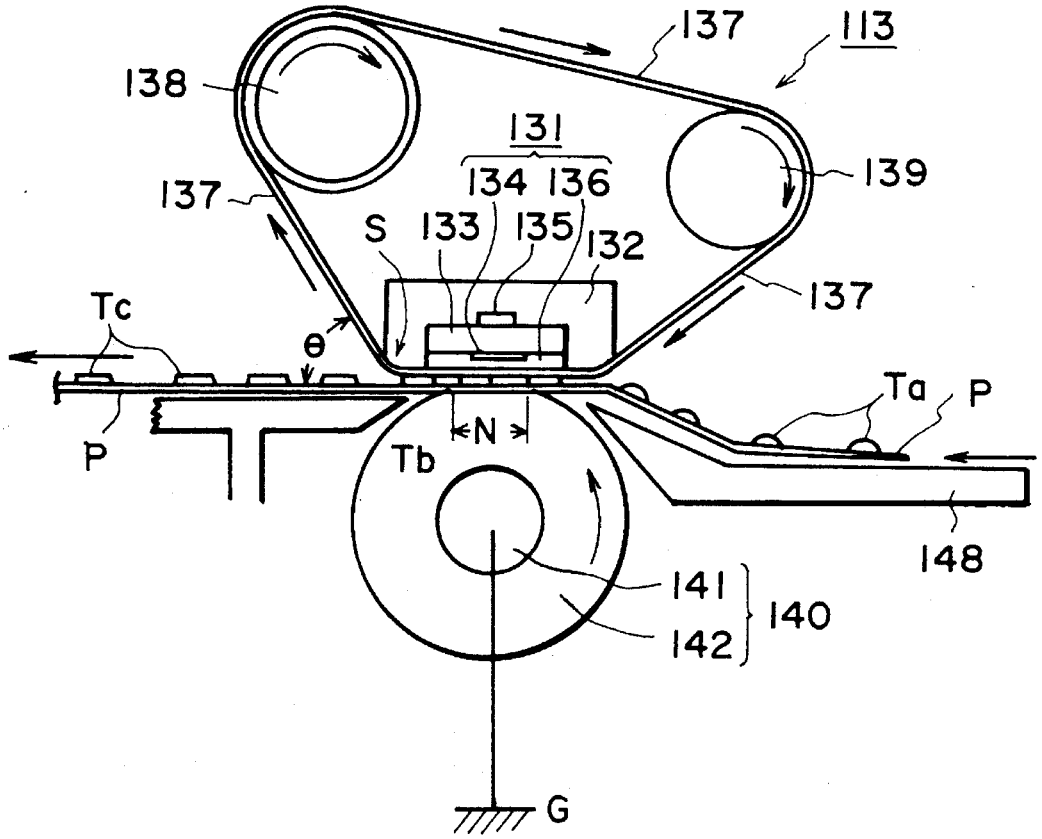
FIG. 17 shows a heat fixing apparatus according to a further embodiment of the present invention.

FIG. 17 is an enlarged sectional view of the fixing device 113. The fixing device comprises a heater for producing heat upon electric power supply thereto and a heat resistive film movable in the sheet movement direction while being contact with the heater. The fixing device is of a film heating type in which the sheet which is to be subjected to the image fixing operation is passed through the heater position together with the film while the sheet is being in contact with the opposite side of the film from the heater, so that the thermal energy from the heater is applied to the sheet to fix the image, and then the sheet is separated from the film surface.

A heat resistive fixing film in the form of an endless belt 137, is extended around three parallel members, i.e., left driving roller 138, right follower roller 139, and low thermal capacity linear heater 131 (heater) disposed at a lower level than the rollers 38 and 139.

The follower roller 139 also functions as a tension roller for the endless fixing film 137. The fixing film 137 is rotated together with the clockwise rotation of the driving roller 138 at a predetermined peripheral speed, that is, the same peripheral speed of the sheet P carrying thereon an unfixed toner image Ta coming thereto from the image transfer station described in the foregoing, in the clockwise direction, too, without crease, snaking motion or delay.

A pressing or back-up roller (member) 140 comprises a core metal 141 made of steel or stainless steel or the like and a rubber elastic layer 142 of silicone rubber or the like having good releasing or parting property. It is pressed to the bottom surface of the heater 31 by an unshown urging means with a total pressure of 8–12 kg, for example, with the lower travel of the fixing film 137 interposed therebetween. It rotates about an axis of the core metal 141 in the counterclockwise direction, that is, in the same peripheral direction as the recording material P movement direction. The core metal 141 is grounded (G) for preventing noise.

The fixing film 137, in this embodiment, comprises heat resistive and insulative base film having a thickness of approx. 40 microns and made of polyimide, polyether ketone, polyether sulfone, polyether imide, polyparabanic acid or the like material, and a parting layer, on such a side of the base film as is near the recording material, having a thickness of approx. 10 microns, made of PFA, PTFE or another fluorinated resin or silicone resin material which has been provided with electric conductivity by dispersing therein conductive material such as conductive whisker, carbon black, graphite or the like material (two layer structure). The parting layer also functions as the electrically conductive layer.

The heater 131 is in the form of a low thermal capacity linear heater extending in a direction crossing with the movement direction of the film 137, and comprises a heater base plate 133, a heat generating resistor (heat generating element) 134 for producing heat upon electric power supply thereto, a temperature sensor 135, and a surface protection layer 136 or the like. It is supported on a heater support 132.

The heater support 132 is of heat insulative, highly heat resistive and rigid material capable of insulatively supporting the heater 131 from the fixing device and therefore the entirety of the image forming apparatus.

The heater base plate 133 is heat resistive and insulative and has a low thermal capacity. For example, it is an alumina base plate having a thickness of 10 mm, a width of 10 mm and a length of 240 mm.

The heat generating element 134 is extended substantially at the center of the bottom surface (the surface facing to the film 137) of the base plate 133. It is printed by screen-printing, for example, electric resistance material such as Ag/Pd (silver-palladium), $Ta_2N$ or the like with a thickness of approx. 10 microns and a width of 1–3 mm. It is coated with a surface protection layer of heat resistive glass 36 having a thickness of approx. 10 microns.

A temperature sensor 135, for example, is a low thermal capacity temperature sensing element. It is, for example Pt film or the like screen-printed substantially at the center of the top surface (a surface opposite from the heat generating resistor 134 surface) of the base plate 133. As for another temperature sensor, a low capacity thermister or the like may be contacted to the base plate.

The heater 131 of this embodiment is supplied with electric power by the connection at the opposite longitudinal ends, so that the heat is generated substantially over the entire length of the heater 134 in the form of a stripe or line. A phase angle of the electric power supply to the heater 134 is controlled by a power supply control circuit (not shown) including Triac, in accordance with an output of set temperature sensor 134.

The recording material P is conveyed from the image transfer station to the fixing device 113. It carried on its top surface an unfixed toner image Ta. It is guided by a guide 148 and enters between the fixing film 137 and the back-up roller 140 of a nip N (fixing nip) formed between the heater 131 and the pressing roller 140. The image bearing surface of the recording material P is closely contacted to the bottom surface of the fixing film 137, while rotating in the same direction and at the same peripheral speed without the deviation, crease or lateral shifting. Thus, they are passed together through the nip between the heater 131 and the pressing roller 140, while receiving the pressure by the nip. The toner image Ta is heated by the heater 131 through the fixing film 137 in the nip N, and is softened or fused to an image Tb.

The fixing film 137 is steeply deflected at an acute angle (deflection angle θ of approx. 45 degrees) at a large curvature of radius (radius of curvature of approx. 2 mm) at the edge S of the supporting member 132. Therefore, the sheet P fed through the nip together with the fixing film 137 is separated from the fixing film 137 by the large curvature, and then is discharged to a sheet discharge tray 115. By the time that the sheet is discharged, the toner is sufficiently cooled and solidified, and therefore, is fixed on the recording material P as a toner image Tc.

Figure 18:
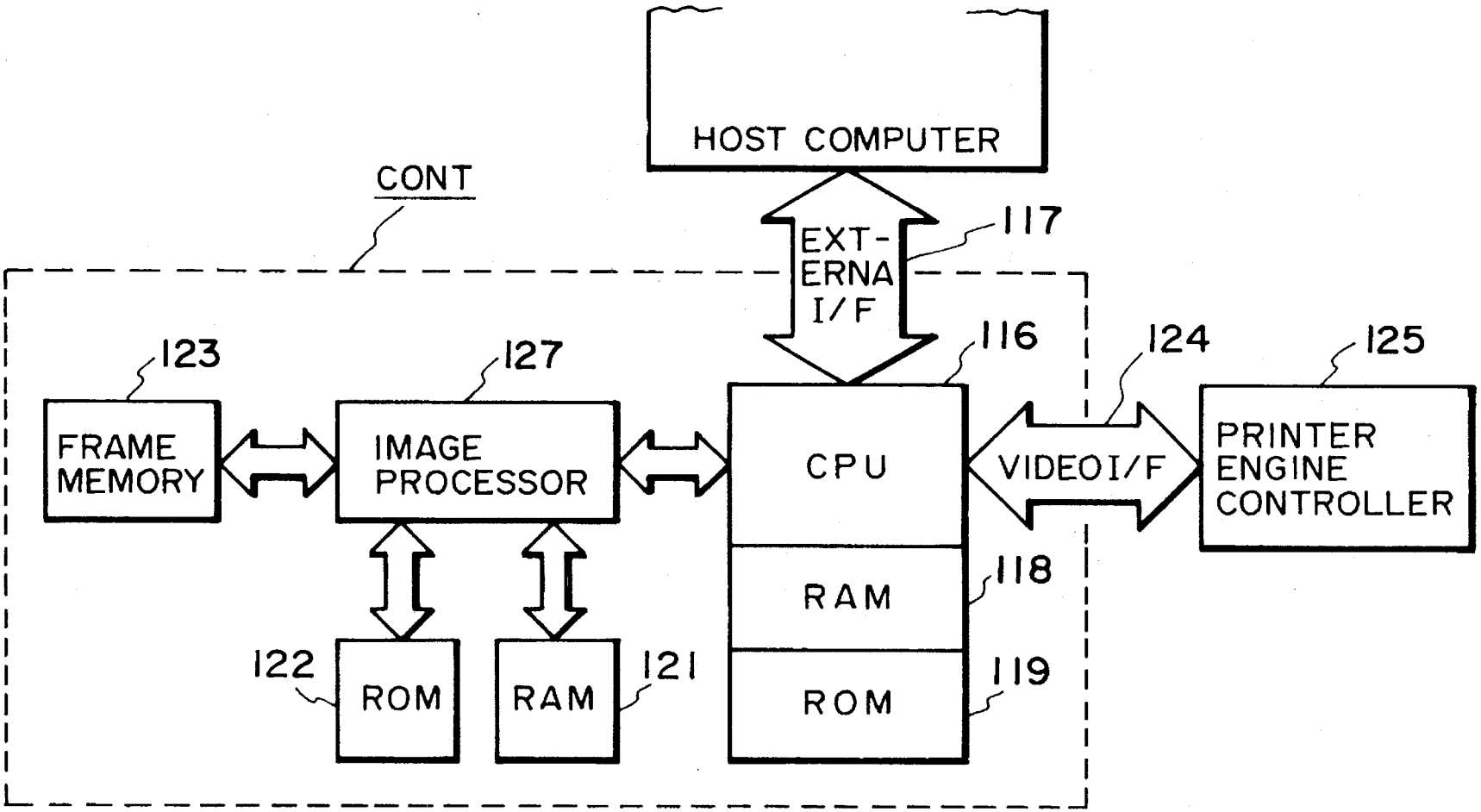
FIG. 18 shows a block diagram of a control system.
Figure 19:
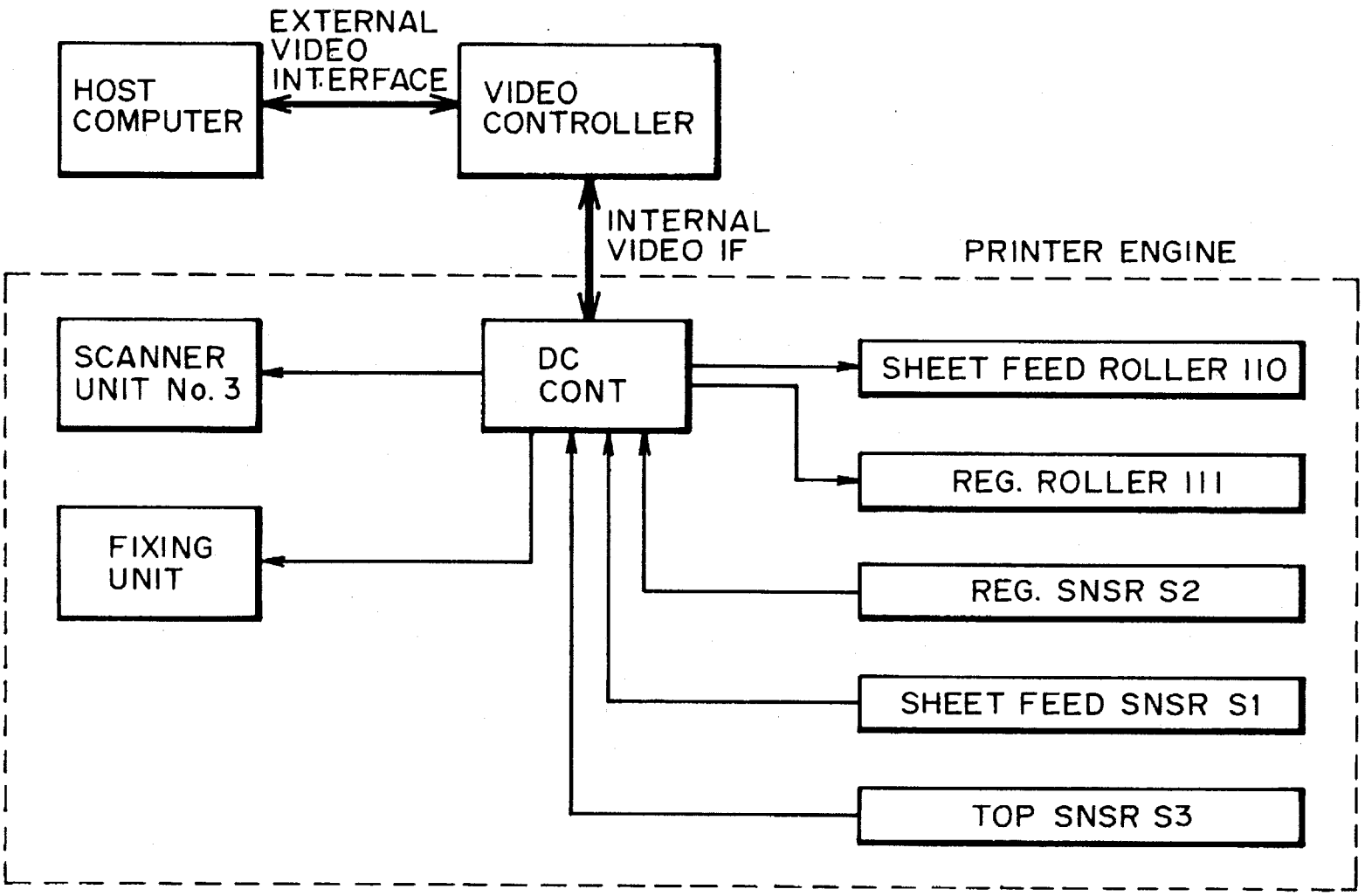
FIG. 19 is a block diagram of a control system for a printer engine.

Since, in this embodiment, the thermal capacity of the heat generating element 134 and the base plate 133 of the heater 131 is small and since it is insulatively supported from the supporting member 132, the surface temperature of the heater 131 at the nip N increases to a sufficiently high temperature relative to the toner fusing point (or the fixable temperature relative to the sheet P) by the electric power supply to the heat generating element 134, in a short period of time, and therefore, the stand-by temperature control in which the temperature of the heater 131 is increased beforehand, is not necessary. Therefore, the energy consumption can be saved, and the temperature rise within the apparatus can be prevented. Referring to FIG. 18, there is shown a block diagram of a data processing system for a printer, and FIG. 19 is a block diagram of a control system for the printer engine.

In FIG. 18, reference numeral 116 designates a CPU, which comprises a ROM 119 for storing control program and a RAM 118 used as a register or the like. Through an external interface 117, it receives a coded data from a host computer or the like, and the coded data are supplied to an image processor 120.

The image processor 120 stores the coded data in a RAM 121, and analyses the coded data. As desired, it reads out the data from character font stored in a ROM 122 to convert the coded data to a video data representing dot image, and the converted data are stored in a frame memory 123. When the video data for one page is stored in the frame memory 123, the CPU 116 generates printing instructions to the printer engine controller 125 through the video interface 124. In synchronism with the main and sub-scan synchronizing signals from the engine controller 125, the video data stored in the frame memory 123 are transmitted sequentially to the engine controller 125. The controller CONT is constituted by the above-described elements 116–124.

The description will be made as to the printing operation and the fixing temperature control operation.

Figure 20:
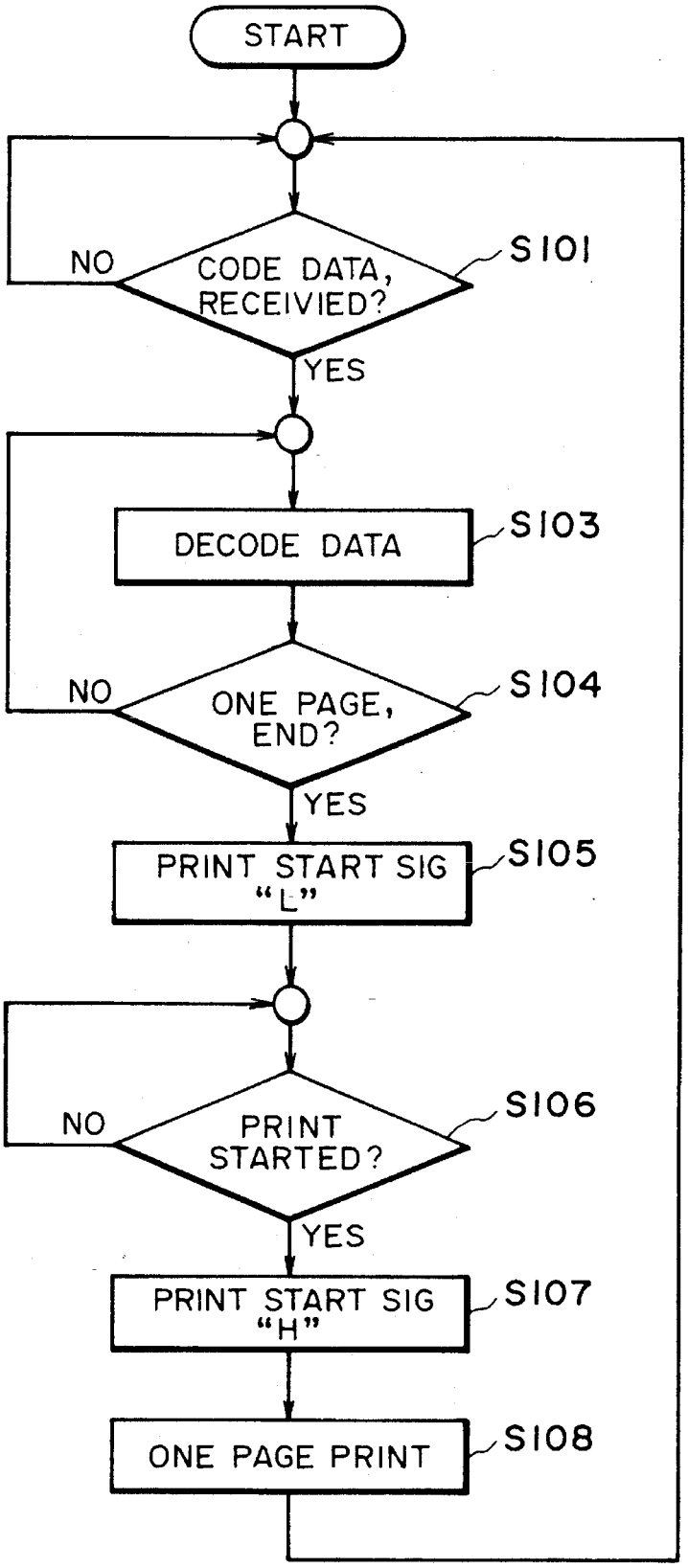
FIG. 20 is a flow chart showing sequential operations of a controller.
Figure 21A:
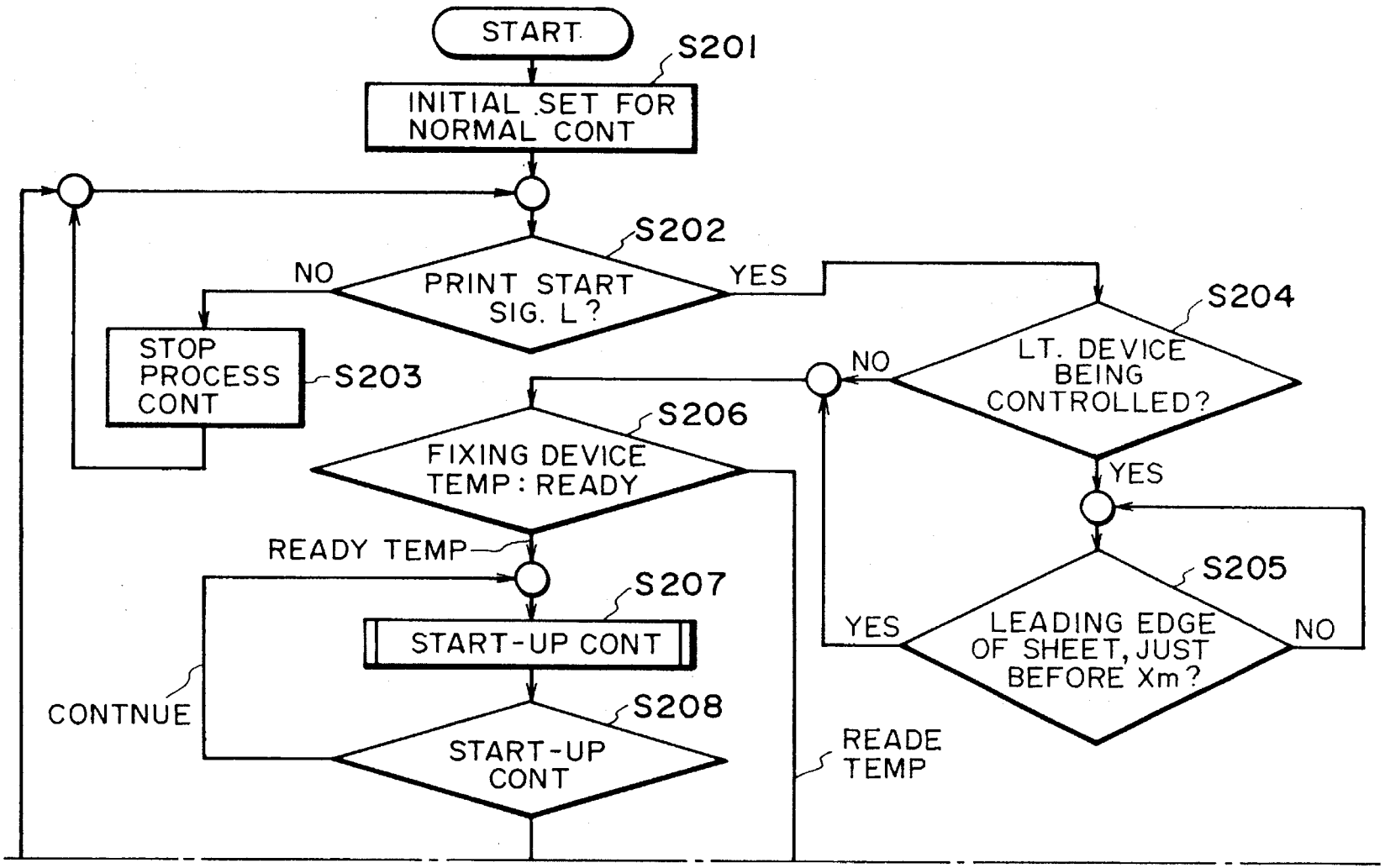
FIG. 21 is a flow chart of sequential operations of a printer engine.
Figures 21, 21B:
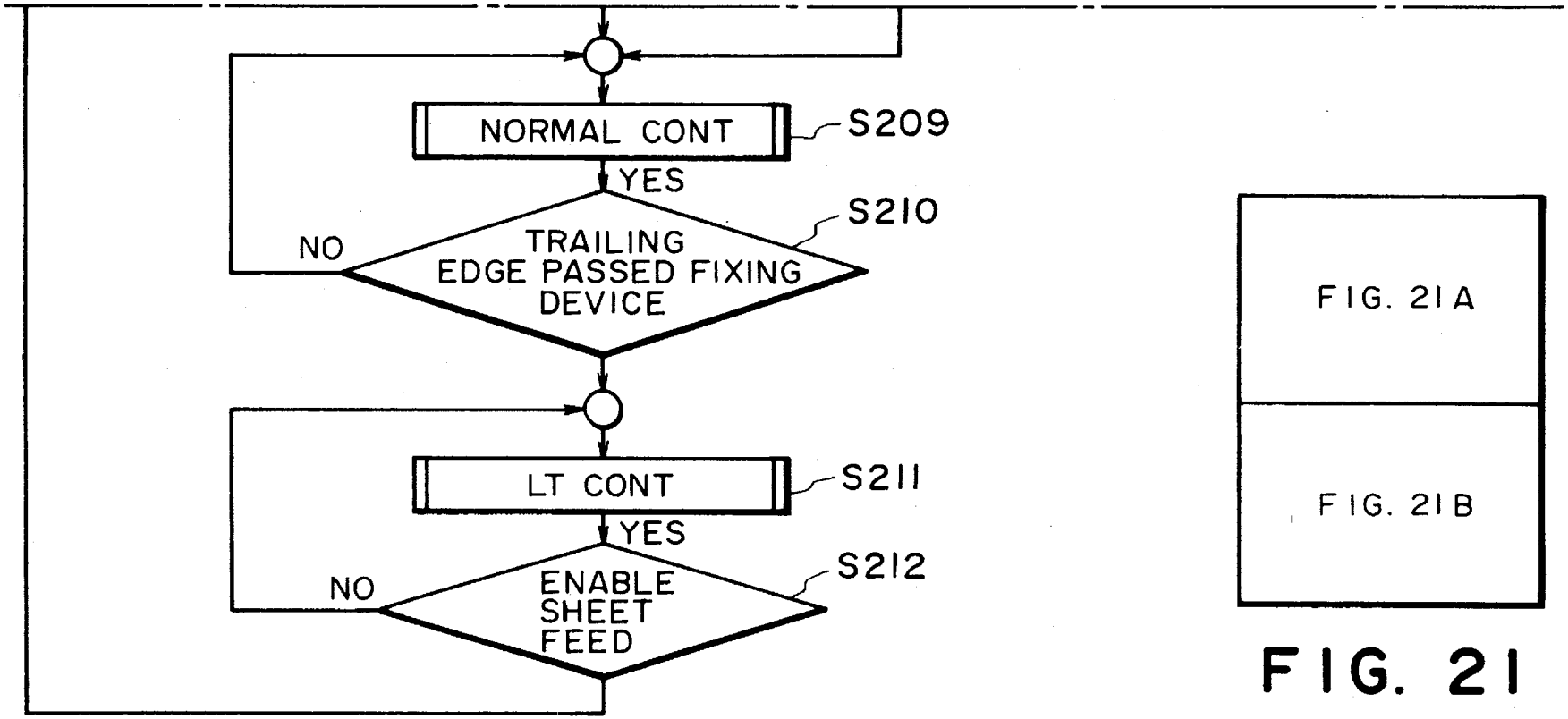
Figure 22:
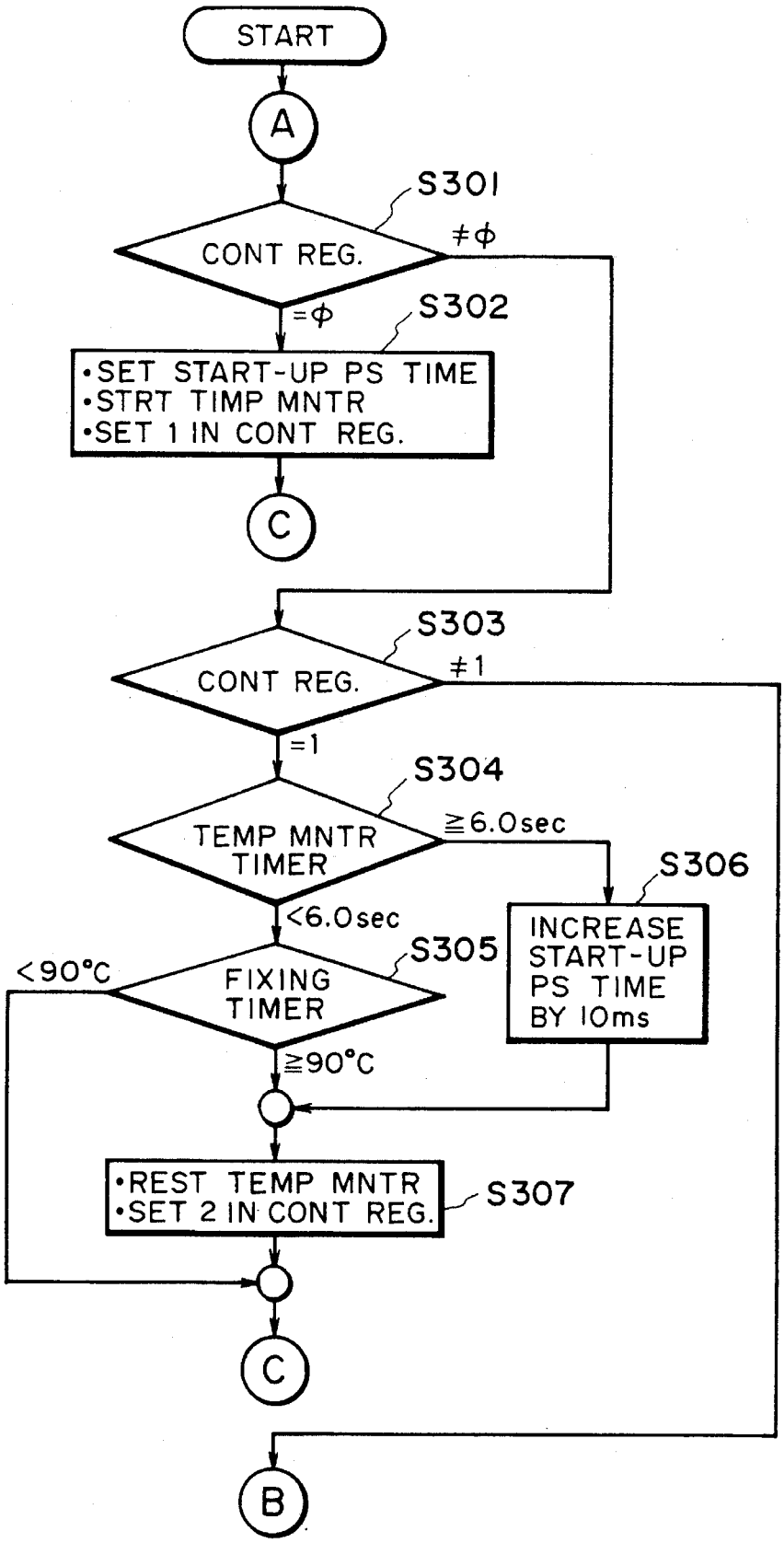
FIG. 22 is a flow chart (No. 1) for fixing device start-up control.
Figure 23:
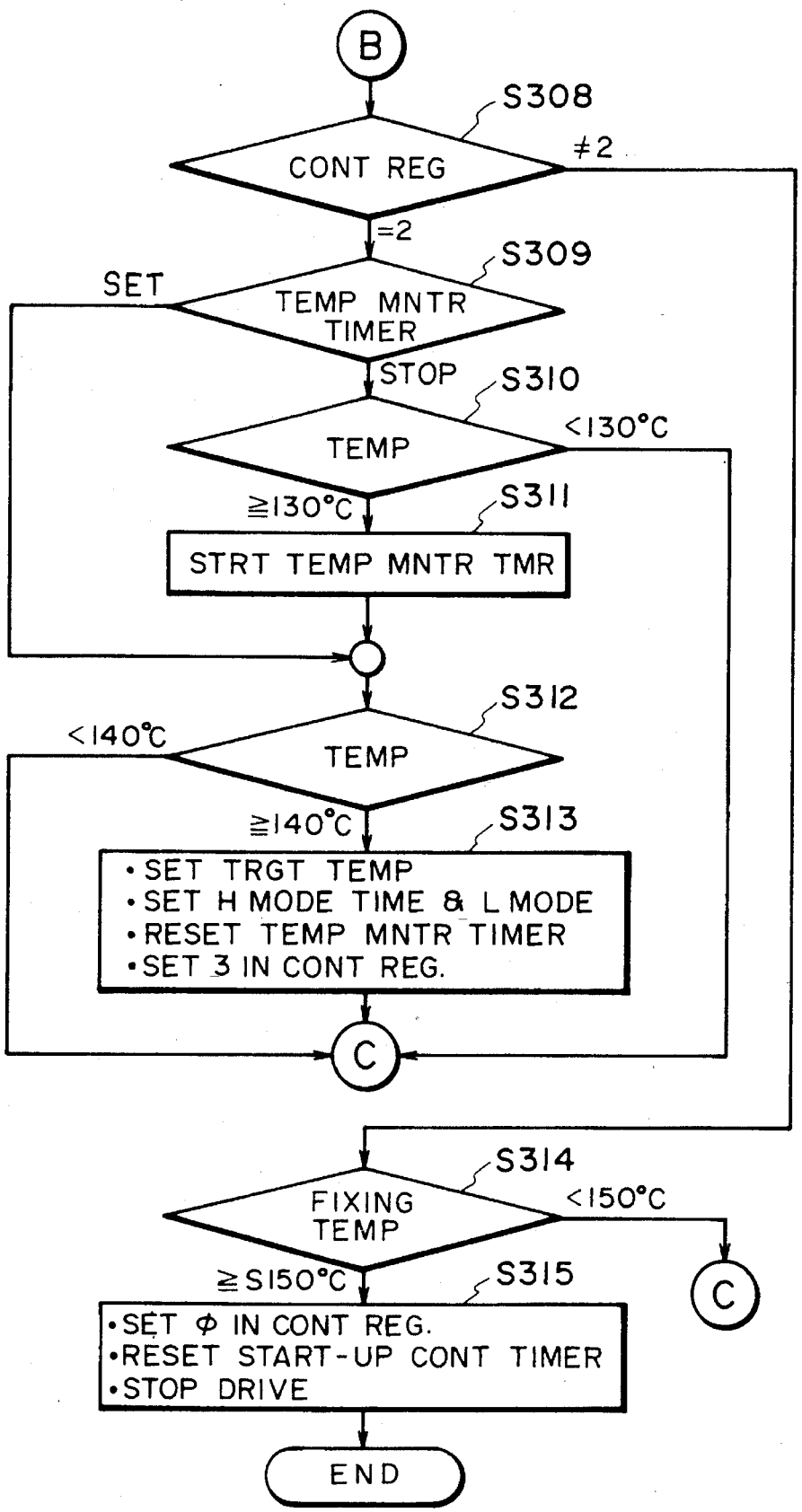
FIG. 23 is a flow chart (No. 2) of a fixing device start-up control.
Figure 24:
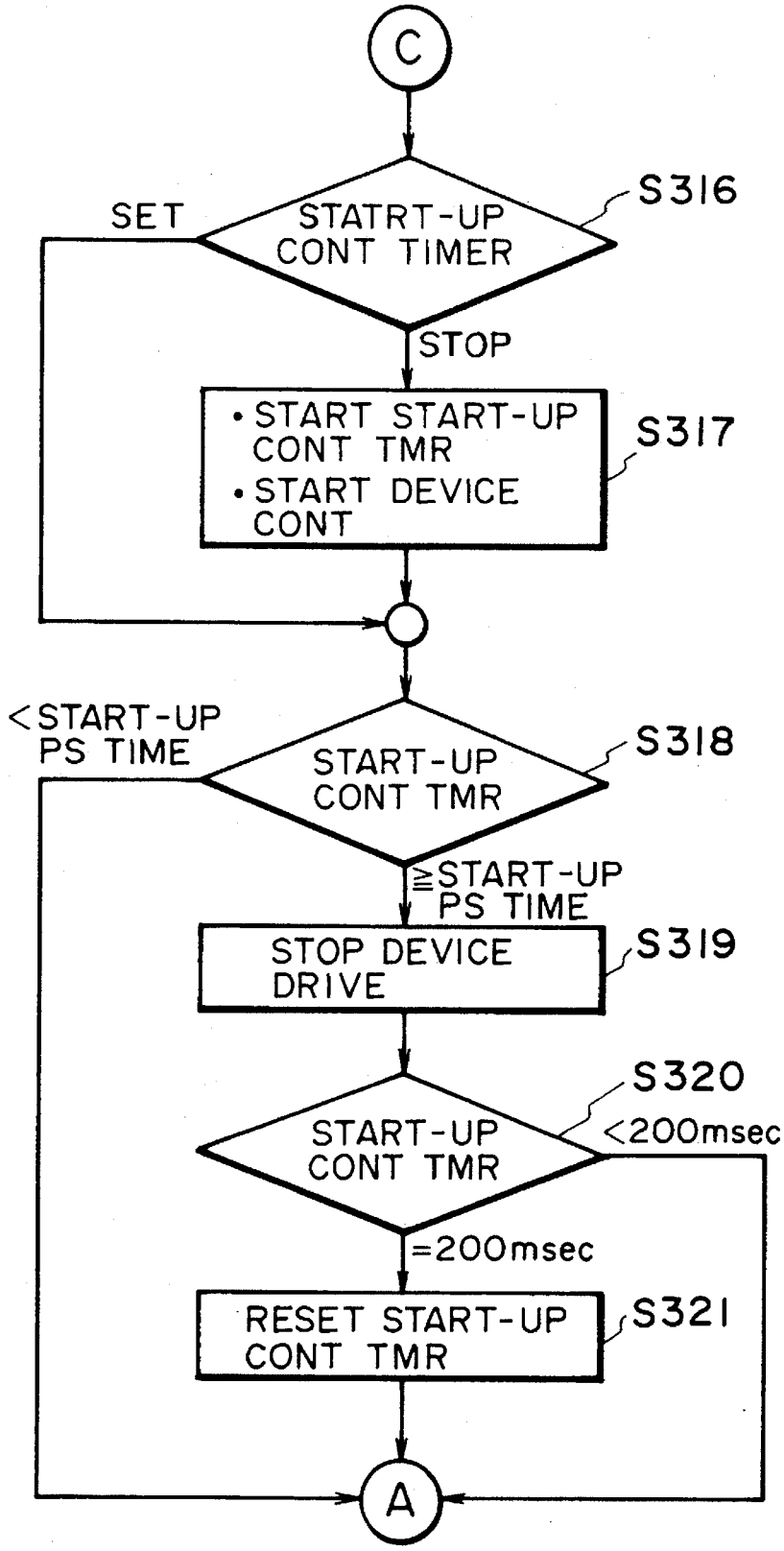
FIG. 24 is a flow chart (No. 3) of a image fixing device start-up control.

FIG. 20 is a flow chart of sequential operations by the controller CONT. FIG. 21 is a flow chart of sequential operations of the printer engine. FIGS. 22, 23 and 24 are timing charts of the fixing device temperature control operation.

The controller CONT waits for the coded image data from external equipment such as host computer or the like at step S101 in FIG. 20. When it receives the coded data, the operation proceeds to step S103.

At the step S103, the coded data is decoded to video data by the image processor 120 (FIG. 18).

At step S104, the discrimination is made as to whether the coded data are decoded into video data for one page. If not, step S103 is executed. If so, the operation proceeds to step S105.

At step S105, a print starting signal (video interface 24 signal) is rendered "L" to instruct the start of the printing operation of the engine.

At step S106, in order to start the printing operation, the engine effects the preliminary operations including starting the sheet feeding operation (starting to drive the polygonal mirror, uniformly charging the surface of the photosensitive drum 2 or the like). The controller CONT waits for the production of the sub-scan synchronization signal through the-video interface 24. Upon reception thereof, the operation proceeds to step S107.

At step S107, the print starting signal is rendered "H". At step S108, the printing operation is carried out for one page, and then, the operation proceeds to step S101.

The description will be made as to the temperature control for the fixing device. In the printer engine, immediately after the actuation of the power switch, the initial setting operations are carried out at step S201 in FIG. 21. The target temperature of the fixing device temperature control is selected to be 155° C. The target temperature is set again at the later stage. The fixing heater temperature control is carried out by electric power supply to the fixing device in a certain period in a predetermined period. The apparatus is provided with two modes, i.e., for the case in which the current temperature is lower than the target temperature and for the case in which it is higher than that. The electric power supply period (H mode period) for the case in which the current temperature is lower than the target temperature, and the electric power supply period (L mode period) for the case in which the temperature is higher than that, can be selectively operated.

TABLE 1

| | TEMP. RISING SPEED | | | |
|---|---|---|---|---|
| | <70 (deg/S) | | ≧70 (deg/S) | |
| AC RANGE | H POWER SUPPLY PERIOD | L POWER SUPPLY PERIOD | H POWER SUPPLY PERIOD | L POWER SUPPLY PERIOD |
| 95 (V) ↓ 230 (V) | 140 msec ↓ 0 msec | 120 msec ↓ 0 msec | 140 msec ↓ 0 msec | 120 msec ↓ 0 msec |

First, Table 1 above is accessed for the purpose of initial setting, and the H power supply period and the L supply period are selected depending on the AC input voltage when the temperature rising speed is not less than 70 deg/sec. The above-described target temperature of 155° C. and this setting is used for the fixing temperature control at the initial stage after the main switch is actuated.

At step S202, the print instruction signal from the controller is awaited. If the print start signal is "L", the step S204 is carried out. If not, step S203 is carried out.

In step S203, the process control operation is stopped for the purpose of stopping the entire driving system to decrease the power consumption.

In step S204, it is monitored whether the low temperature control (S211) which will be described hereinafter is being carried out or not. If not, the operation proceeds to step S206. If so, the operation proceeds to step S205. The step S205 will be described in detail hereinafter.

In step S206, the temperature of the fixing device is monitored. If it is not less than a start-up ready (130° C.), the normal fixing device control is carried out at step S209. If not (less than 130° C.), an operation of step S207 is carried out.

In step S207, a start-up fixing device control operation is carried out. The operations in the step S207 are shown in detail in FIGS. 22–24.

The engine controller 125 (FIG. 18) comprises a CPU, and effects the start-up fixing device control using a control register in a RAM region in the CPU.

If the control register is 0 at step S301 (FIG. 22), the operation proceeds to step S302, and the start-up power control period is selected on the following Table 2 depending on the AC input voltage, and thereafter, the operation proceeds to step S316. Then, the temperature monitoring timer is started, and 1 is set in the control register.

TABLE 2

| AC VOLTAGE RANGE | START-UP POWER SUPPLY PERIOD |
|---|---|
| 95 (V) ↓ 230 (V) | 200 msec ↓ 0 msec |

If the control register is 1 at step S303, the operation proceeds to step S304, in which the temperature monitoring timer is monitored. If it is not less than 6.0 sec, the start-up power supply period is increased by 10 msec at step S306. Thereafter, step S307 is carried out.

If the temperature monitoring timer represents less than 6.0 sec at step S304, operation of step S305 is carried out to monitor the fixing device temperature.

If the fixing device temperature is not less than 90° C., the operation proceeds to step S307 in which the temperature monitoring timer is re-set, and the control register is set to 2. Then, the operation proceeds to S316 which will be described hereinafter. If the fixing device temperature is less than 90° C. at step S305, the operation proceeds to step S316 which will be described hereinafter. If the control register has a level 2 at step S308 (FIG. 23), the operation proceeds to step S309 in which the temperature monitoring timer is operated. If the temperature monitoring timer is not in operation, the fixing device temperature is monitored at step S310. If it is less than 130° C., a step S316 is executed which will be described hereinafter. If it is not less than 130° C., the temperature monitoring timer is started at step S311, and the operation proceeds to step S312.

If the temperature monitoring timer is in operation at step S309, the operation proceeds to step S312. If the temperature is less than 140° C. at step S312, the operation proceeds to step S316 which will be described hereinafter. If it is not less than 140° C., a target temperature of Table 3 in the normal fixing device control and the H mode period and L mode period in Table 1 described hereinbefore, are set, and the temperature monitoring timer is reset, and in addition, the control register is set to 3, in step S312. Then, the operation proceeds to step S316 which will be described hereinafter.

TABLE 3

| TEMP. RISING SPEED RANGE | TARGET TEMP. |
|---|---|
| <50 (deg/S) | T0 |
| ≧50 (deg/S) <70 (deg/S) | T1 |
| ≧70 (deg/S) <100 (deg/S) | T2 |
| ≧100 (deg/S) | T3 |

T0 > T1 > T2 > T3

If the monitoring of the fixing device temperature at step S314 reflects the temperature less than 150° C., the start-up power supply control is continued. If it is not less than 150° C., the operation proceeds to step S315. At step S315, the control register is set to 0, and the start-up control timer is reset, and in addition, the fixing drive is stopped, thus completing the start-up fixing device control operation.

At step S316 (FIG. 24), the start-up control timer is monitored. If the temperature monitoring timer is not in operation, the operation proceeds to step S317. At step S317, the start-up control timer is started, and the drive of the fixing device is started. Then, the operation proceeds to step S318. If the temperature monitoring timer is in operation at step S316, the operation proceeds to step S318.

At step S318, the start-up control timer is monitored. If the start-up control timer value is less than the start-up power supply period, the operation proceeds to step S301. If it is larger, the fixing device drive is stopped at step S319. Then, at step S320, the start-up control timer is monitored again. If the start-up control timer value is less than 200 msec, the operation proceeds to step S301. If it is 200 msec, the start-up control timer is reset, and the operation proceeds to step S301.

The foregoing is the detailed description of the start-up fixing device control at step S207 in FIG. 6.

At step S208, the processing state of the start-up fixing device control operation is monitored. If it is completed, the operation proceeds to step S209.

Figure 25A:
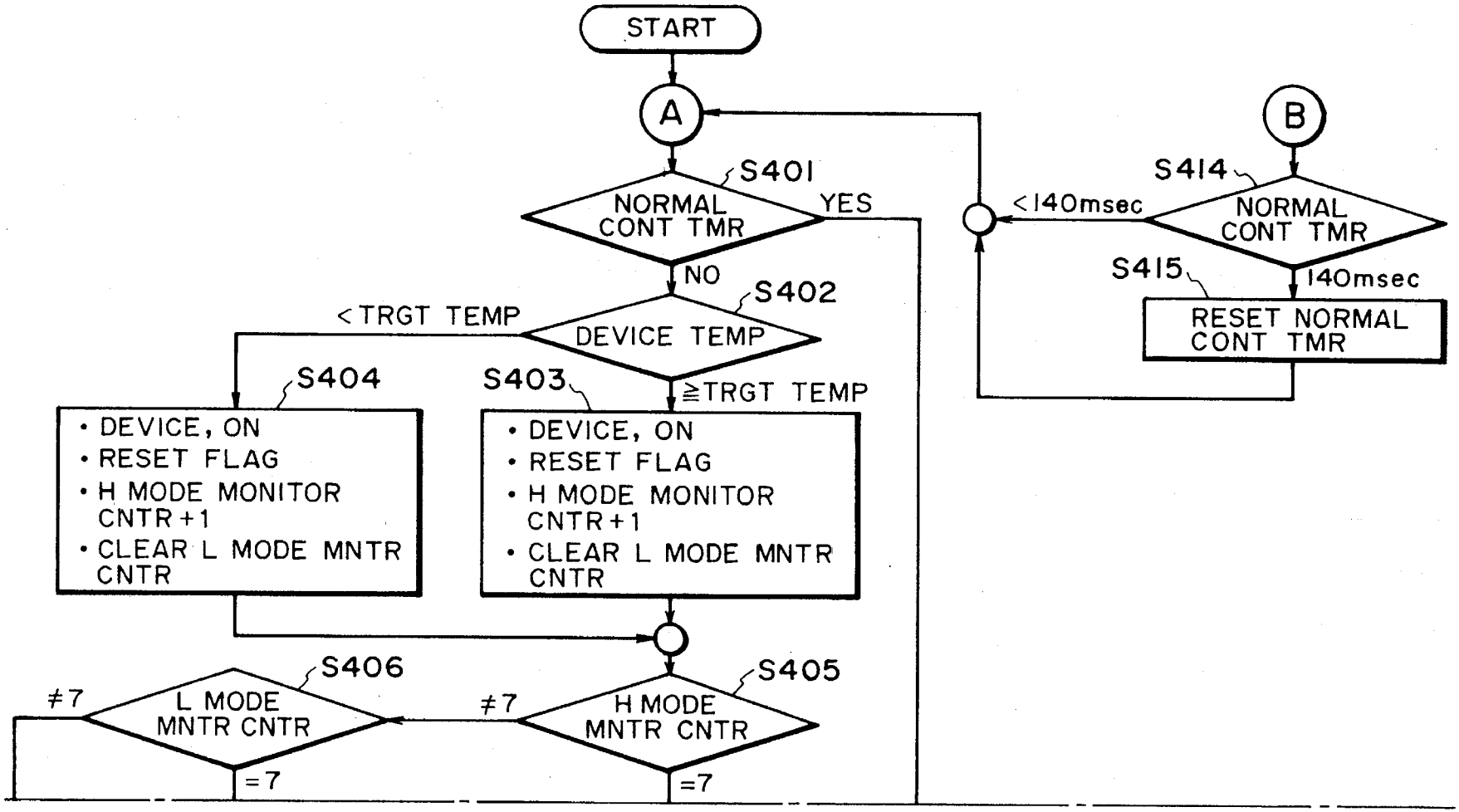
FIG. 25 is a flow chart of sequential operations in normal fixing device control operation.
Figures 25, 25B:
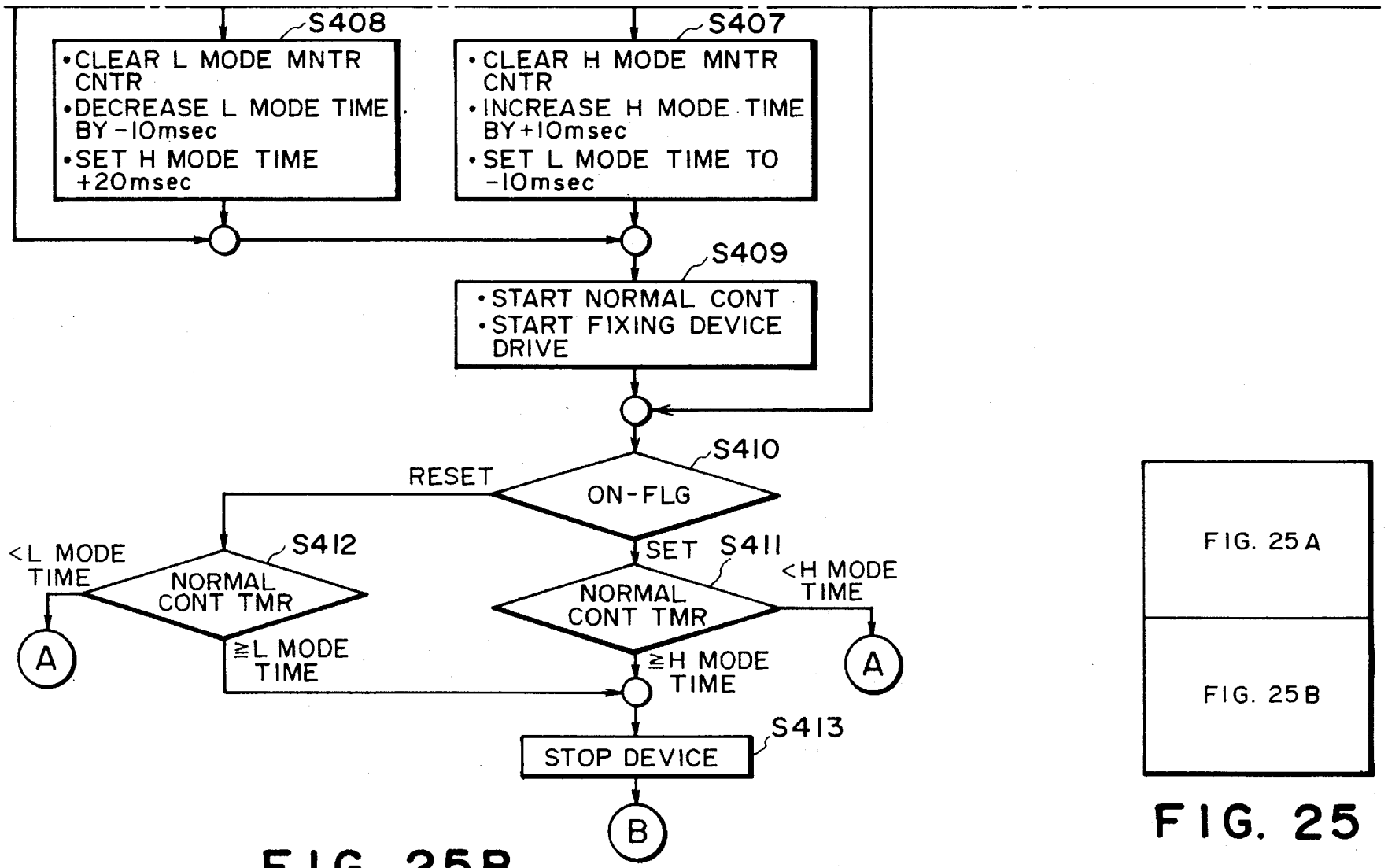

At step S209 of FIG. 6, the normal fixing device control operation is carried out. FIG. 25 shows the detail of the step S209.

At step S401, the operating condition of the normal fixing control timer is monitored. If it is in operation, the operation proceeds to a step S410 which will be described hereinafter. If it is not in operation, the fixing device temperature is monitored at step S402. If the temperature is not less than the target temperature, the operation proceeds to step S403; and if it is higher, the operation proceeds to step S404.

At step S403, a fixing device ON-FLAG provided in the RAM, is reset, and L mode monitoring counter in the RAM is counted up. In addition, an H mode monitoring counter in the RAM is cleared.

At step S404, an image fixing device ON-FLAG in the RAM is set, and the H mode monitoring counter in the RAM is counted up, and in addition, the L mode monitoring counter in the RAM is cleared.

In step S405, the count of the H mode monitoring counter is monitored. If it is 7, the operation proceeds to step S407. At step S406, the count of the L mode monitoring counter is monitored, and if it is 7, the operation proceeds to step S408.

If neither of the counts of the H mode monitoring counter and the L mode monitoring counter is 7, the operation proceeds to step S409 which will be described hereinafter.

At step S407, the H mode counter is cleared, and the H mode period is increased by 10 msec, and correspondingly, the L mode period is increased by 20 msec.

At step S408, the L mode monitoring counter is cleared, and the L mode period is decreased by 10 msec, and correspondingly, the H mode period is increased by 20 msec. At step S409, the normal fixing control timer is started, and the drive of the fixing device is started.

At step S410, the fixing ON-FLAG is monitored. If it is "set", the operation proceeds to step S411. If it is "reset", the operation proceeds to step S412.

If, at step S411, the normal fixing control timer value is not less than the H mode period, the drive of the fixing device is stopped at step S413. If it is less than that, the operation proceeds to step S401.

If, at step S412, the normal fixing control timer value is not less than L mode time period, the fixing device operation is stopped at step S413. If it is less than L mode time period, the operation proceeds to step S401. Thereafter, the normal fixing control timer is monitored at step S414. If the timer period is less than 140 msec, the operation proceeds to step S401. If the timer period is 140 msec, the operation proceeds to step S415, and the normal fixing device control timer is reset. Then, the operation proceeds to step S401.

The foregoing is the description of the detail of the normal fixing device control in step S209 in FIG. 21.

In step S210 in FIG. 21, the above normal fixing control operation is completed a predetermined period after the trailing edge of the sheet P passes by the sheet feed sensor S1, that is, upon detection of the trailing edge of the sheet P arriving the fixing device 13. Then, the normal fixing control timer is reset, and the operation proceeds to step S211.

Figure 26A:
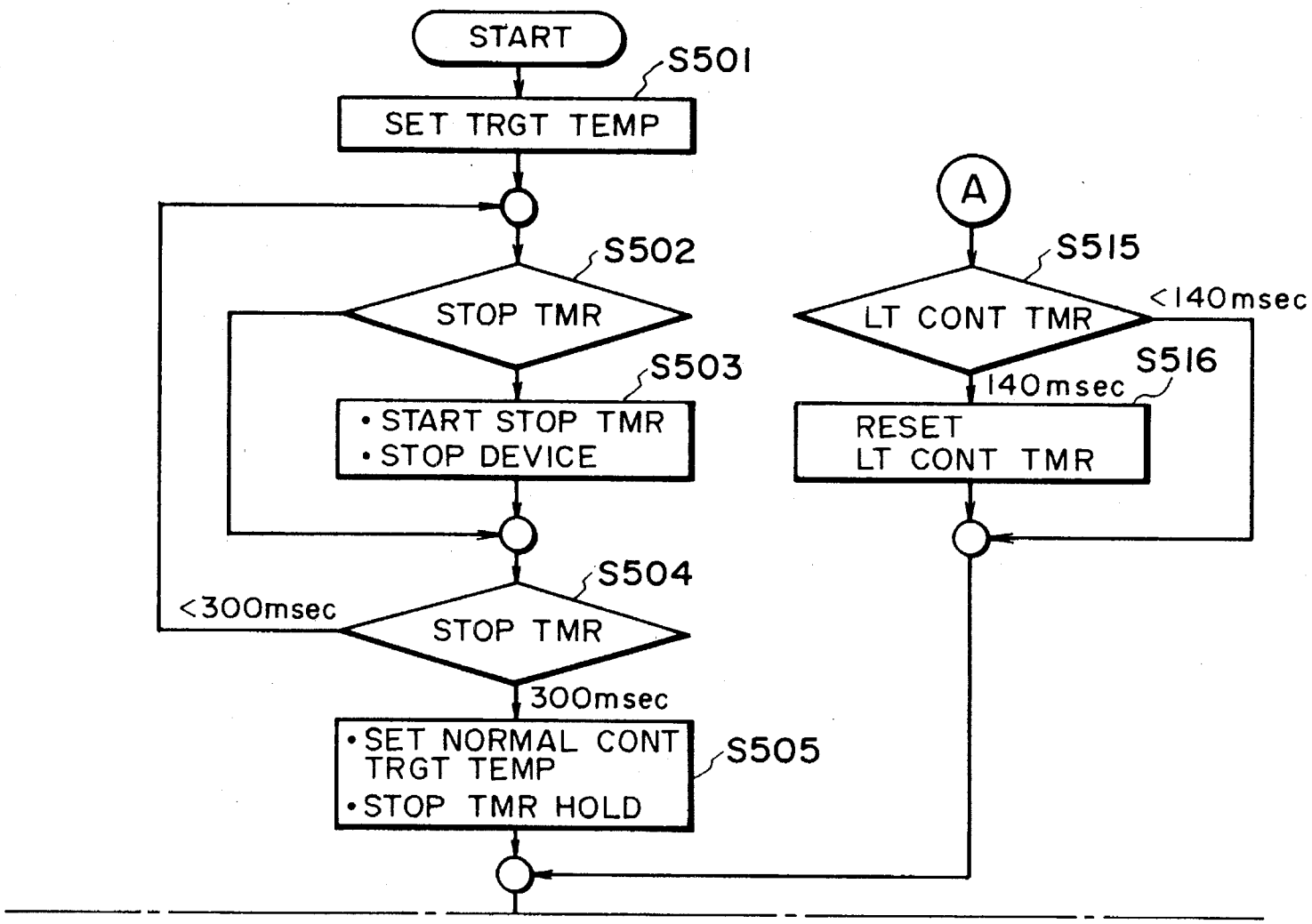
FIG. 26 is a flow chart of sequential operations in low temperature fixing device control operation.
Figures 26, 26B:
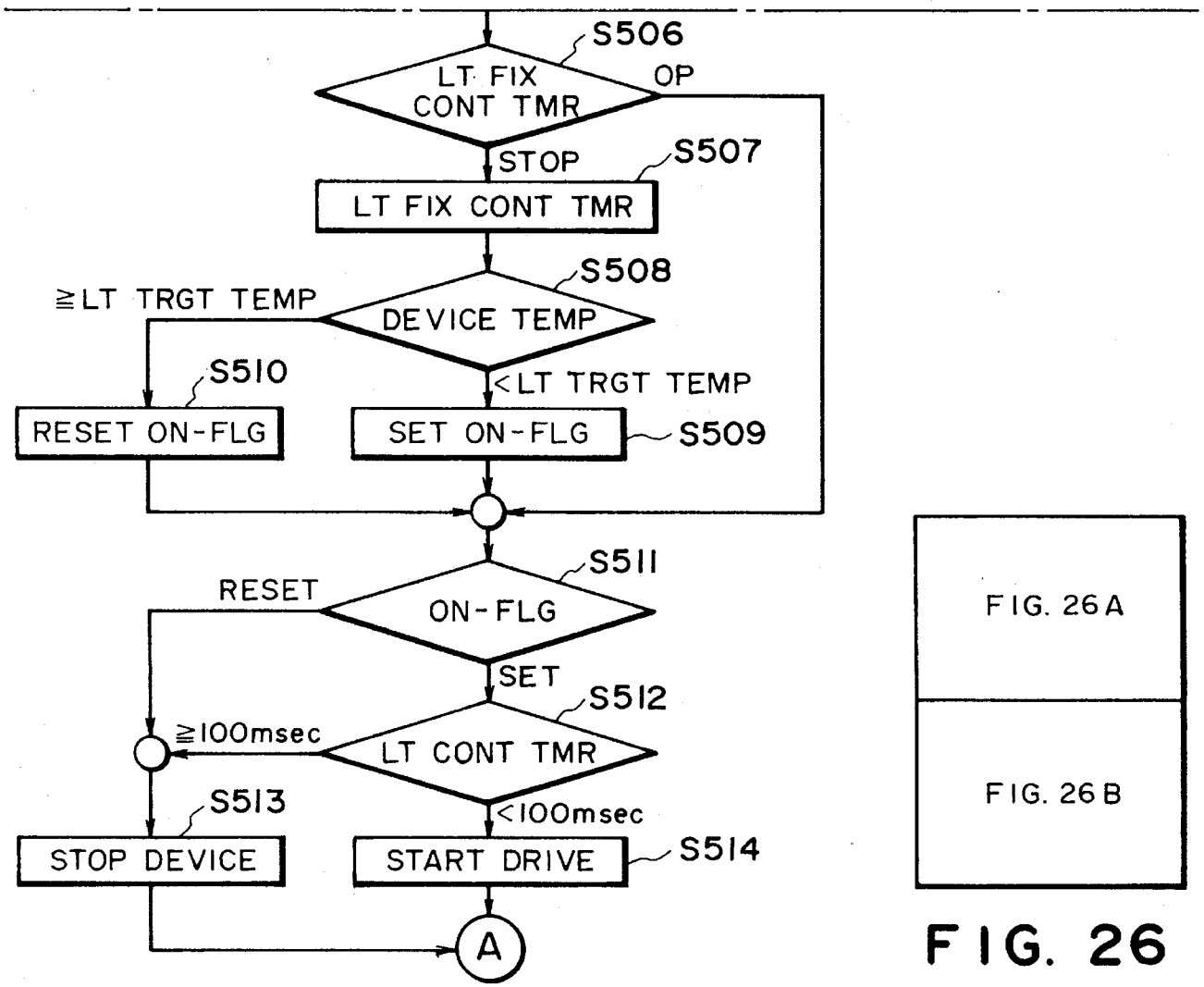

At step S211, the low temperature fixing device control is carried out. The detail of the operations in the step S211 are shown in FIG. 26.

At step S501, the target temperature of the low temperature fixing device control is selected in accordance with the following Table 4.

TABLE 4

| NORMAL TARGET TEMP. | LOW TEMP. TARGET TEMP. |
|---|---|
| T0 | T0' |
| T1 | T1' |
| T2 | T2' |
| T3 | T3' |

T0 > T0', T1 > T1', T2 > T2', T3 > T3'

At step S502, the operational state of a forced stop timer is monitored. If it is not in operation, the forced stop timer is started at step S503, and the drive of the fixing device is stopped, and then the operation proceeds to step S504. If it is in operation, the operation proceeds to step S504.

At step S504, the forced stop timer is monitored, and the forced stop timer period is less than 300 msec, the operation proceeds to step S502. If it is not less than 300 msec, the forced stop timer is reset at step S505, and the target temperature for the next normal fixing device control operation is set by Table 5 depending on the fixing device temperature at that time. The low temperature fixing operation is carried out at step S506 and subsequent steps.

TABLE 5

| FIXING TEMP. | CURRENT NORMAL TARGET TEMP. | NEXT NORMAL TARGET TEMP. |
|---|---|---|
| 0° C. | T2 | T3 |
| ↓ | T1 | T2 |
| T0 | T0 | T1 |

At step S506, the operational state of the low temperature fixing device timer is monitored. If it is in operation, the operation proceeds to S511 which will be described hereinafter. If it is not in operation, the low temperature fixing control timer is started at step S507, and the fixing device temperature is monitored at step S508.

If the fixing device temperature is less than the low temperature target temperature, the fixing ON-FLAG is set at step S509. If it is not less than that, the fixing ON-FLAG is reset at step S510.

Thereafter, at step S511, the fixing ON-FLAG is monitored. If it is in reset state, the drive of the fixing device is stopped at step S513. If the fixing device ON-FLAG is in set state, the low temperature fixing control timer is monitored in step S512. If the timer period is not less than 100 msec, the drive of the fixing device is stopped at step S513. If the timer value is less than 100 msec, the drive of the fixing device is started at step S514. In step S515, the low temperature fixing control timer is monitored again. If the timer value is 140 msec, the low temperature fixing control timer is reset at step S516, and the operation proceeds to step S506. If the timer value is less than 140 msec, the operation proceeds to step S506.

The foregoing is the detailed description of the low temperature fixing device control in the step S211 of FIG. 21.

Thereafter, in step S212 in FIG. 21, the low temperature fixing device control is continued. The engine controller counts the time from the feeding of the/TOP signal of the video interface (sub-scan synchronization signal) to the video controller, and monitors whether the sheet feed may be started or not. If it is the sheet feed timing, the operation goes back to step S202, in which the print start signal from the video controller is waited for.

If, at this time, the print start signal is "L", the execution of the low temperature fixing control is monitored at the above-described step S204. If it is being executed, the operation proceeds to the above-described step S206 at the predetermined timing given in Table 6 as counted from the timing of the feeding of the /TOP signal to the video controller on the basis of the normal fixing control target temperature set in the low temperature fixing control operation at step S211 described hereinbefore.

TABLE 6

| NORMAL TARGET TEMP. | LOW TEMP. CONTROL TERMINATING TIMING |
|---|---|
| T0 | Before Device: 0 mm |
| ↓ | ↓ |
| T3 | Before Device: Min. sheet interval (*1) |

*1: Distance between trailing edge of first sheet and leading edge of second sheet in max. through-put operation.

Figure 27:
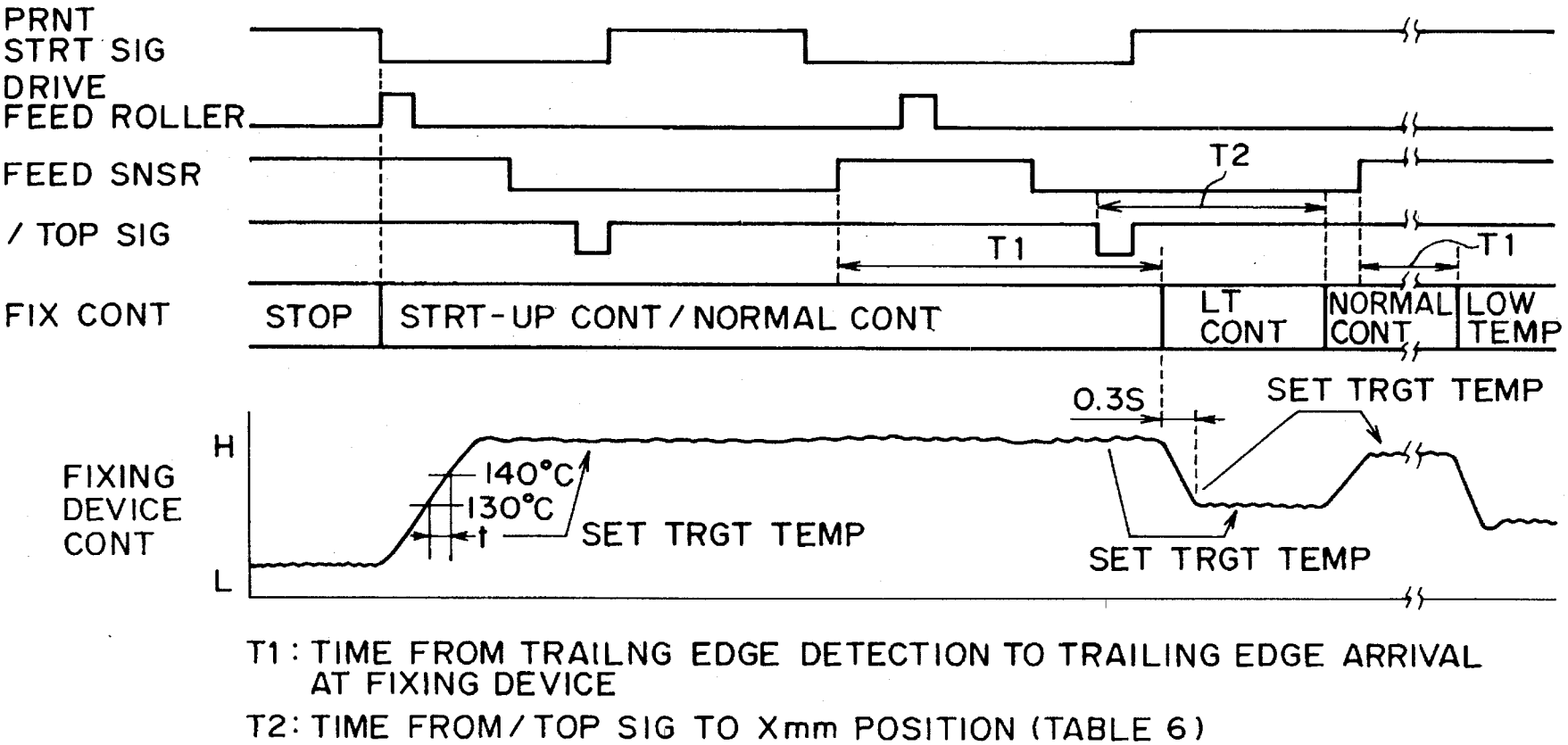
FIG. 27 is a timing chart in the fixing operation control.

FIG. 27 is a timing chart of the above-described fixing operation control.

The foregoing descriptions are related to embodiments of the present invention, and the values in Tables 1–6 and the descriptions, can be changeable properly by one skilled in the art.

The start-up fixing control at step S207, and the normal fixing device control at step S209 in FIG. 21, are not limited to the particular methods described hereinbefore.

The description will be made as to a further embodiment. In the foregoing embodiment, a processing operation shown in FIG. 28 may be inserted between steps S202 and S203 in FIG. 21. By doing so, the same advantageous effects are provided even if the engine controller receives a false print start signal through the video interface from the video controller.

Figure 28:
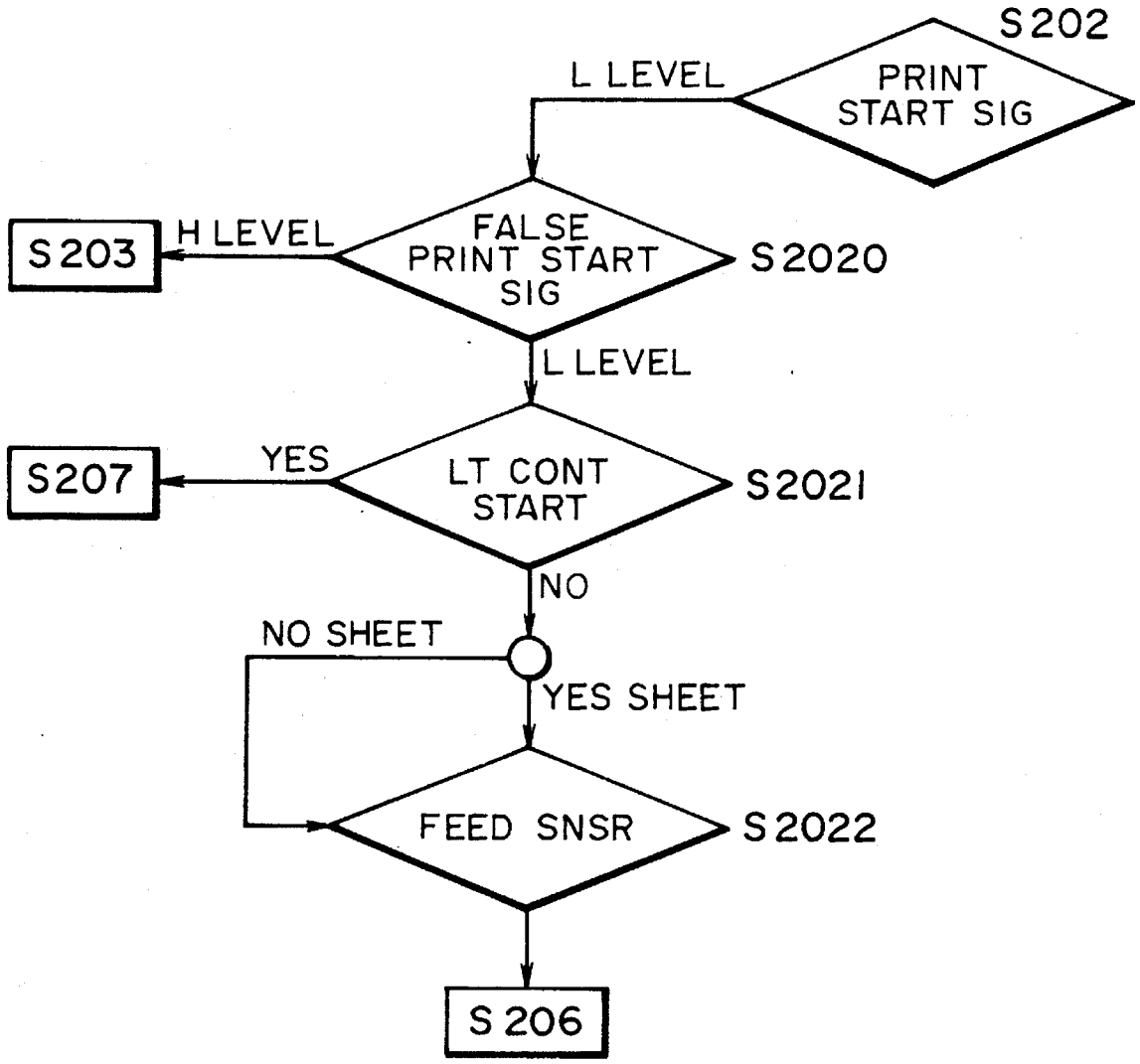
FIG. 28 is an additional flow chart to the flow chart of FIG. 21.

More particularly, in FIG. 28, step S2020 waits for a false print start signal, and if it is "H", the operation proceeds to the above-described step S203. If it is "L", the sheet feeding operation is started. If, at this time, the low temperature fixing device is in operation, the above-described step S207 is executed. If the fixing device control is not started, that is, if it is the first printing operation, the arrival of the sheet leading edge at the sheet feeding sensor is awaited at step S2022. Upon the detection of the leading edge of the sheet, the operation proceeds to the above-described step S206.

A further embodiment will be described, in which an over heating in a sheet non-passage region of the heater during the continuous printing operation on small size sheets, can be prevented, and in addition, even if the apparatus is in a cold state, the good image fixing operation is assured.

Figure 29:
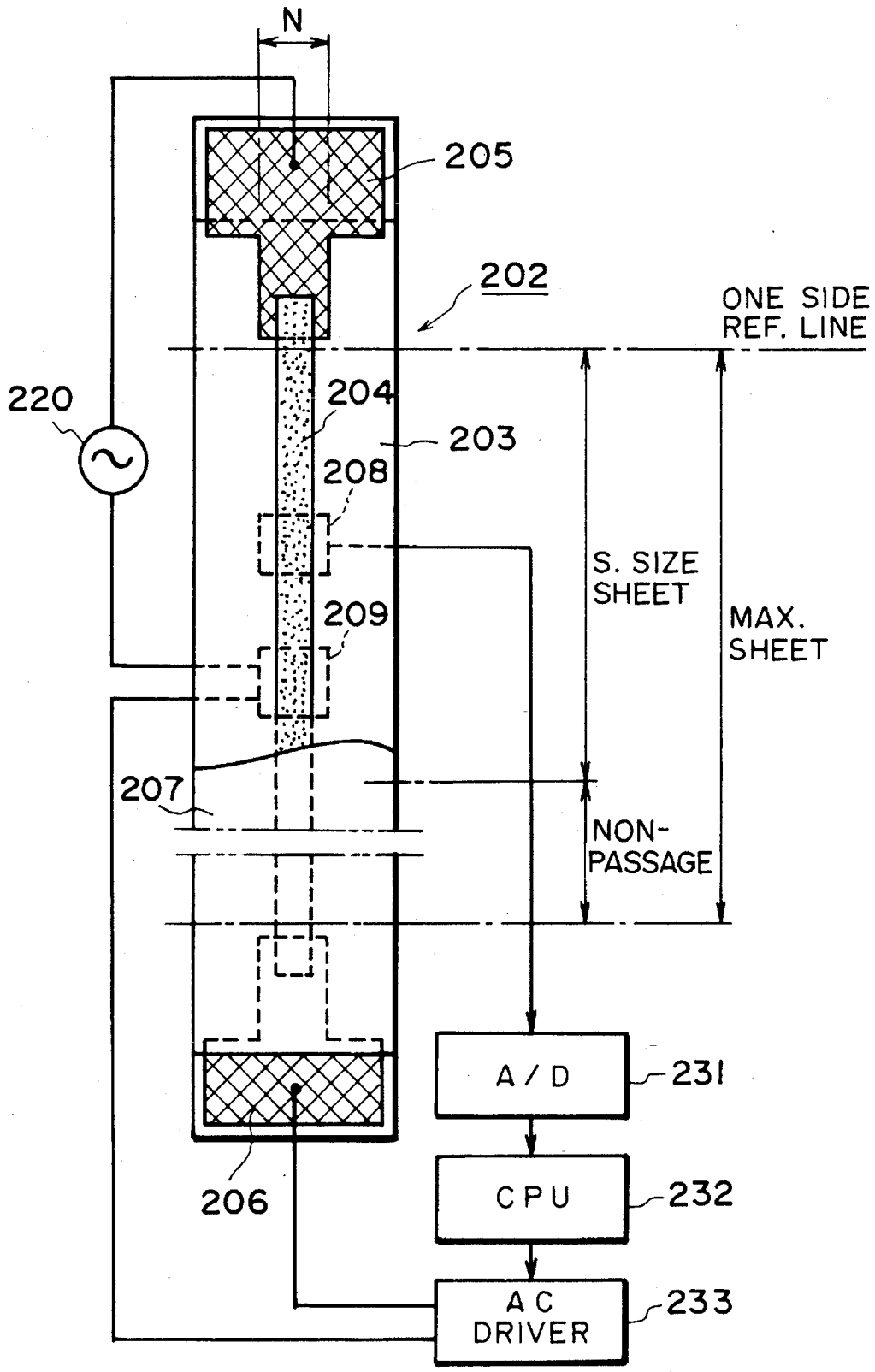
FIG. 29 is a partly broken-away top plan view of a heater of a heating apparatus (image heating fixing apparatus), and a block diagram of a power control system therefor.

FIG. 29 is a partly broken away top plan view of a heater with some parts omitted, of a heating apparatus according to an embodiment of the present invention, and a block diagram for controlling the heater surface temperature.

The apparatus is usable with the apparatus shown in FIGS. 16 and 17.

The heater 202 in this embodiment comprises an elongated ceramic base plate 303 extending in a direction substantially perpendicular to the film movement direction. The base plate 203 is electrically insulative, heat resistive and low thermal capacity plate made of $Al_2O_3$ (alumina), AlN, SiC or the like. It further comprises a heat generating element 204 (heating source) made of silver palladium (Ag/Pd), $RuO_2$, $Ta_2N$ or the like. It is in the form of a line or stripe extending along the length of the base plate substantially in the middle thereof in the width direction on one side (surface side) of the base plate 203. The heater 202 further comprises power supply electrodes 205 and 206 disposed at longitudinally opposite ends of the heat generating element 204 on the base plate, an electrically insulative coating layer 207 (surface protection layer) of glass or the like covering the heat generating element formed surface of the base plate 203, a temperature sensor 208 in the form of a thermistor or the like contacted to the other side (backside) of the base plate 203, and a thermal fuse 209 (thermal protector) for safety.

The base plate 203 is of ceramic material having a thickness of 1 mm and having a good thermal conductivity. The resistance of the heat generating element 204 is 34 Ω. The temperature sensor 208 is in the form of a thermister, and is disposed at a position which is always in the sheet passage region.

The output signal of the thermister is supplied to a CPU 232 through an A/D converter 231. On the basis of the input signal, the CPU 232 controls the power supply to the heat generating-element 204 from the voltage source 220 through an AC driver 233. During the sheet passage, the temperature control operation is carried out to maintain the surface of the heater 202 at 180° C.

In this embodiment, in order to permit the print outputs at 4 A4 sheets/min the process speed is 24 mm/sec. The interval between the sheets in the continuous printing operation is 57 mm and the period thereof is approx. 2.4 sec. As for the method of changing the percentage of the non-supply period of the power to the heater 202 during the sheet absent period, this embodiment uses memory, by the CPU 232, of the number of the continuous sheets, that is, the sheet passage period.

Figure 30:
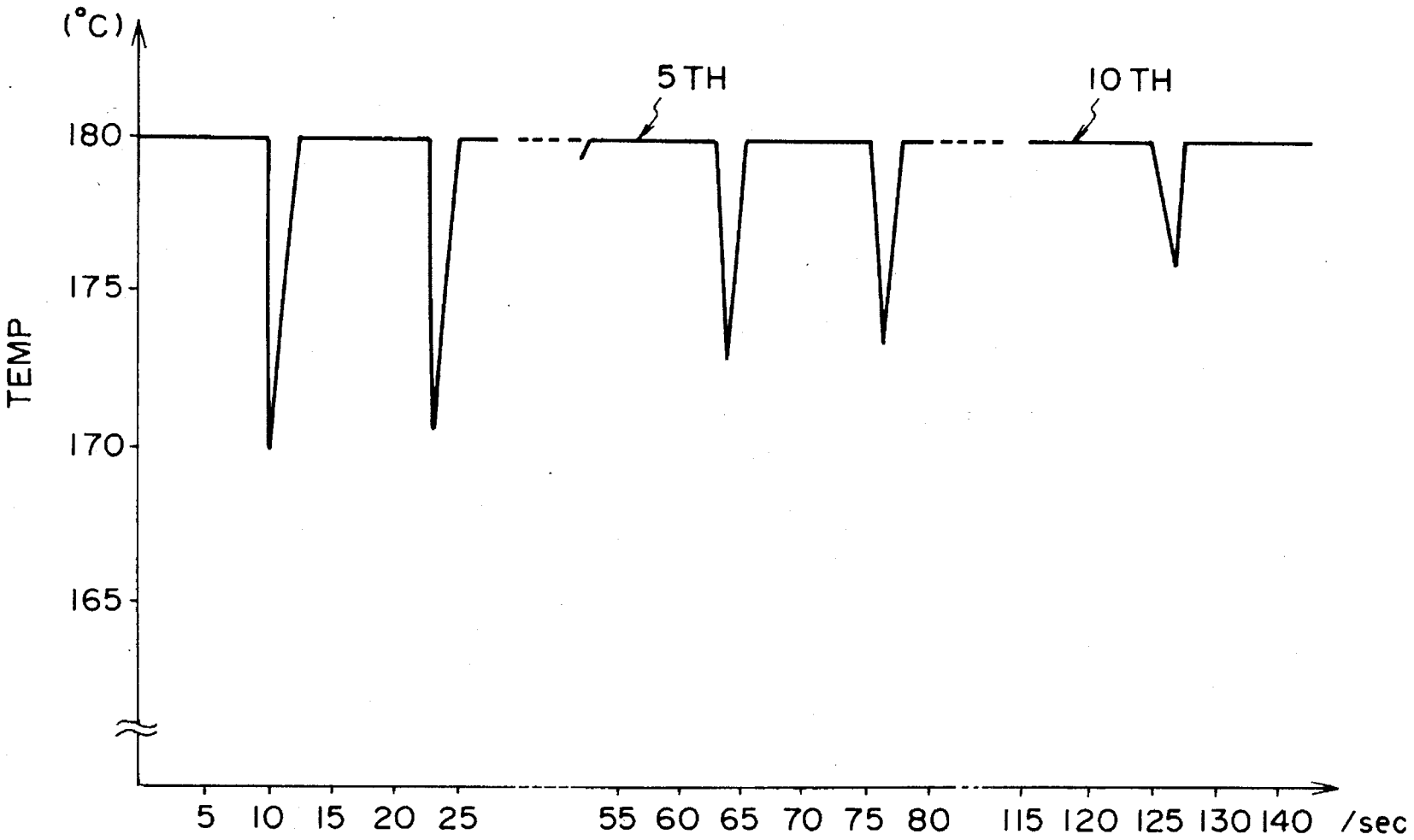
FIG. 30 is a diagram of electric power supply system for the heater.

More particularly, as shown in FIG. 30, the electric power supply to the heater is rendered off for 0.5 sec, and thereafter the heater temperature is increased to 180° C. in 1.9 sec, in the first 5 sheets processing. At this time, in order to determine the electric power supply to the heater 202, the electric power required for 180° C. temperature control is measured at the trailing edge of the previous sheet, and the electric power was applied to provide 180° C. again.

The reason for this is as follows. If the proper electric power for maintaining 180° C. is not supplied in this state, more particularly, if the electric power is higher, the overshooting is too large with the result of high temperature offset. If it is lower than that, the temperature does not reach 180° C., and therefore, the insufficient image fixing occurs. For the next 5th to 10th sheets, the electric power supply is rendered off for 1.2 sec, and the heater temperature is increased to 180° C. in 1.2 sec. Also, at this time, in order to determine the electric power supply to the heater, the electric power required for maintaining 180° C. is measured at the trailing edge of the previous sheet, and the heating operation is effected with the electric power supply to maintain 180° C. For the 10th and subsequent sheets, the electric power supply is rendered off, for 2.0 sec, and the heater temperature is increased to 180° C. in 0.4 sec.

Figure 31:
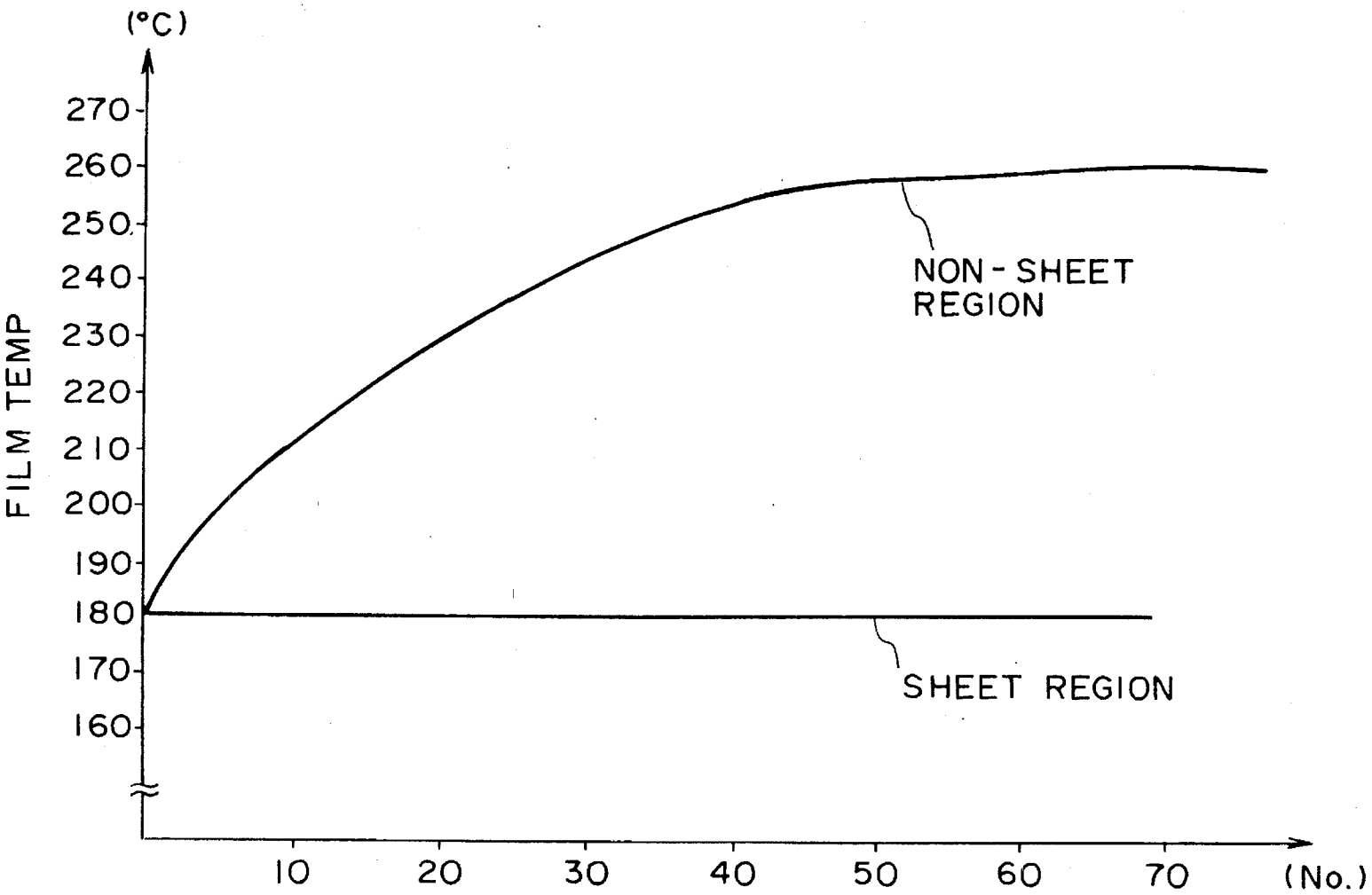
FIG. 31 is a graph of temperature changes of the sheet passage portion and the sheet non-passage portion during the sheet is passed, illustrating the problem underlying the present invention.

Using such control system, envelope size sheets are continuously processed. In the case where the 180° C. temperature control is carried out during the sheet absent period, the surface temperature in the sheet non-passage region of the heater changes with time as shown in FIG. 31. It becomes as high as 250° C. at 40th sheet. When A4 sheet is passed with this state, the sheet was creased due to the step produced by the thermal expansion difference of the back-up roller, corresponding to the boundary between the sheet passage region and the sheet non-passage region of the heater.

The back-up roller is of silicone rubber which is excellent in the heat resistivity, but it is continuously usable if the temperature is not higher than 200° C. If the higher temperature is continued for a long period of time, the silicone rubber is thermally deteriorated with the result of damage, as has been confirmed.

Figure 32:
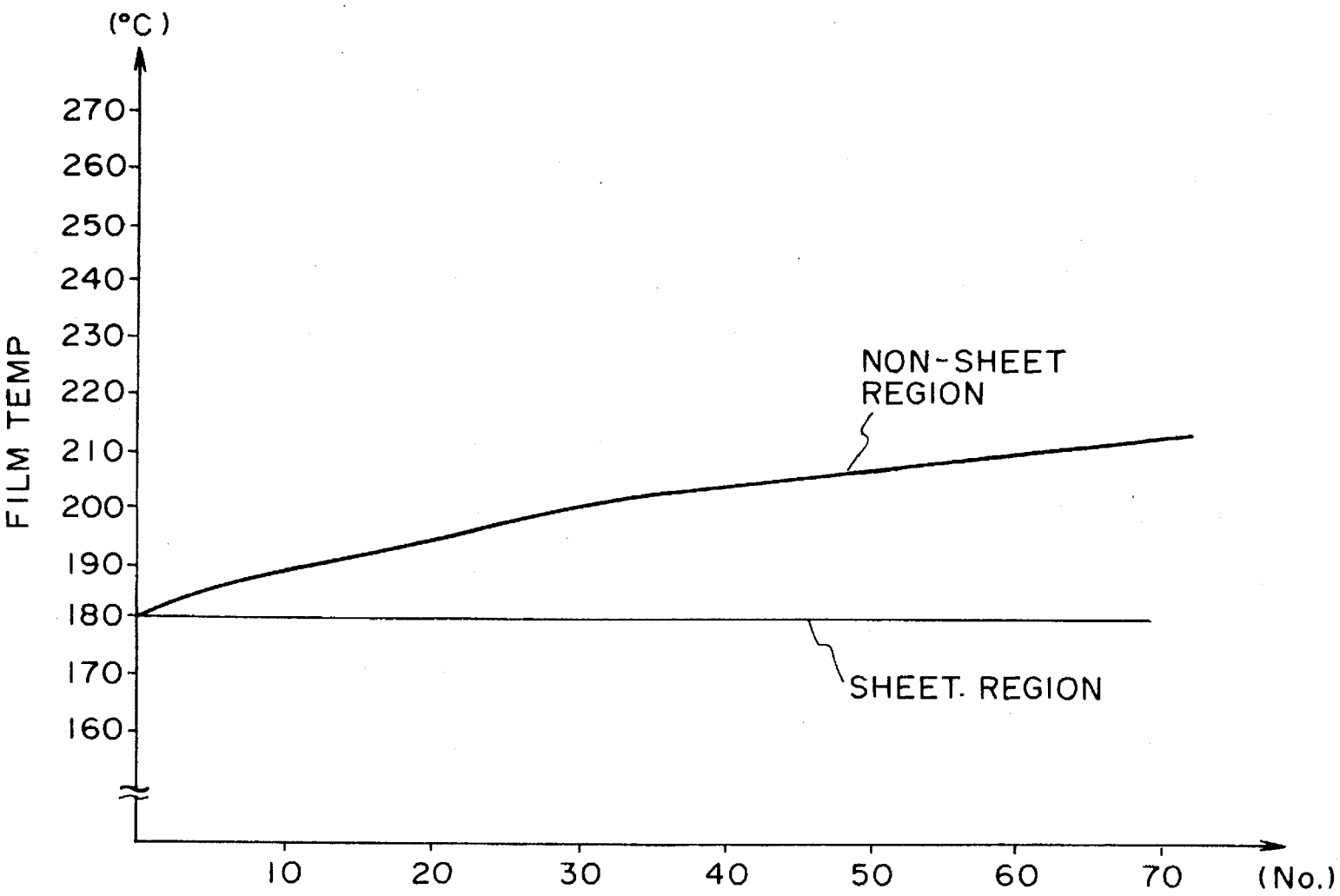
FIG. 32 is a graph of temperature changes of the sheet passage portion and the sheet non-passage portion of the heater during the sheet passage, when the control system of this invention is used.

According to the control method of this embodiment, the temperature in the sheet non-passage region of the heater 202 is as shown in FIG. 32 (the temperatures during the sheet passage periods were plotted). At the seventh sheet, the surface temperature of the heater is as low as 210° C. This is because, as described hereinbefore, the non-power-supply period is provided so that with the increase of the parts such as pressing roller or the like, the non-supply period is made longer so as to cool the heater as much as possible during the sheet absent period.

By the provision of the non-supply period of 2 sec for 10th and subsequent sheets, the heater temperature in the sheet non-passage region decreases at the surface by approx. 20–30 degrees, so that the temperature rise and lowering are repeated in the sheet presence period and the absence period. As a result, the temperature rise in the sheet non-passage region of the heater can be suppressed.

Thus, the sheet crease and the thermal deterioration of the back-up roller can be avoided, so that durable fixing system can be provided.

When the temperature increasing speed of the heater is low, and the heat escape is quick, the temperature decrease is too large if the heat generation of the heater is stopped. It would be possible that the heater can not be heated to the fixing temperature by the time the next recording material reaching the fixing nip N. In such a case, rather than completely stopping the electric power supply to the heater, the voltage of the power supply is lowered, or the duty ratio of the pulsewise electric power supply is lowered, thus decreasing the heat generation amount.

In this embodiment, as for the information used to change the non-supply period in the sheet absent period, the number of sheets is counted, and the switching operation is effected for the number. In this embodiment, immediately after the passage of the recording sheet through the fixing nip N, the electric power supply to the heater is stopped, and the lowering speed of the surface temperature of the heater is detected, and in accordance with the lowering speed, the timing at which the next electric power supply to the heater is determined. If the lowering speed is high, it means that the apparatus, such as the back-up roller or the like, are still cold, and therefore, the heat is easily escapes to them. With this state, the electric power supply to the heater is resumed at earlier timing. If, on the contrary, the lowering speed is low, the heat is not easily escaped to the other elements, and the apparatus is already at hot condition. Therefore, the non-supply period is made longer as much as possible to prevent the temperature rise in the sheet non-passage region.

More particularly, in this embodiment, the lowering period from 180° C. to 175° C., is detected, and the electric power non-supply periods are determined as follows:

Not more than 100 msec: 0.4 sec

100–300 msec: 1.2 sec

More than 300 msec: 2 sec

Thus, the control was divided into three groups. The method of increasing the temperature to 180° C. subsequently, is the same as in the foregoing embodiment.

By doing so, the temperature rise in the non-sheet passage region of the heater as in the foregoing example, can be suppressed as shown in FIG. 32. In the foregoing example, the switching is effected definitely on the basis of the number of processed sheets. In this embodiment, however, the degree of the warming of the apparatus is reflected in the control, and therefore, the control operation can meet the ambient condition.

In the foregoing, the electric power supply to the heater 202.is decreased immediately after the recording material passes through the fixing nip N, and the degree of warming of the apparatus is detected. It is, however, possible that the degree of warming of the apparatus can be detected by detecting the temperature rising speed resulting from heating for a predetermined period, for example, 0.3 sec. Further alternatively, the degree of warming of the apparatus can be discriminated on the basis of the temperature rising speed from the start of the previous non-passage period, and on the basis of the discrimination, the power non-supply period is changed in the sheet absent period.

In the initial stage of the continuous printing operation, the heat tends to be insufficient, and it is a further possible alternative that the sheet absent period control is determined on the basis of the temperature increasing speed while the heating is effected in the sheet interval period, and from a certain stage, the sheet absent period control is determined on the basis of the temperature decreasing speed while the power supply is being shut-off or the low power supply is effected.

A further embodiment will be described in which as for the information to be used to change the non-supply period of power during the sheet absent period, the electric power required for maintaining the heater temperature at 180° C. is detected.

If the back-up roller or the like is cold, the heat escaping to them is large, and therefore approx. 200 W is required in order to maintain the heater at the temperature of 180° C. However, together with the operation of the continuous processing, the back-up roller or the like becomes warm with the result that the heat escaped thereto decreases. In order to maintain 180° C. of the heater temperature at this time is approx. 100 W.

This embodiment is particularly based on this fact, and means is provided to detect the electric power required for maintaining the heater temperature at 180° C. during the sheet processing period. In response to the input electric power in the sheet processing period, the non-power-supply period in the next sheet absent period is determined.

More particularly, the non-supply periods are determined on the basis of the electric power required to maintain a temperature of 180° C.:

180 W or more is required: 0.4 sec (non-supplied period)

180–130 W: 1.2 sec

Not more than 130 W: 2 sec

The method of increasing the temperature to 180° C. subsequently, is the same as in the foregoing embodiment.

By doing so, the temperature rise of the heater, similarly to the foregoing example, can be suppressed to approx. 210° C. even when 7 envelopes are continuously supplied.

In this example, the non-supply period in the sheet absent period is changed irrespective of the size of the sheet. However, it is possible that such control is carried out limitedly for small size sheet. In the case of the laser beam printer used for the description of this embodiment, the maximum usable size is LTR size, and therefore, the non-power-supply period is provided in the sheet absent period limitedly for the B5 sheet or the envelope or the like. As for the method of detecting the sheet size, (1) In the case of cassette sheet supply, the sheet size signal from the cassette is used:

(2) A sensor is provided in the sheet supply station, and .the length of the sheet is detected by the sensor, and on the basis of the detection, the sheet size is predicted. Any known method for determination of the sheet size is usable.

When it is discriminated that small size sheets are continuously processed, the sheet interval or the sheet absent period is made longer by 2 sec than for the letter size. More particularly the period is made 4.4 sec for the small size sheets while it is 2–4 sec for the letter size sheet. In such a period, the non-supply period is changed. By doing so, the cleaning period can be made longer in the sheet absent period in the case of small size sheet, thus further decreasing the temperature rise in the non-sheet period.

Thus, when the maximum size sheet is processed, the throughput can be maintained. Only when the small size sheets are processed, the throughput decreases slightly, but the temperature rise in the sheet non-passage region can be prevented.

In this embodiment, as described hereinbefore, the fact of the small size sheet used is detected by a sensor disposed in the sheet feeding station, and when the small size sheet is supplied, the sheet interval is set approx. 106 mm (4.4 sec), and the non-power-supply period is changed. More particularly, in the first - fifth sheets, the power supply is rendered off for 1.0 sec, and the heater temperature is increased to 180° C. in the rest period, that is, 3.4 sec. For the fifth - tenth sheets, the power supply is rendered off for 1.7 sec, and rendered on for 1.7 sec. For the tenth and subsequent sheets, the power supply is rendered off for 3.8 sec and is rendered on for 0.6 sec, thus controlling the electric power supply.

By doing so, the temperature increase in the sheet non-passage region is further suppressed. After 70th sheet, the surface temperature of the heater further decreases by 10 degrees, so that the further stabilized sheet processing is possible.

As for the information to be used to change the non-power supply period in the sheet absent period, the electric power required for maintaining the heater temperature at 180° C. or the temperature decreasing speed during the non-power supply can be used with the same advantageous effects.

In this manner, when the small size sheets (B5 or envelope or the like) is continuously processed, the non-energization period is provided in the sheet absent period, and the non-energization period is changed on the basis of the state of the apparatus, by which the temperature rise in the sheet non-passage region of the heater in the case of small size sheet processing, can be suppressed, and therefore, the problems resulting from overheating in the sheet non-passage region of the heater, can be avoided.

A further embodiment will be described in which when the set temperature of the heater is determined, an erroneous detection of the heater temperature is assuredly prevented.

In this apparatus, in the heater start-up operation, the heater is energized with 500 W constant electric power. This is accomplished by the use of power control means using pulsewidth modulation in the form of phase control or wave number control or the like on the basis of information from an AC voltage detection circuit or heat generating element resistance detecting means or the like.

In this embodiment, frequency was 50 Hz and the voltage was 100 V AC, and a basic wave number of the wave number control is 20 waves. The heater is started up with 14 wave on and 6 wave off. If, at this time, the entire apparatus is cold, the temperature increasing speed of the heater is not high, and if, on the contrary, the entire apparatus including the back-up roller or stay is warm, the increasing speed is high. Therefore, the thermal state of the apparatus can be detected on the basis of the speed. In accordance with it, the set temperature for the heater is determined for the first sheet, by which the film temperature for the first sheet can be controlled to be in a temperature range without the insufficient fixing and high temperature offset.

Figure 33:
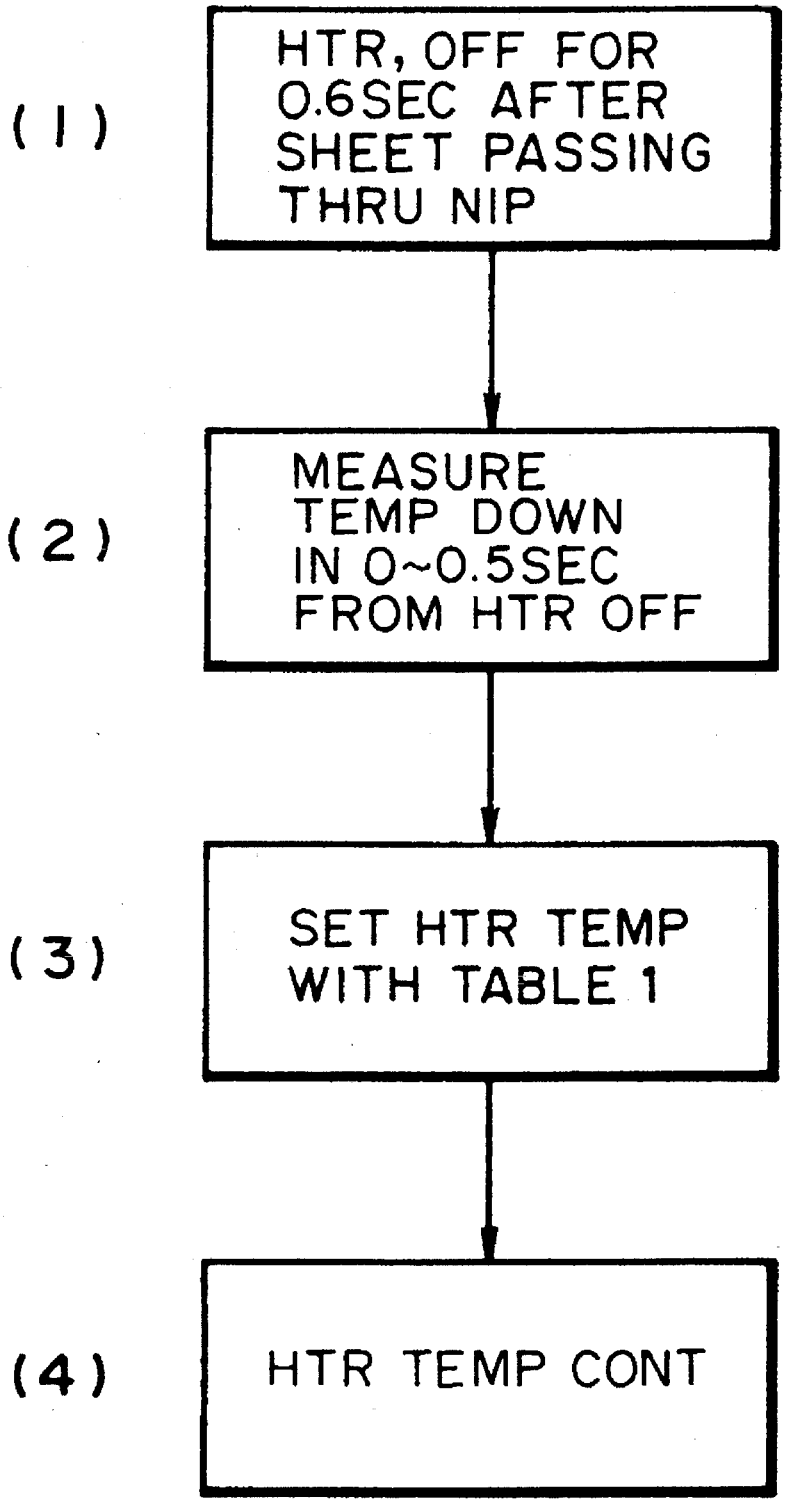
FIG. 33 shows a heater control algorithm of a heating apparatus according to a further embodiment of the present invention.

The description will be made as to the continuous printing operation. In this case, the heater temperature is set through the algorithm shown in FIG. 33. More particularly, (1) Simultaneously with the recording material P leaving the fixing nip N, the electric power supply to the heater is forcedly rendered off for 0.6 sec:

(2) When the heater is not energized, the heater temperature decrease for 0.5 sec is detected: and (4) On the basis of the detection, the control temperature of the heater for the next sheet is determined in accordance with the following Table 7.

TABLE 7

| TEMP. DECREASE | DECREASING SPEED | SET TEMP. |
|---|---|---|
| >25 (°C.) | >50 (°C./sec) | 210 (°C.) |
| 20–25 | 40–50 | 200 |
| 15–20 | 30–40 | 190 |
| <15 | <30 | 180 |

(4) The temperature control for the heater 2 is started for the next Sheet P.

Figure 35:
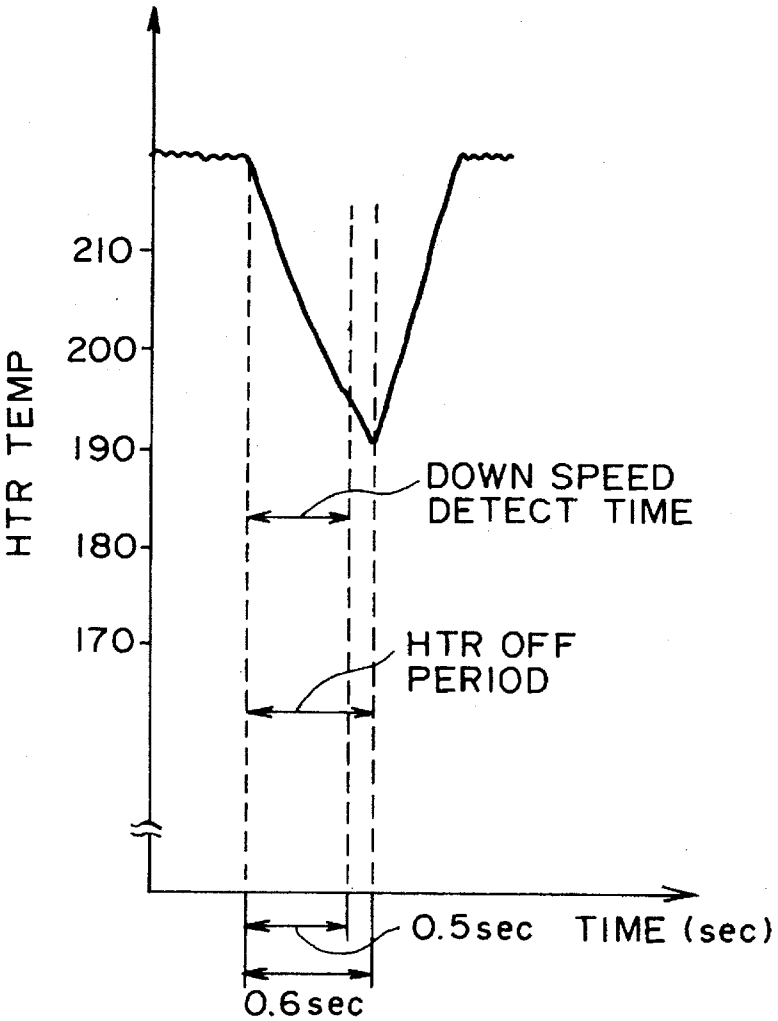
FIG. 35 is a graph of heater temperature change when the control system is in accordance with an aspect of the present invention.
Figure 34:
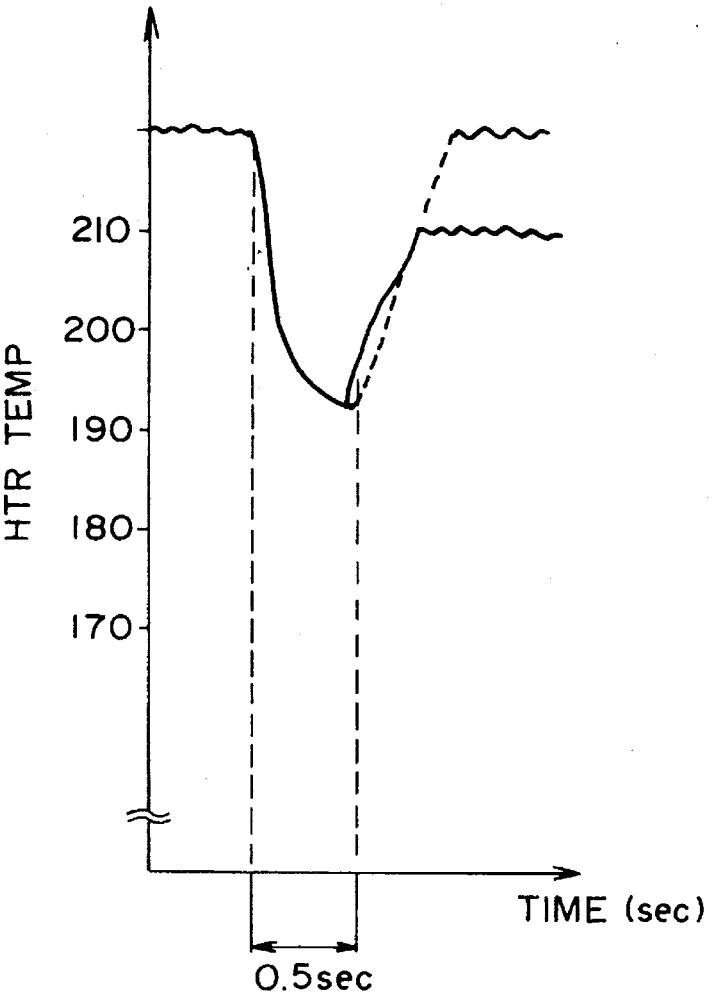
FIG. 34 is a graph of heater temperature when an erroneous detection occurs, which is solved by an aspect of the present invention.

The temperature decreasing speed is detected during the non-power-supply period. If both are the same as in the conventional apparatus, erroneous detection occurs with the result that as shown in FIG. 34 the temperature set is unintentionally switched to 200° C. even if 210° C. is still required. If this occurs, insufficiently fixed image is discharged. According to this embodiment, as shown in FIG. 35, the erroneous detection is avoided so that the heater surface temperature is controlled assuredly in accordance with Table 1.

Figure 36:
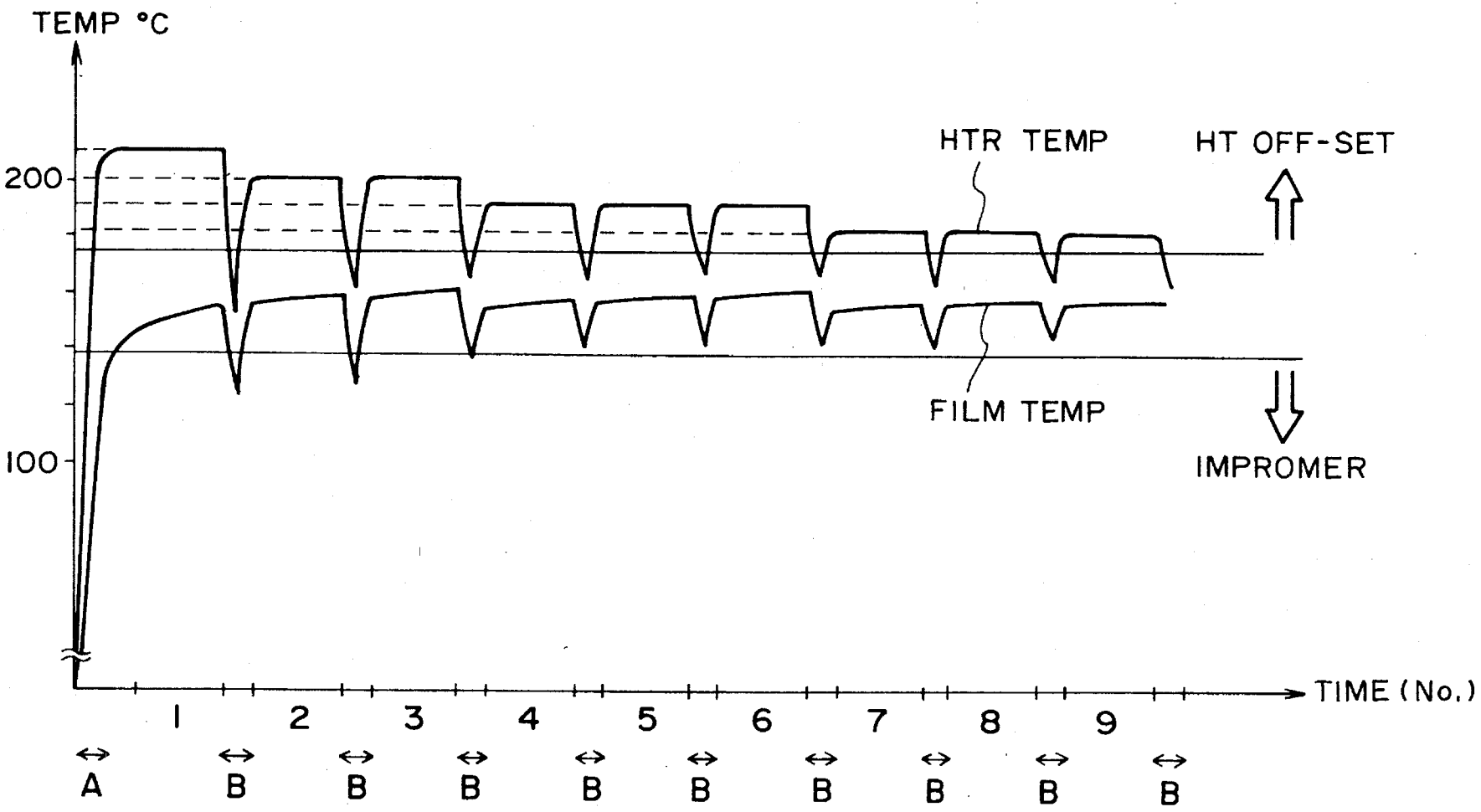

By doing so, the temperature decreasing speed of the heater can be detected with certainty. On the basis of these pieces of informations, the thermal state of the entirety of the apparatus including the back-up roller, can be predicted. Then, by properly changing the set temperature for the heater, the film temperature can be maintained constant, as shown in FIG. 36, thus avoiding the insufficient image fixing and high temperature offset.

In the foregoing example, the lowering speed of the heater is detected. However, the same advantageous effect can be provided when the set temperature for the heater is changed on the basis of the temperature reached by the heater in a predetermined period of time as in this example.

Figure 37:
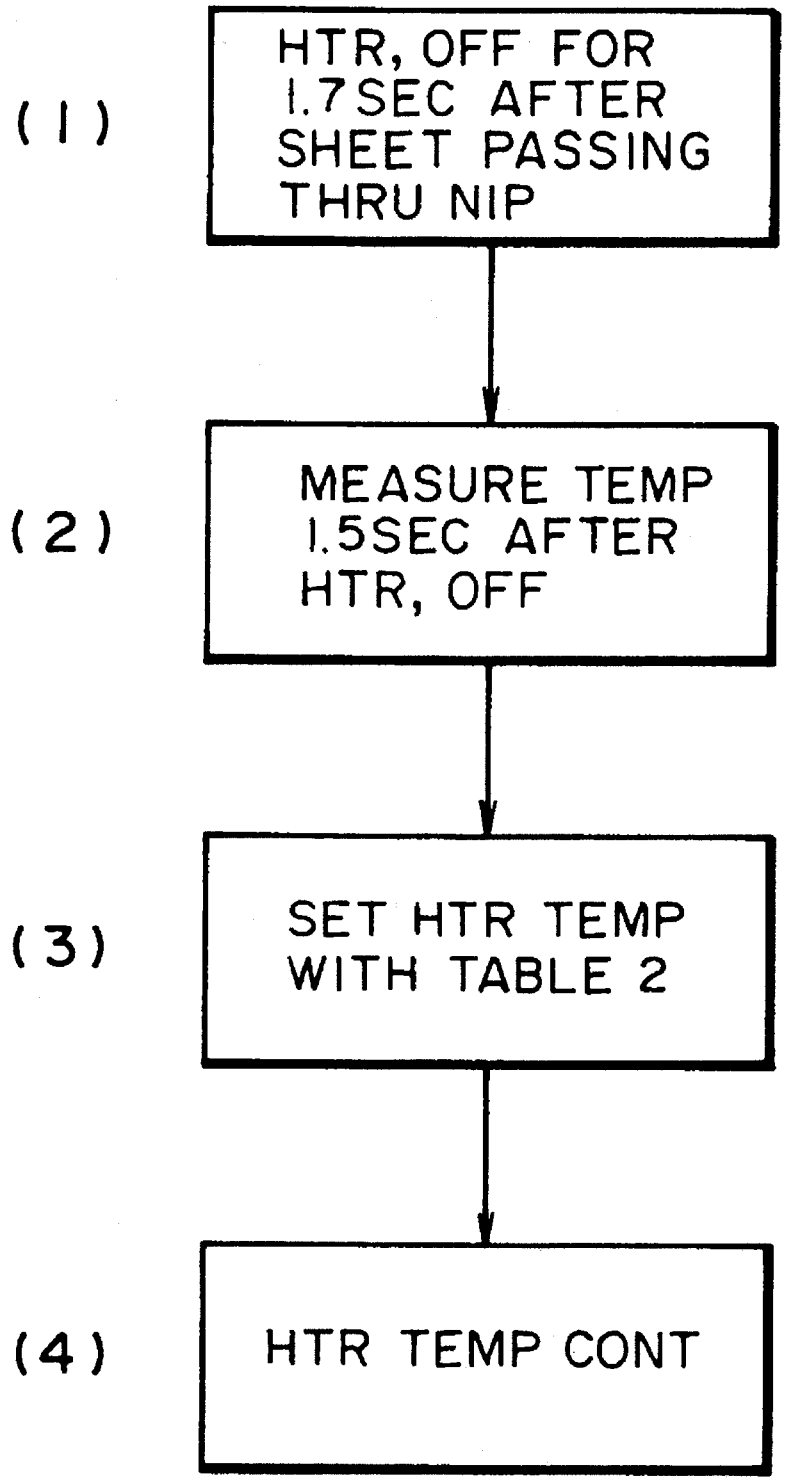
FIG. 37 shows a heater control algorithm.

More particularly, the set temperature of the heater is determined through the algorithm shown in FIG. 37.

(1) Simultaneously with the recording material leaving the fixing nip N, the electric power supply to the heater is rendered off for 1.7 sec:

(2) The temperature of the heater reached in 1.5 sec is detected:

(3) The heater control temperature for the next sheet is determined in accordance with the following Table 8:

TABLE 8

| REACHED TEMP. | SET TEMP. |
|---|---|
| <120 (°C.) | 210 (°C.) |
| 120–140 | 200 |
| 140–150 | 190 |
| >150 | 180 |

(4) The temperature control for the heater for the next sheet is started.

By doing so, the heater temperature can be controlled without erroneous detection as in the foregoing example. As a result, the constant temperature of the film is assured, and therefore, the high temperature offset and the insufficient image fixing, can be prevented.

Figure 38:
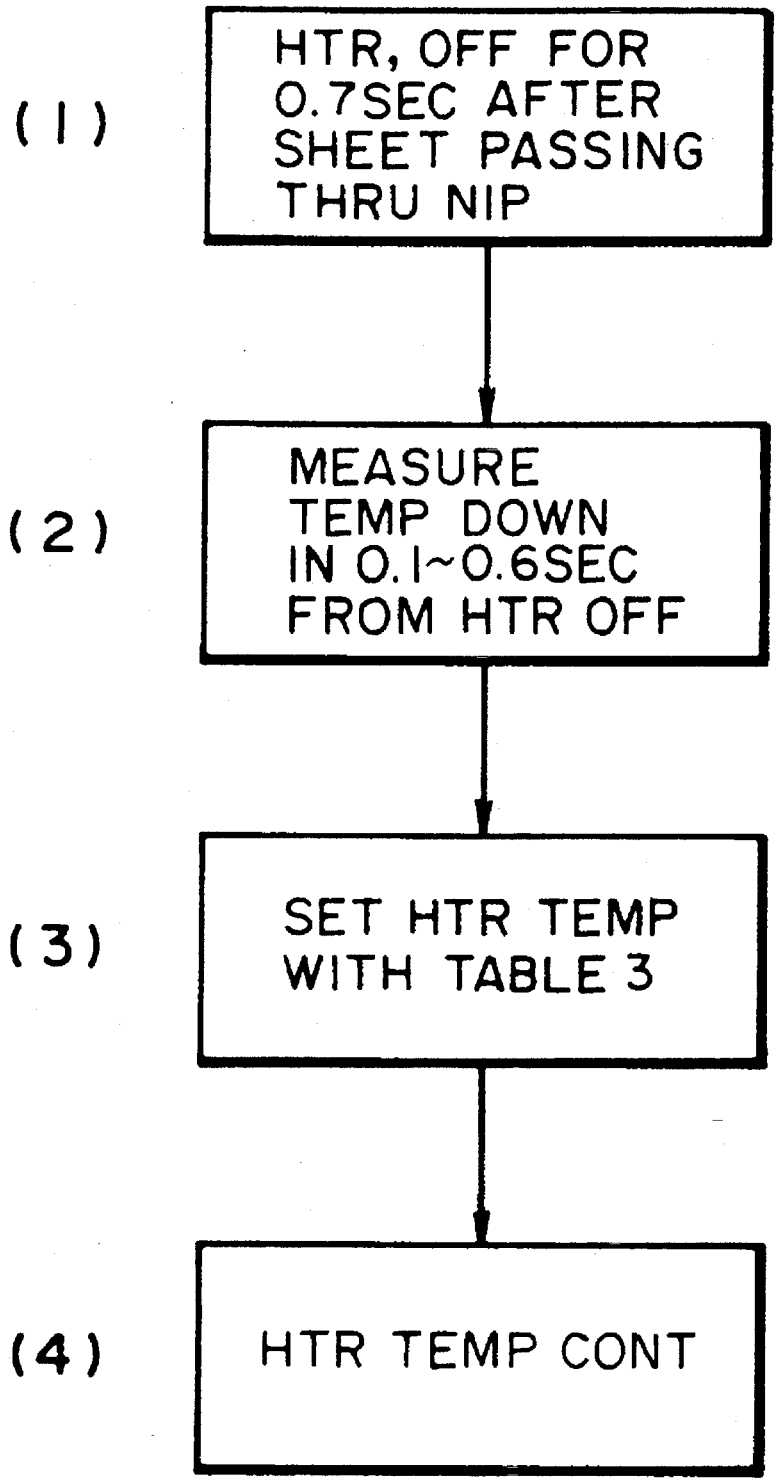
FIG. 38 shows a heater control algorithm.

In the foregoing example, simultaneously with the stop of the electric power supply to the heater, the lowering speed is detected. In the present example, the start of the lowering speed detection is assured to be after stoppage of the electric power supply to the heater. More particularly, the algorithm shown in FIG. 38 is used to determine the control temperature for the heater for the next sheet is determined.

(1) When the recording material leaves the fixing nip N, the electric power supply to the heater 2 is forcedly rendered off for 0.7 sec:

(2) The heater temperature decrease from 0.1 sec to 0.6 sec in which the heater 2 is not energized, is detected:

(3) On the basis of the detection, the control temperature for the heater surface for the next sheet, is determined in accordance with Table 9.

TABLE 9

| TEMP. DECREASE | DECREASING SPEED | SET TEMP. |
|---|---|---|
| >25 (deg) | >50 (deg/sec) | 210 (°C.) |
| 20–25 | 40–50 | 200 |
| 15–20 | 30–40 | 190 |
| <15 | <30 | 180 |

(4) The temperature control for the heater is started.

Figure 39:
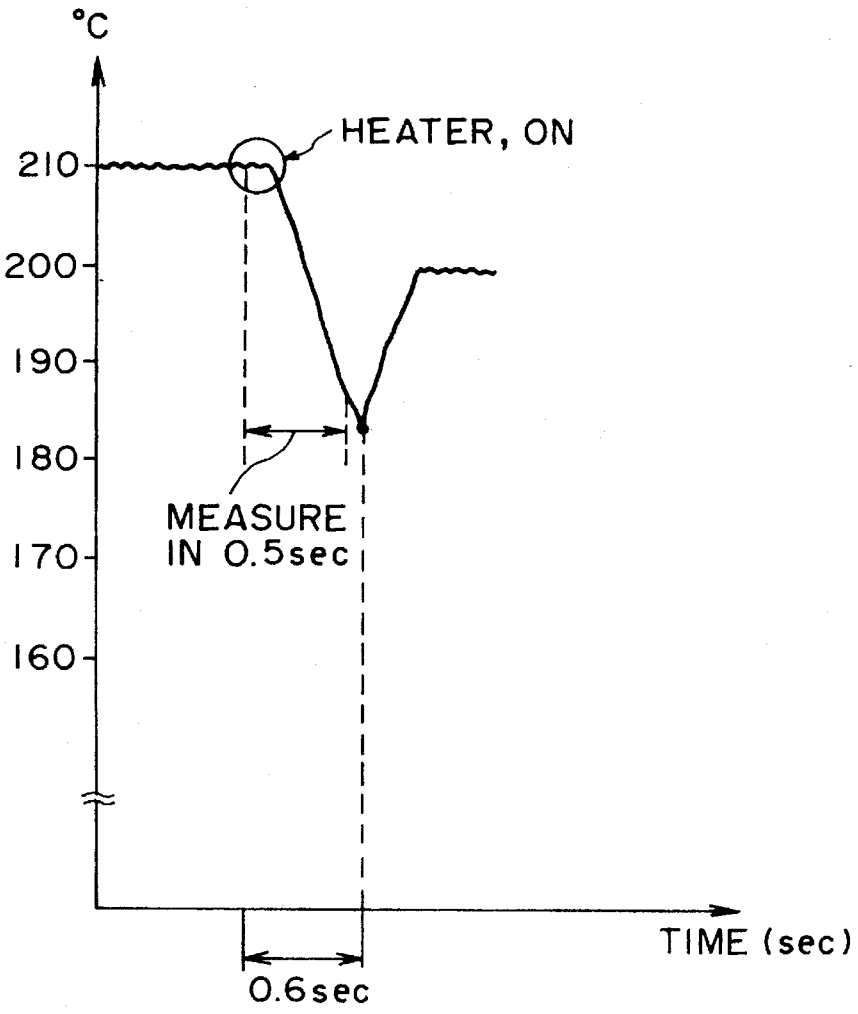
FIG. 39 is a graph of heater temperature change upon erroneous detection, which is solved by the present invention.

According to this example, the erroneous operation in the detection start as shown in FIG. 39 in detecting the heater temperature decreasing speed, is avoided.

Figure 40:
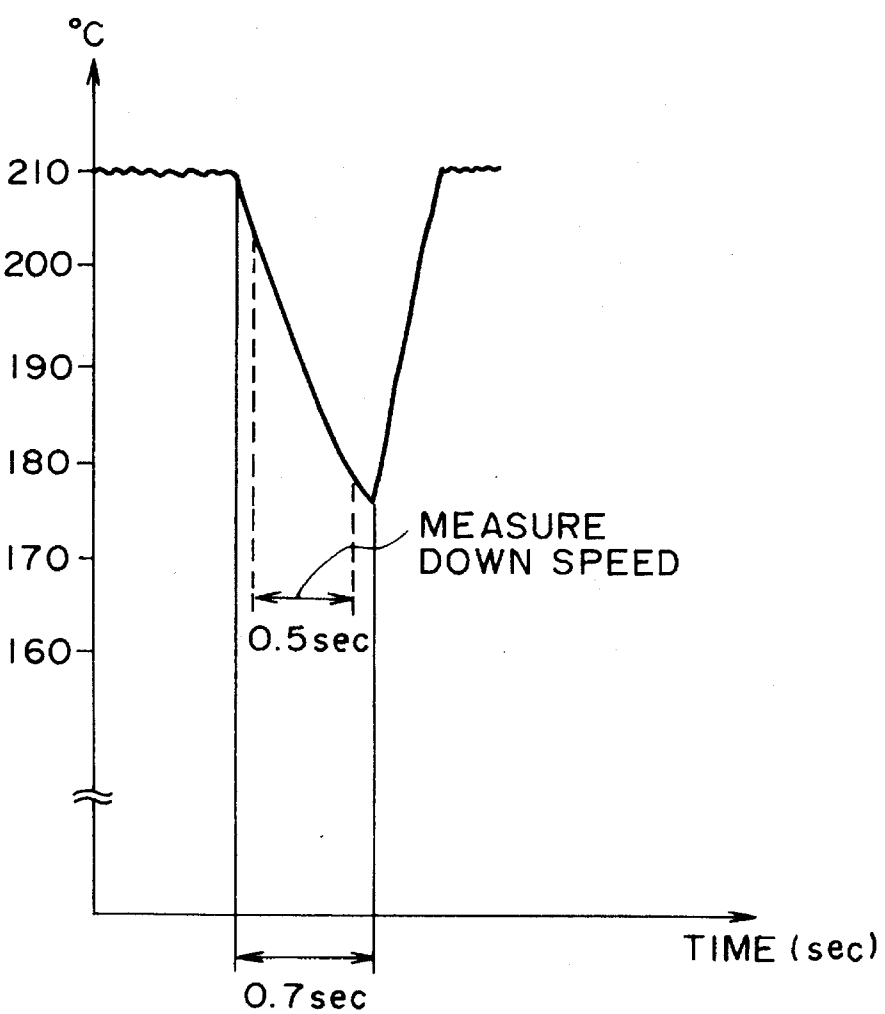
FIG. 40 is a graph of heater temperature change when a control system according to an aspect of the present invention is used.

According to this example, even if there is variation in the sheet feeding speed with the result of variation in the timings at which the sheet trailing edges leaving the fixing nip N, the heater temperature lowering speed can be correctly detected, as shown in FIG. 40. By changing the heater control temperature on the basis of the information, good fixed images can be produced.

Another example will be described in which the temperature control mode is provided for the sheet absent period, and in that mode, the temperature is decreased to a predetermined temperature in a predetermined period (0.5 sec).

In the foregoing example, only the temperature is detected despite the fact the sheet absent period control mode has started before 0.5 sec, it is erroneously detected that the apparatus is hot if the temperature is higher than the control temperature after 0.5 sec due to the temperature ripple. Therefore, the control temperature for the heater is decreased.

Figure 41:
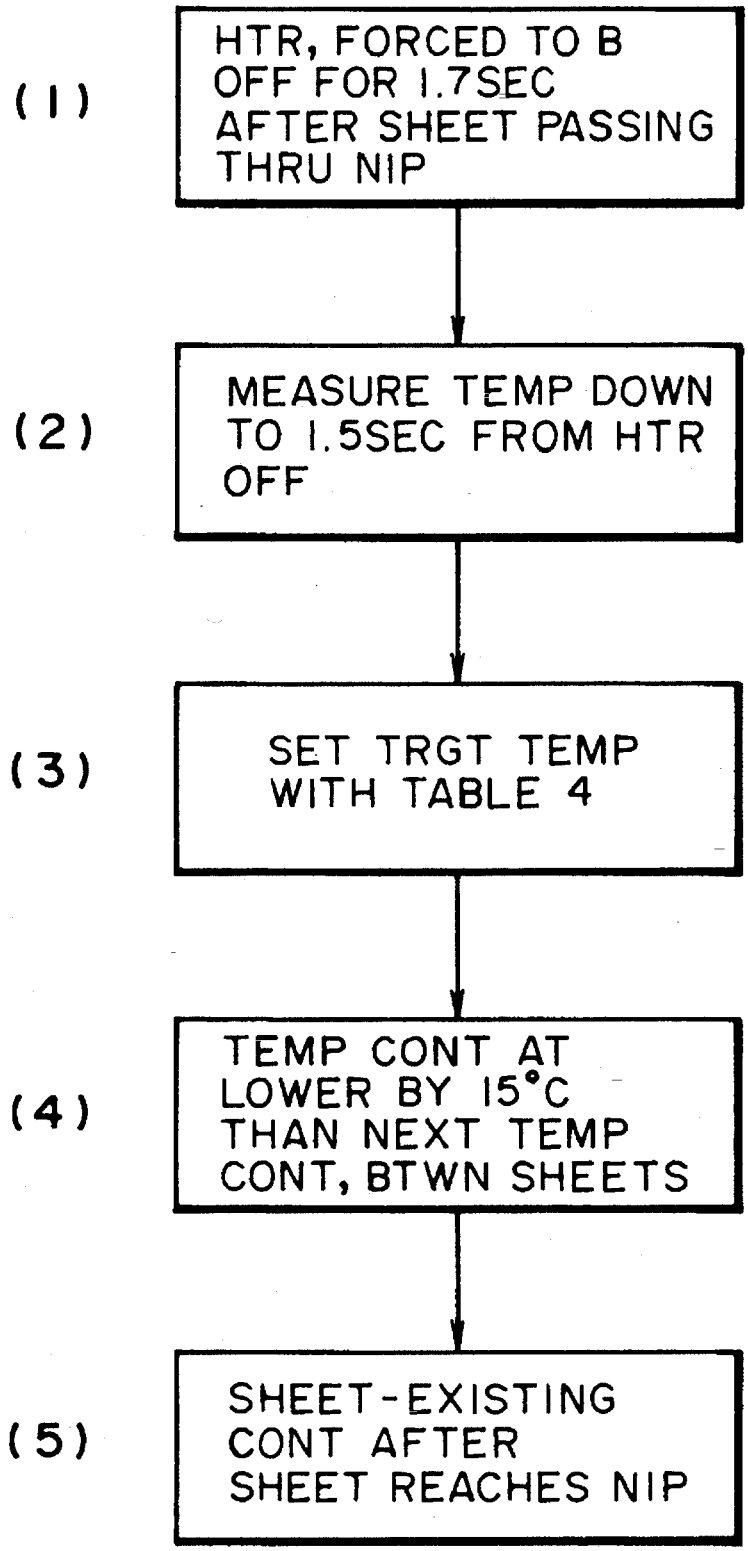
FIG. 41 shows a heater control algorithm.

In order to prevent such an erroneous detection, in the present example, the control temperature for the heater is determined through the algorithm shown in FIG. 41.

(1) Upon the recording material P leaving the fixing nip N, the heater 2 is forcedly rendered off for 1.7 sec:

(2) The temperature reached in 1.5 sec from the heater off, is detected:

(3) On the basis of the detection, the control temperature for the next is determined in accordance with the following Table 10.

TABLE 10

| REACHED TEMP. | SET TEMP. FOR SHEET PRESENT |
|---|---|
| <120 (°C.) | 210 (°C.) |
| 120–140 | 200 |
| 140–150 | 190 |
| >150 | 180 |

(4) When the sheet absent period is long, the sheet absent period control mode is provided at a position 15 degrees lower than the control temperature:

(5) Upon arrival of the recording material P at the fixing nip N, the operational mode is switched to the temperature control mode for the sheet processing.

Figure 42:
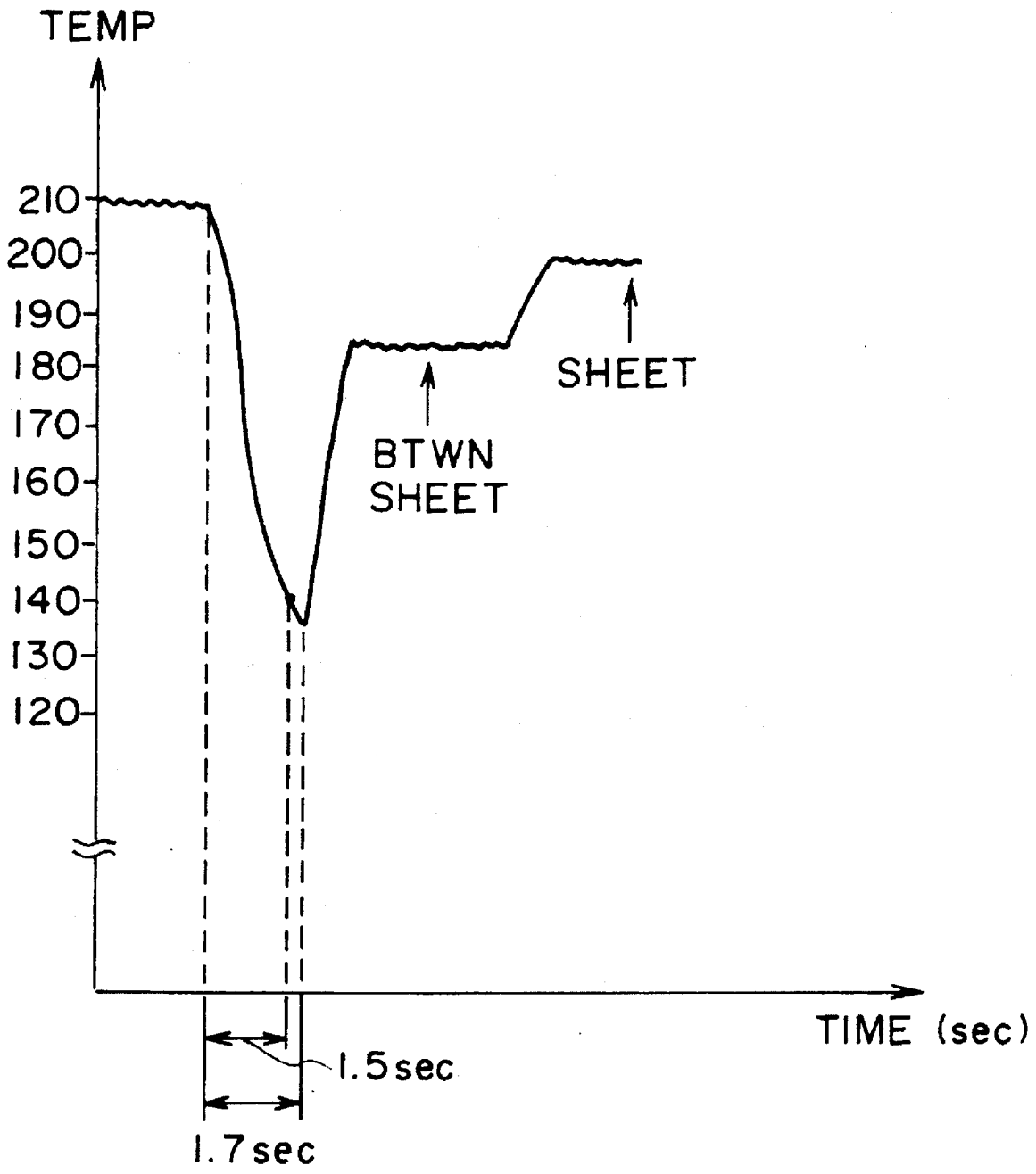
FIG. 42 is a graph of heater temperature change.

By doing so, the surface temperature becomes as shown in FIG. 42. By the provision of the second temperature controlling mode in the sheet absent period, the surface control temperature for the heater can be changed without erroneous detection.

In the foregoing example, the heater is forcedly rendered off in the sheet absent period, and the temperature lowering is detected. It is a possible alternative that a predetermined electric power supply is forcedly carried out in the sheet absent period, and the temperature increasing change is detected in a period shorter than the on-period, by which the thermal state of the apparatus can be predicted, thus determining the control temperature for the next sheet with certainty.

As in the foregoing examples, the erroneous detection for the temperature change of the heater can be avoided by making the period in which the constant power is supplied, or the period in which the electric power supply is forcedly rendered off, longer than the time period in which the temperature change of the heater is detected.

A further embodiment will be described in which erroneous detection relating to the temperature change of the heater is avoided.

In this embodiment, the heater is started up with constant electric power supply of 500 W. The electric power having the frequency of 500 Hz and the voltage of 100 V AC is used. The basic number of waves for the wave number control is 20 waves. The heater is started up with 14 waves on and 6 waves off.

If, at this time, the entire apparatus is cold, the temperature increasing speed of the heater is low. If, on the contrary, the entire apparatus including the pressing or back-up roller and the stay is warm, the temperature increasing speed is high. Therefore, by detecting the speed, the thermal state of the apparatus can be predicted. On the basis of the prediction, the set temperature of the heater for the first sheet is determined, so that the film temperature for the first sheet can be determined so as to be in the range without the insufficient image fixing and the high temperature offset. These are the same in the foregoing embodiments.

Figure 43:
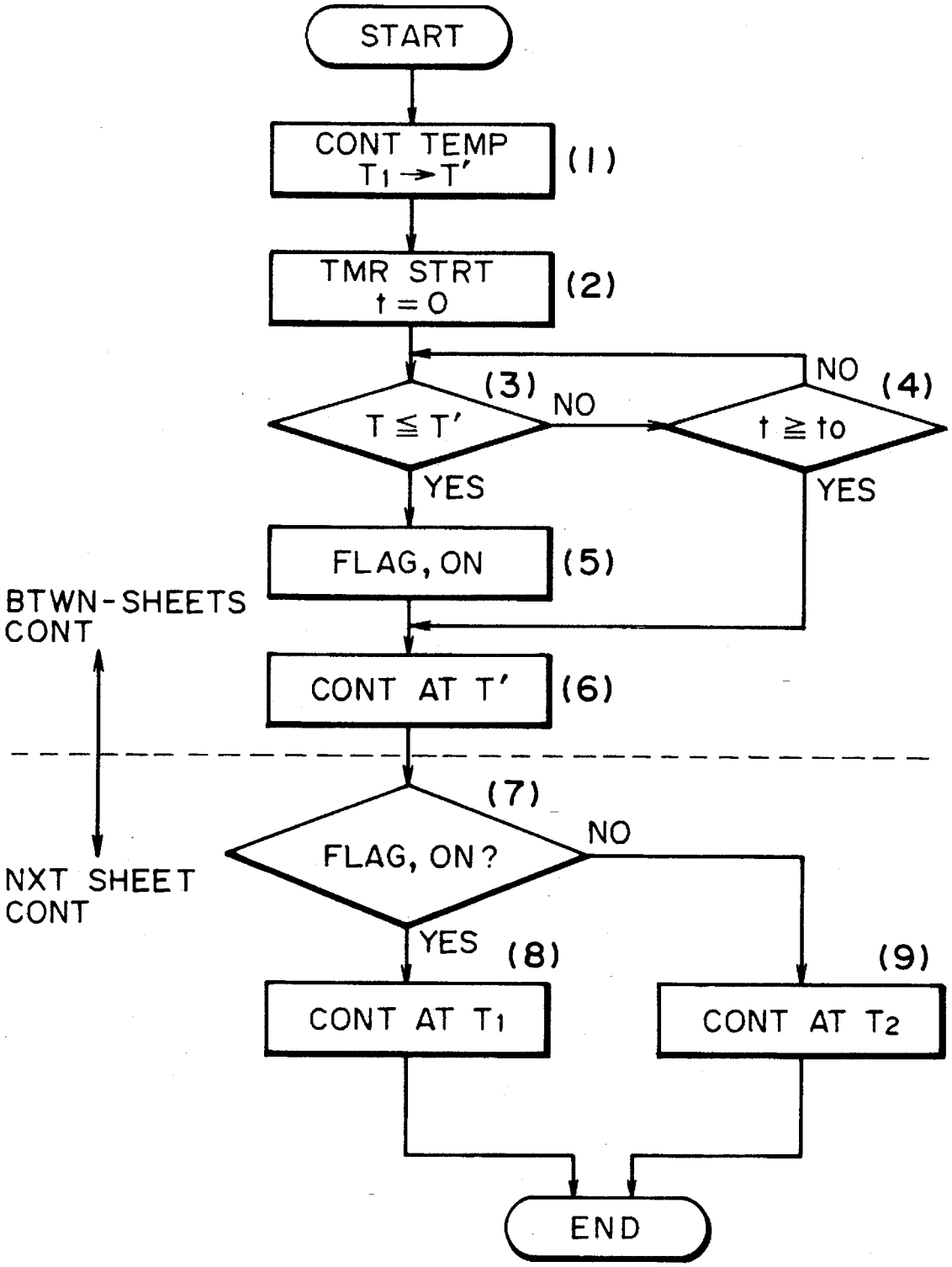
FIG. 43 is a heater control flow chart of a heating apparatus according to a further embodiment of the present invention.

The description will be made as to the case in which the recording sheets are continuously supplied. In this case, the heater temperature is set through the algorithm shown in FIG. 43.

Figure 44:
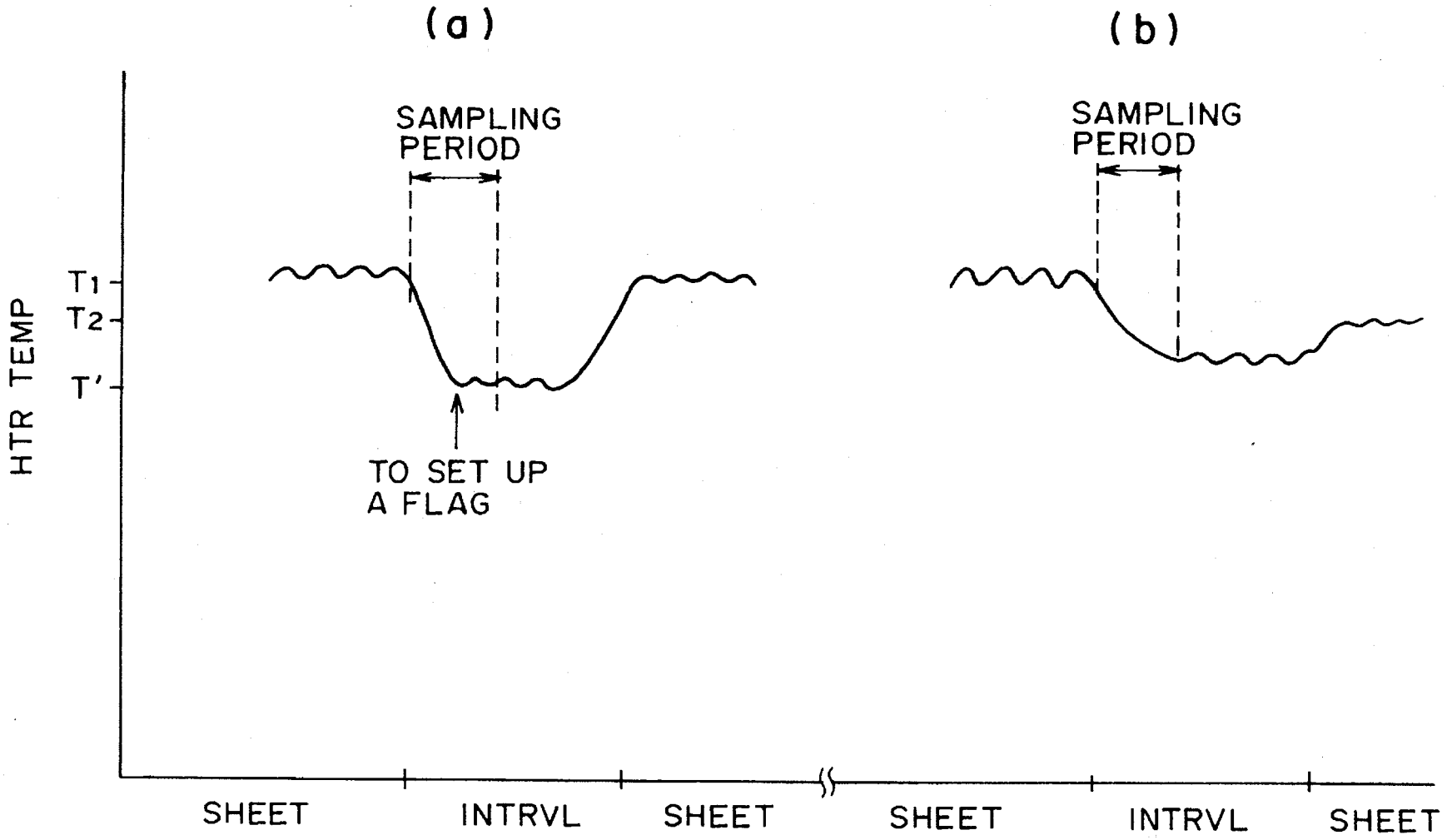
FIG. 44 shows a heater temperature change.

(1) Simultaneously with the recording material P leaving the fixing nip N, the control temperature is switched from T1 to T'. (2) The timer is started. (3) If the temperature T of the heater is higher than T', the operation proceeds to (4). (4) If the timer does not reach the sampling period, the operation goes back to (3). If the discrimination at (3) is affirmative, a flag is set at (5). (6) The control temperature in the sheet absent period is first set to T'. If the timer exceeds the sampling period at (4), the operation proceeds to (6) without setting the flag, and the control operation is effected with the temperature T'. If the flag is set for the next recording material at (7), the operation proceeds to (8), and the heater is controlled with the same temperature T1 as for the previous recording material. If the flag is not set at (7), the control temperature is switched to T2 at (9), and the next recording material fixing operation is carried out. The temperature change in the case of the above control is shown in FIG. 44.

In this manner, the flag is used such that if it is set, the cold state of the apparatus is discriminated, and the control temperature during the sheet present period is not controlled, whereas if the flag is not set, the control temperature is lowered. By doing so, the film temperature can be maintained in a temperature range without the improper image fixing or the high temperature offset.

The experiments will be described. The control temperature for the heater 2 during the sheet present period is sequentially switched in the manner shown in Table 11. More particularly, when the flag is not set, from 180° C. to 170° C.

from 170° C. to 163° C., and from 163° C. to 155° C.

the control temperature during the sheet present period for the heater is changed in this manner. The sampling time t0=0.3 sec.

TABLE 11

| SHEET PRESENT | SHEET ABSENT |
|---|---|
| 180 (°C.) | 163 (°C.) |
| 170 | 158 |
| 163 | 150 |
| 155 | 120 |

Figure 45:
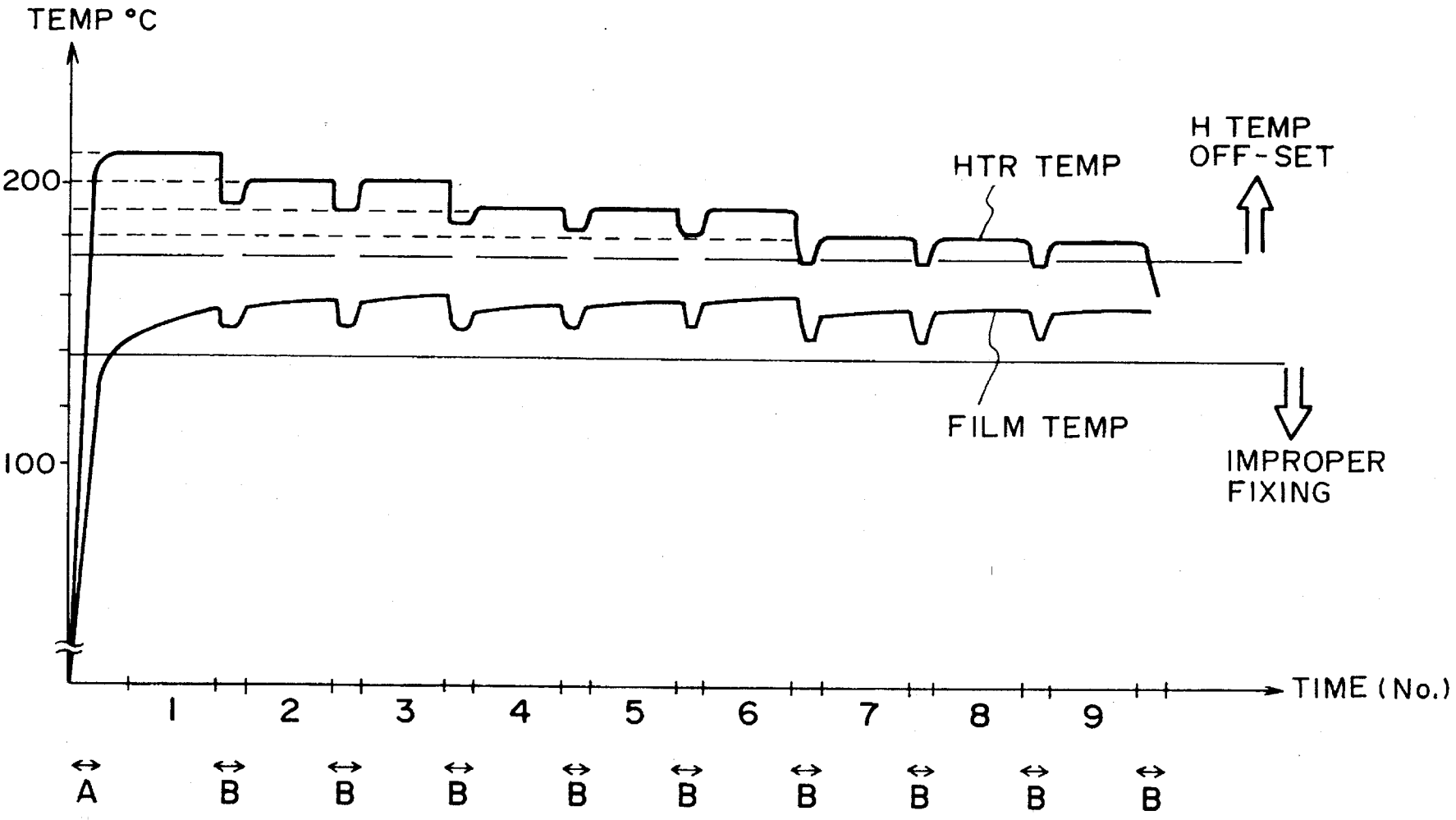
FIG. 45 is a graph showing temperature changes of a heater and a film.

As as result, as shown in FIG. 45, the temperature of the film can be maintained in a range without the high temperature offset and without the insufficient or improper image fixing.

In the previous example, the next control temperature is determined on the basis of whether the flag is set or reset. In the present example, the discrimination is made as whether the timing at which the sheet absent period temperature control starts is early or not. More particularly, the time period t from the reaching to the sheet absent period control temperature to a predetermined time $t_0'$ (it may be a control period from the start of the sheet absent control), is measured. The time t is short if the film and the back-up roller is warm, and is long if they are cold.

Figure 46:
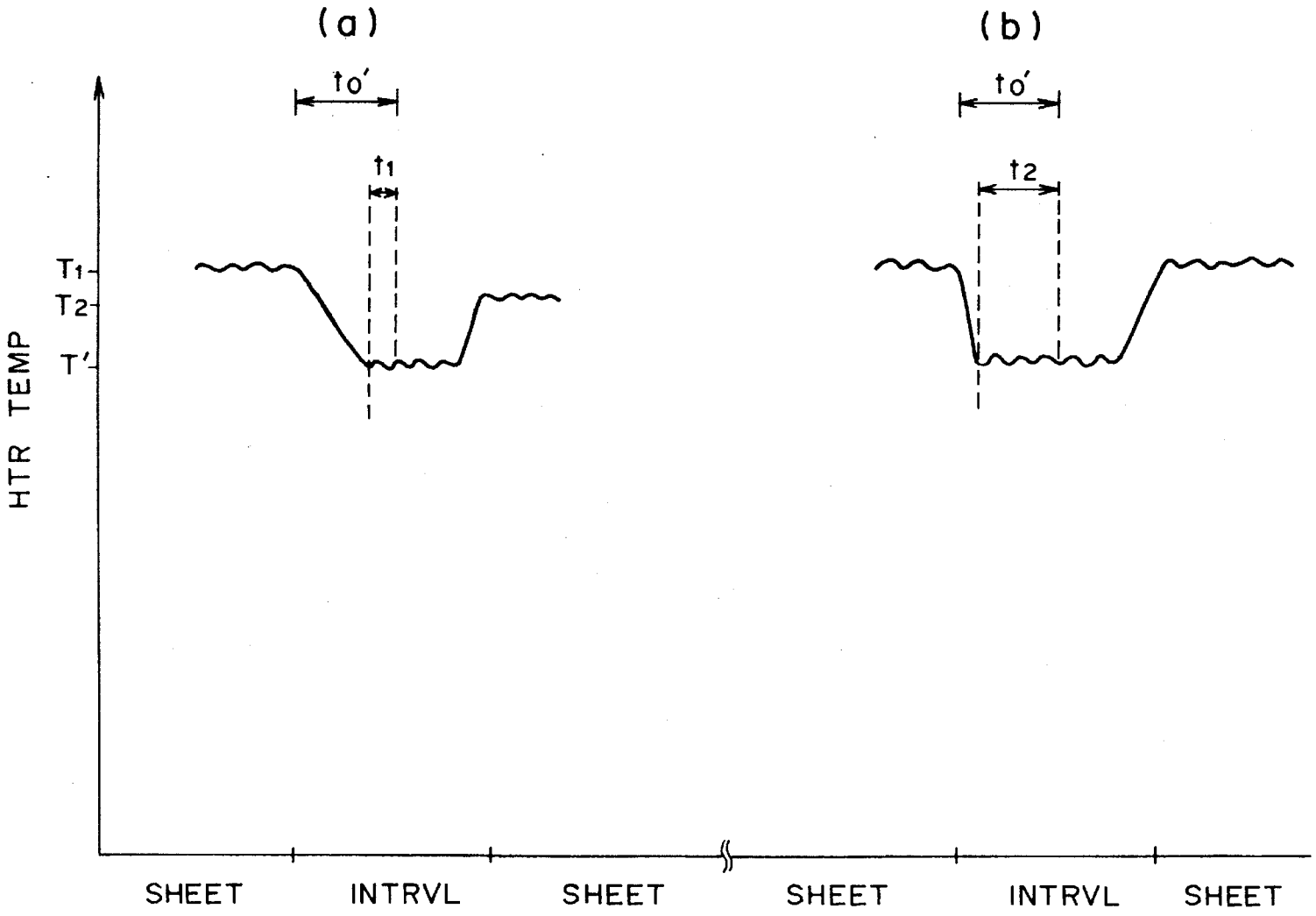
FIG. 46 is a graph of temperature change of a heater.

Therefore, if the time period t is short, as shown by $t_1$ in (a) in FIG. 46, the control temperature for the next recording material is lowered to T2. On the other hand, if t is long as indicated by $t_2$ in (b), the control temperature T1 for the next recording material is maintained.

The same results are in FIG. 45 are obtained also in the following manner. The control temperatures during the sheet absent and present periods are the same as in the embodiment. The time period $t_0'$ is 0.3 sec. When $t \leqq 0.2$ sec, the control temperature for the next recording material is the same as the previous recording material. When $0.3 \geqq t > 0.2$ sec, the control temperature for the next recording material is decreased by one step. In other words, if 180° C. control is effected for the previous recording material, the temperature for the next recording material is lowered to 170° C.

A further embodiment will be described in which the erroneous detection for the heater temperature change is eliminated, and the film temperature can be maintained at the constant level in any mode of the operation of the apparatus to avoid the improper fixing or the high temperature offset of the image heating apparatus.

Figure 47:
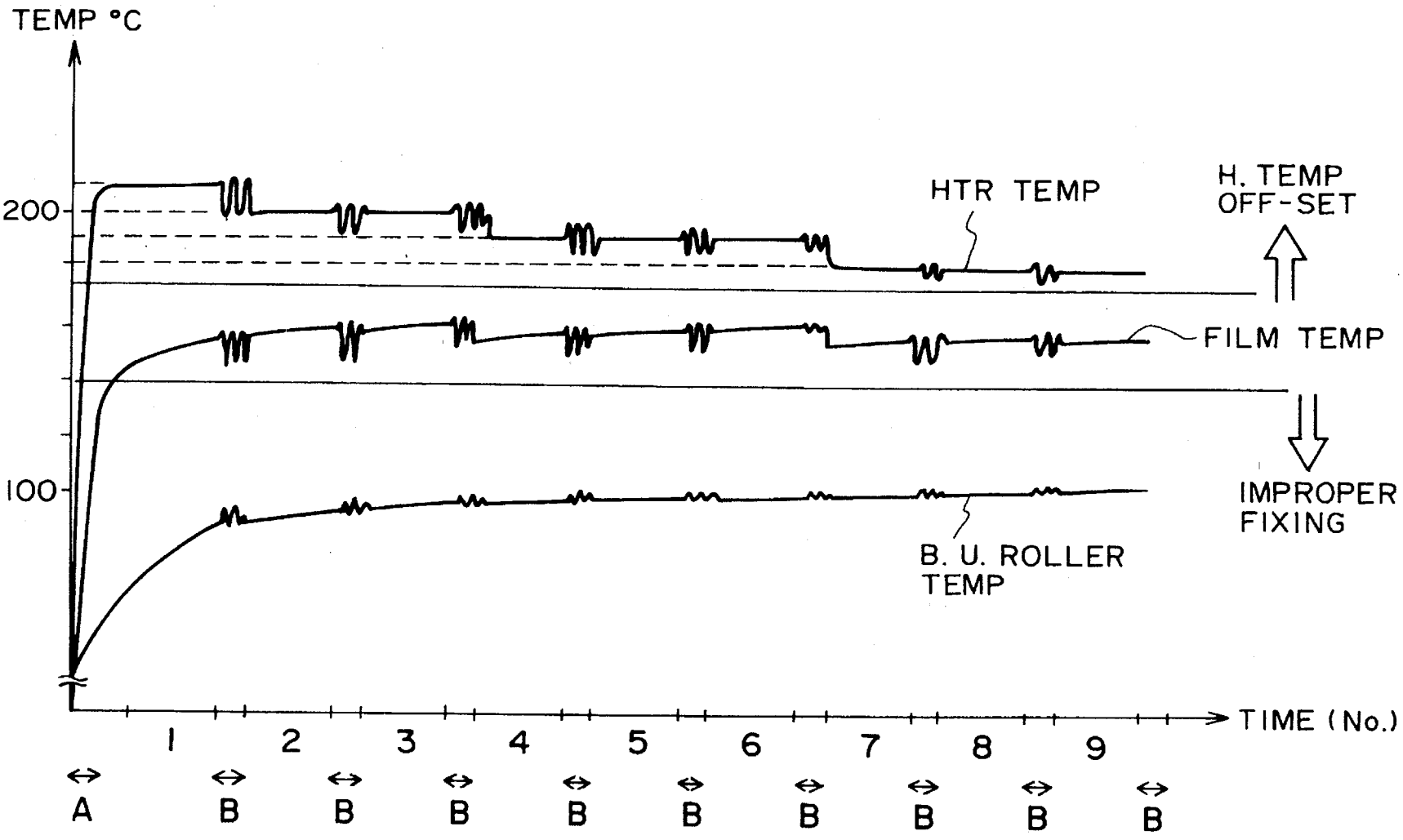
FIG. 47 is a graph of temperature changes of a heater, a film and a back-up roller of a heating apparatus according to a further embodiment of the present invention.

FIG. 47 is a graph of change, with time, of the heater temperature, film temperature and the back-up roller temperature during the continuous printing operation.

Figure 48:
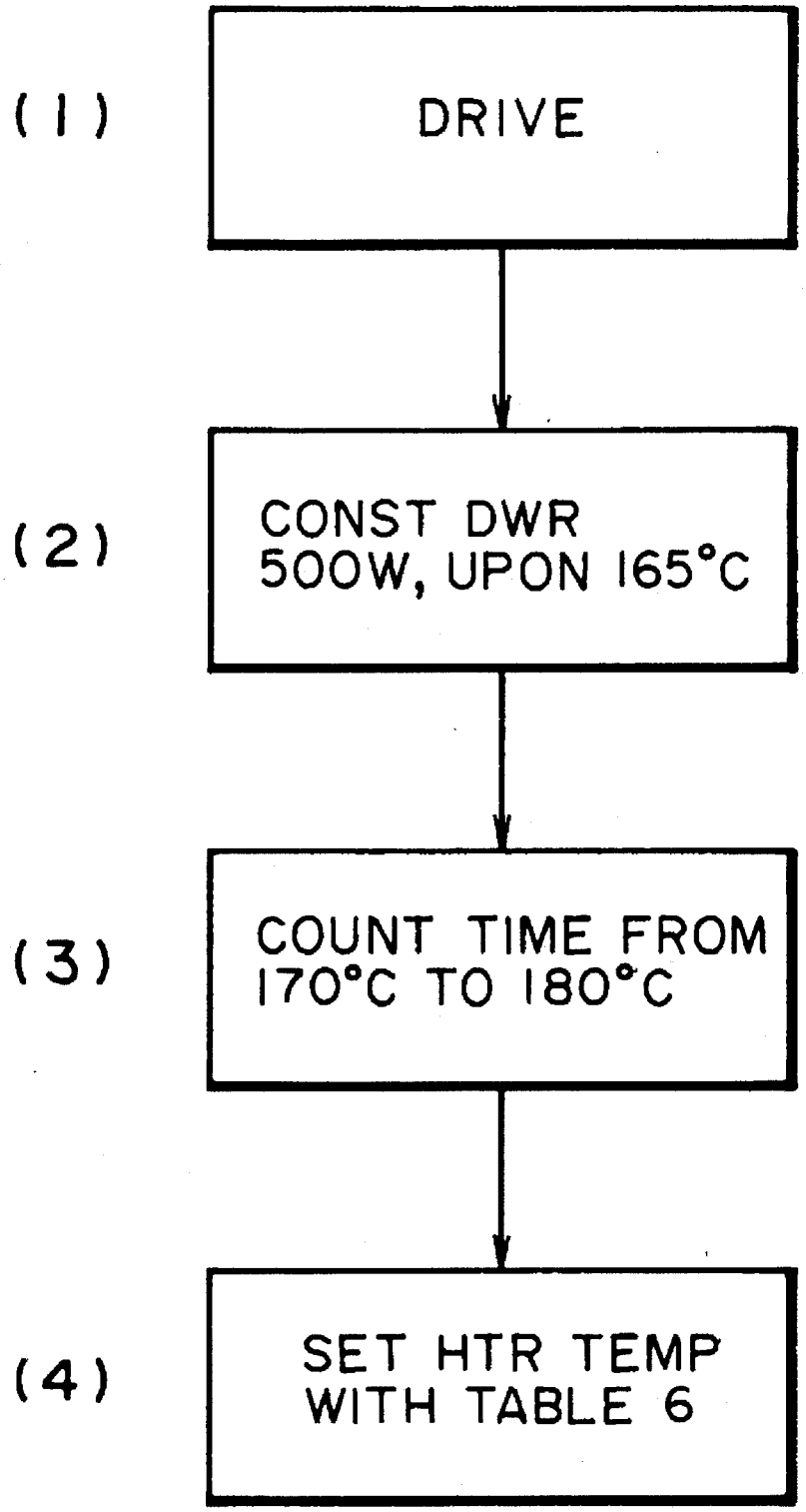
FIG. 48 shows a heater control algorithm.

At the time of heater start-up, the temperature for the heater is set in accordance with the algorithm of FIG. 48 and the following Table 12:

TABLE 12

| MEASURING TIME | INCREASING SPEED | SET TEMP. |
|---|---|---|
| >1 (sec) | >10 (°C./sec) | 210 (°C.) |
| 0.5–1 | 10–20 | 200 |
| 0.33–0.5 | 20–30 | 190 |
| <0.33 | >30 | 180 |

The heater is started up with the constant electric power supply of 700 W. When the heater temperature reaches 165° C., the supply power is switched to 500 W.

More particularly, on the basis of the information from the AC voltage source detector and the heater resistance detecting means, the electric power control means controls by pulse width modulation such as phase control and wave number control or the like to provide a constant electric power supply. In this embodiment 700 W heater (100% power supply) with the frequency of 50 Hz and the voltage of 100 V AC, was used. The AC voltage was controlled with 100 msec on and 40 msec off to provide the constant 500 W control power supply.

If the entire apparatus is cold, the temperature increasing speed of the heater is low. If, on the contrary, the entire apparatus is warm, the increasing speed is high. Therefore, if the increasing speed is considered, the temperature of the back-up roller or the stay can be predicted. On the basis of the prediction, the set temperature for the heater for the first sheet is controlled. By doing so, the film temperature can be maintained with simple operation to prevent the improved fixing and the high temperature offset, irrespective of in what manner the apparatus is operated before.

In the sheet present period, if it is controlled at 200° C., for example, the temperature supply is alternately switched between a level slightly higher than the required electric power and the level slightly lower than the required level, by which the temperature ripple is reduced.

If the electric power required for maintaining the temperature at 200° C., for example, the high level of 190 W and the low level of 170 W are properly switched in the control operation. This is based on the finding that since it is difficult to correctly control to the required power even through the phase control and the wave number control, it is better to control by the high and low levels against the variation of the thermal capacity of the apparatus and the degree of warming of them. In the sheet absent period, the high level is 190 W, and the low level is significantly lower than that, 0 W, for example.

Figure 49:
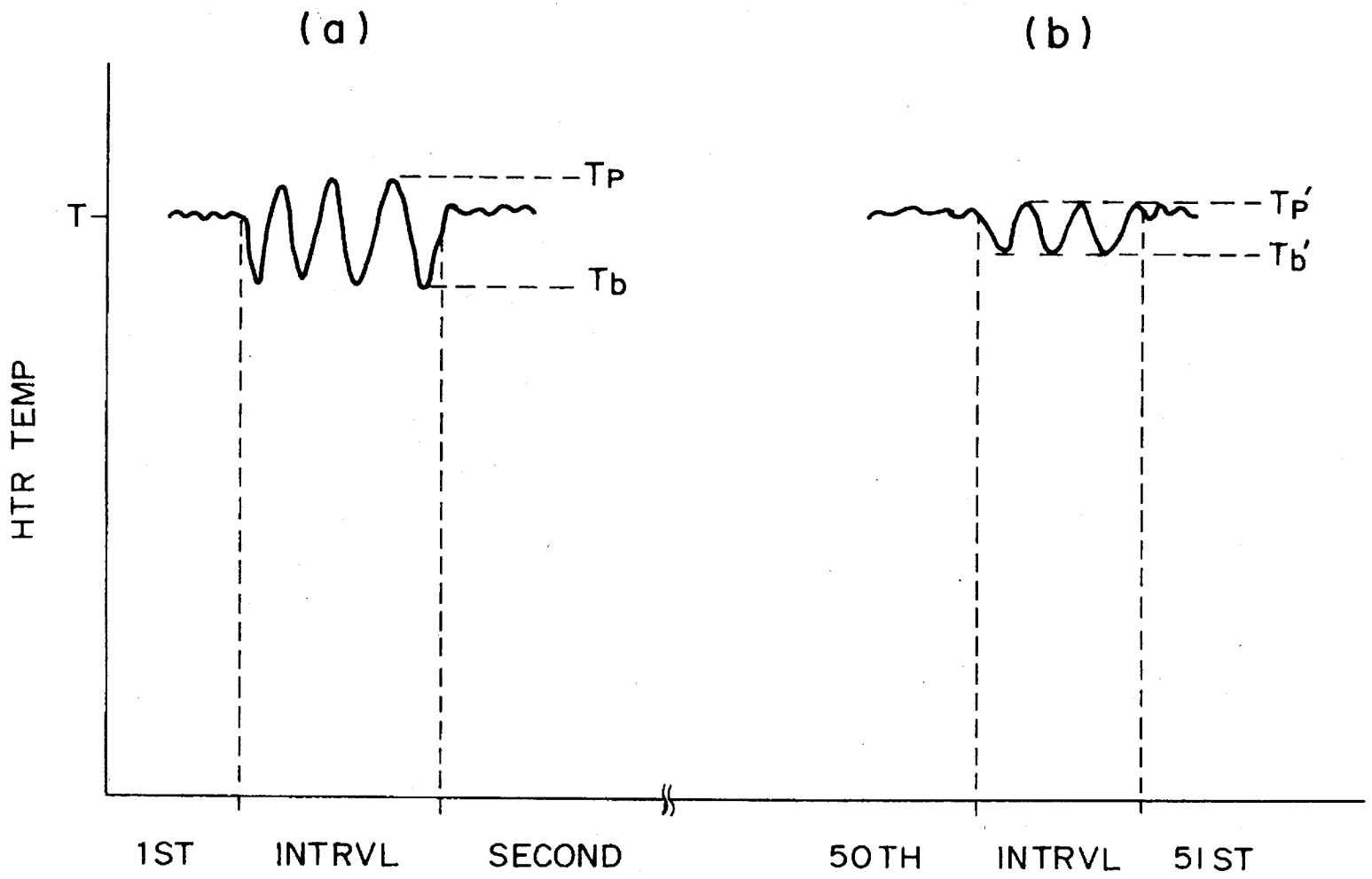
FIG. 49 shows a ripple in a sheet absent period.

Then, as shown in FIG. 49, a large temperature ripple occurs. The temperature ripple is large as indicated by (a) when the apparatus is in cold state, since the heat is quickly removed from the heater to the back-up roller 10 or to the film 1. On the other hand, the ripple after about 50 sheets continuous processing, the ripple is small as indicated by (b), since the apparatus is already warm.

Accordingly, by measuring the degree of the ripple (Tp–Tb) the degree of the warming of the pressing roller 10 and the film 1 can be discriminated. Therefore, on the basis of (Tp from Tb), the control temperature during the sheet present period is switched, and then, the printing operation can be continued without offset and without insufficient image fixing.

In the example of FIG. 47, the control temperature is switched in accordance with the degree of the ripple and in accordance with the following Table 13.

TABLE 13

| Tp – Tb (deg) | CONTROL TEMP. FOR NEXT SHEET (°C.) |
|---|---|
| 70 | 210 |
| 50 | 200 |
| 30 | 190 |
| 10 | 180 |

By controlling the heater temperature on the basis of the warming degree of the apparatus, and the temperature is decreased gradually during the continuous printing operation, the improper image fixing and the toner offset could be prevented.

The high and low power control in the sheet absent period, may be carried out only in a part of the sheet absent period. It will suffice if the control mode is switched to the sheet present mode control at a proper timing with which the proper control temperature is reached before the recording material P enters the fixing nip.

In the above example, the control is based on Tp–Tb, but the control operation can be carried out on the basis of Tb or Tp.

The following Table 40 was used for the control on the basis of Tb, and the following Table 15 was used for the control on the basis of Tp. In any case, the continuous printing operation was possible without toner offset and without improper fixing.

TABLE 14

| Tb | Switching |
|---|---|
| ≦180° C. | 210° C. → 200° C. |
| ≦160° C. | 200 → 190 |
| ≦150° C. | 190 → 180 |

TABLE 15

| Tb | Switching |
|---|---|
| ≦215° C. | 210° C. → 200° C. |
| ≦205° C. | 200 → 190 |
| ≦195° C. | 190 → 180 |

In the foregoing example, the heater is controlled with the same temperature irrespective of the sheet absent period and sheet present period. However, in the present example, the control temperature for the sheet absent period is lowered than that during the sheet present period by not less than 15 degrees.

By doing so, the temperature increase during the continuous printing operation can be suppressed. In addition, the temperature rise in the sheet non-passage region of the heater during the continuous small size processing, can be reduced, and in addition, an wasteful electric power consumption can be prevented.

Figure 50:
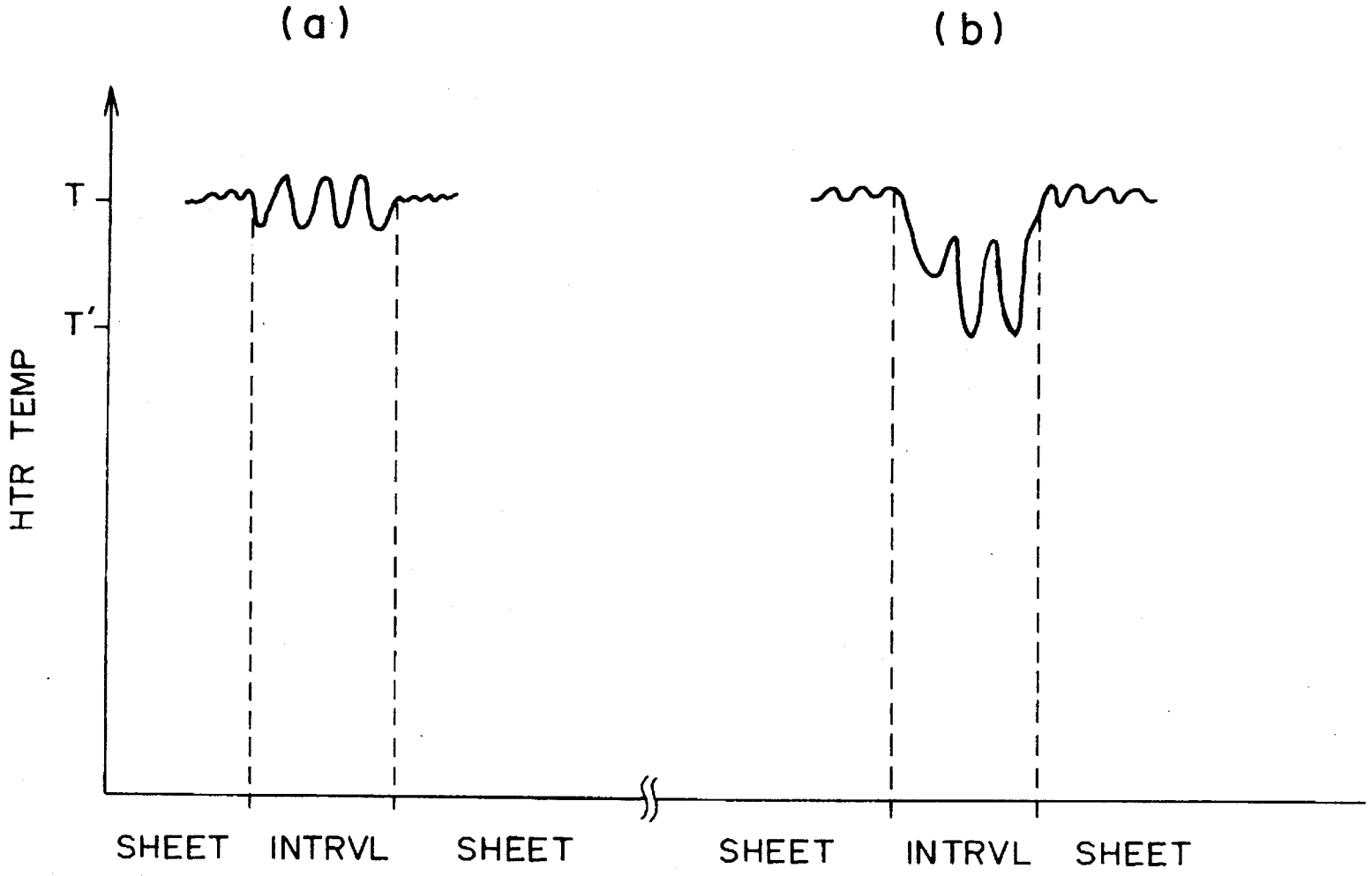
FIG. 50 shows a ripple in a sheet absent period.

It is also to increase the ripple or the like to increase the detection accuracy. The comparison of the ripple is shown in FIG. 50; (a) is for the case of Tables 8 and 9; and (b) is for this example. In this figure, T is the control temperature for the sheet present period, and T' is the control temperature for the sheet absent period.

As described in the above examples, by controlling the electric power supply to the heater in the sheet absent period by the use of high level and the low level which is significantly lower than the high level, the temperature ripple is produced. Using the degree of the ripple, the control temperature for the next recording material is changed to permit continuous printing operation without offset and insufficient image fixing.

A further embodiment will be described in which when the heater is started up to a predetermined temperature with the electric power supply which is controlled by wave number control, the temperature increasing speed is detected, and in accordance with the speed, the various control value is determined thereafter. In such an apparatus, the error of the speed detection is reduced, and the control after the start-up is correctly executed in this embodiment. The heater is started up with 500 W constant electric power. At this time, the electric power supply to the heater is controlled by wave number control on the basis of information from unshown AC voltage detecting circuit and heater resistance detecting means or the like so that the electric power supply to the heater is 500 W irrespective of the input voltage level.

In this example AC voltage of 115 V AC having a frequency of 50 Hz was used. The basic wave number for the wave number control was 20, and the heater was started up with 15 waves on and 10 waves off.

Accordingly, the time required $t_w$ required for repeating one cycle by the basic number of waves, is:

$$t_w = 1.0\ (\text{sec}) \times [20\ \text{waves}/(50\ \text{Hz} \times 2)]$$
$$= 0.2\ (\text{sec}) = 200\ (\text{msec})$$

In the above equation, "50 (Hz)×2" appears because in the wave number control of this example, half wave of the AC cycle is counted as one wave. In other words, the number of waves in 1 sec is 100.

The heater temperature continued to increase with small temperature ripple under the wave number control. When the thermister detects the temperature of 120° C., the CPU detects the temperature increasing speed in a constant time period $t_{base}$.

More particularly, upon arrival at the temperature of 120° C., the CPU starts a timer, and detects the temperature increase in a predetermined time period $t_{base}$.

In other words, the temperature increase speed is an average temperature increase speed in $t_{base}$. If the temperature increases T degrees in $t_{base}$ period, the temperature increasing speed v is: v is dD/d ($t_{base}$).

At this time, if the entire apparatus is cold, the temperature increasing speed of the heater is high. If, on the contrary, it is warm, the increasing speed is high. Therefore, if the temperature increasing speed v is considered, the temperature state of the pressing roller or the stay can be predicted. On the basis of the prediction, the control for the first sheet (control temperature and the supply electric power or the like) is determined. In this embodiment, the control temperature is determined in accordance with the following control Table 16.

TABLE 16

| INCREASING SPEED | CONT. TEMP. |
|---|---|
| <10 deg/sec | 210° C. |
| 10 deg/sec–20 deg/sec | 206° C. |
| 20 deg/sec–30 deg/sec | 202° C. |
| 30 deg/sec–40 deg/sec | 198° C. |
| 40 deg/sec–50 deg/sec | 194° C. |
| 50 deg/sec–60 deg/sec | 190° C. |
| 60 deg/sec–70 deg/sec | 185° C. |
| >7 deg/sec | 180° C. |

Under the condition of this example, it has been confirmed that between 100° C. and 160° C. of the heater temperature, the temperature increasing speed of the heater is approx. 150 degrees/sec when the electric power is supplied with the basic number of waves. This is the highest temperature increasing speed in this embodiment.

Figure 51:
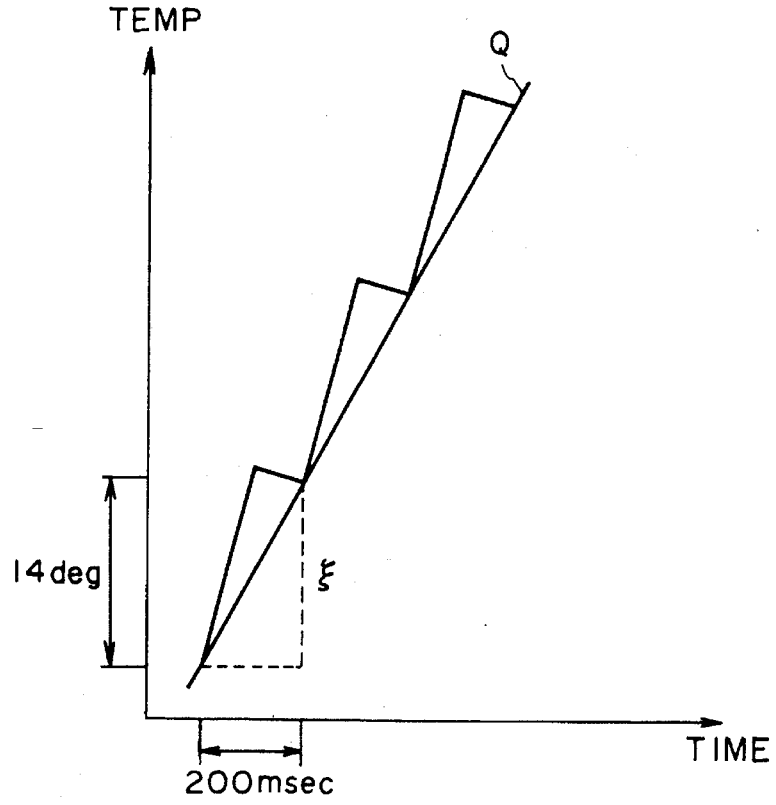
FIG. 51 is a graph of a heater temperature change of a heating apparatus according to a further embodiment of the present invention, during wave number control.

FIG. 51 shows the wave number ripple when the heater temperature is increased in this embodiment. The average temperature increasing speed per unit basic wave number of the heater is represented by an inclination ζ.

The speed is the same as the temperature increasing speed detected when the heater is started up with the full electric power supply without using the wave number control of 500 W.

In order to effect the constant electric power control using the wave number control, it is intended that the average increasing speed ζ is always obtained under the condition that the increasing temperature is ζ.

Therefore, the output detected when the increasing speed is detected, is required to have the inclination ζ or higher.

In this example, the increasing speed measuring time $t_{base}$ is 200 nsec, so as to be equal to the time $t_w$ required for one cycle of the basic wave number. In other words, $$t_{base}=t_w.$$

Figure 52:
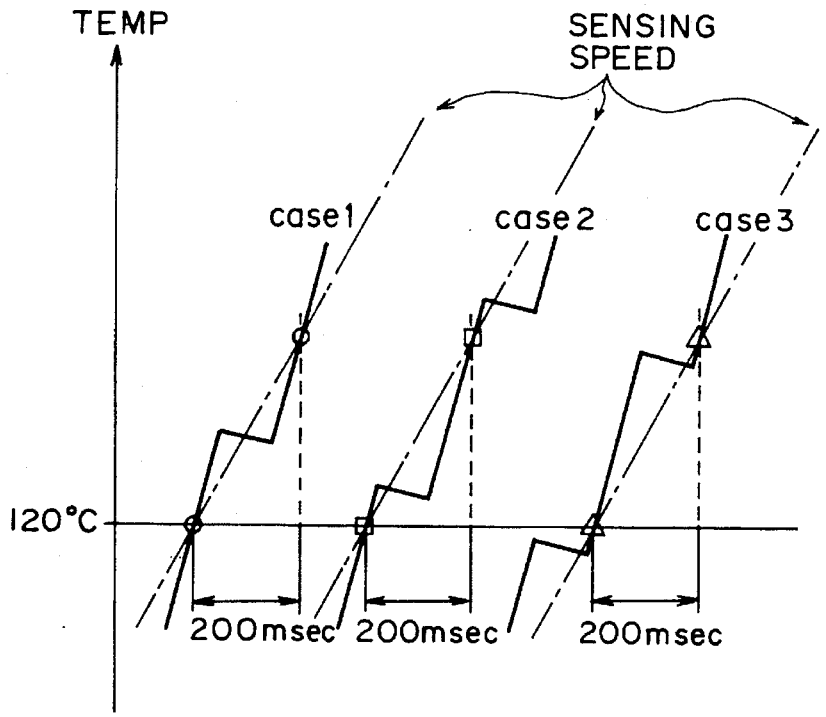
FIG. 52 illustrates detection timing.

FIG. 52 illustrates the timing for the temperature increasing speed detection in this embodiment. The increasing temperature of the heater in one period $t_w$ of the basic wave number is constant irrespective of at which timing in the basic wave number the counting is started.

Therefore, if the measuring period $t_{base}$ for the temperature increasing speed is made equal to one period $t_w$ of the basic wave number, the temperature is measured always at the completion of one cycle of the basic wave number from the start of the measurement (120° C.), and therefore, the temperature increasing speed v=dD/d($t_{base}$) in the time period $t_{base}$ has the same inclination ζ in FIG. 51.

In other words, the conventional problem of the error (variation of the measurements) does not occur irrespective of at what position in the basic wave number the measurement starts.

In this embodiment, the basic wave number is 20, but if the basic wave number is changed, the time $t_{base}$ is changed. For example, it is 100 msec for 10 wave control, and 150 msec for 15 wave control.

The number of waves at which the heater is actuated in the basic wave number, is not limited to 10, but it can be changed from 0–20 in the case of 20 wave control.

The constant power control level is variable depending on the individual apparatuses, and is not limited to 500 W of this example.

As described in the foregoing, by making the measuring period for the temperature rising speed equal to one cycle of the basic wave number, the temperature increasing speed can be accurately controlled irrespective of the start of the measuring period in the basic wave number period. In the foregoing example, the measuring period $t_{base}$ for the increasing speed is equal to the one cycle $t_w$ of he basic wave number, but the measuring period $t_{base}$ may be the basic wave number period $t_w$ multiplied by an integer, that is, $t_{base}$ may be $nt_w$ (n=1, 2, 3 . . . ).

As described hereinbefore, the increasing temperature in the basic wave number period does not change irrespective of whether the counting is carried out from any timing. This applies irrespective of whether the basic wave number is repeated. Therefore, the increasing speed is detected in the basic wave number period multiplied by the integer, the increasing temperature can be detected without variation, similarly to the foregoing example. That is, the correct temperature increasing speed can be obtained.

For example, in the case of 20 wave control, one-to-one is 200 msec, twice is 400 msec, three times is 600 msec.

Figure 53:
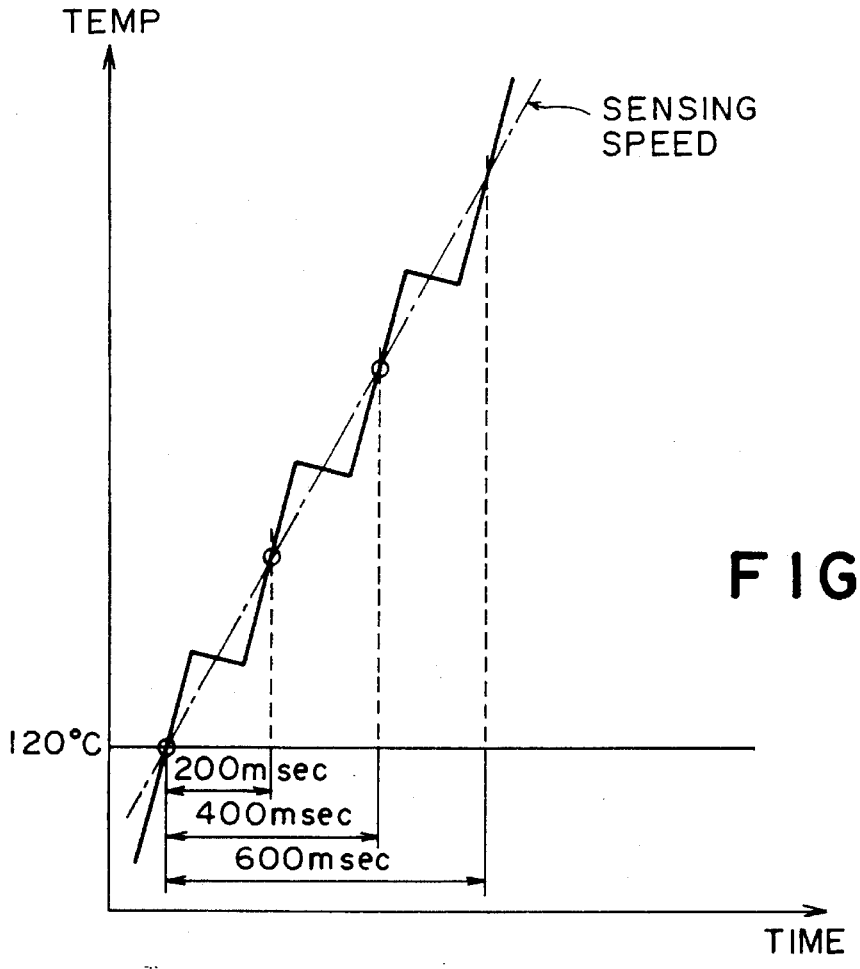
FIG. 53 shows temperature rising speed for each of basic wave numbers.

FIG. 53 shows this. If it is multiplied by the integer, the temperature increasing line has all the same value.

As described in the foregoing example, since the one-to-one detection is 0, it is also 0 if the measuring time is the basic number wave period multiplied by an integer.

If the measuring period is long, for example, twice or three times, the small deviation in the timing during the CPU measurement can be accommodated in the measuring time period, and therefore, the temperature increasing speed can be more accurately as compared with the one-to-one measurement.

In the case where the bit number is low in the A/D converter 31 for converting the thermister 8 output, the temperature resolution detectable by the CPU 32 is low, and therefore, very accurate temperature detection is not possible. However, by increasing the measuring period, the low grade of the resolution of the A/D converter 31 can be accommodated.

In the example described above, the measuring period of the temperature rising speed is the basic wave number period multiplied by an integer, that is, $t_{base}=nt_w$ (n=1, 2, 3 . . . ).

However, $t_{base}$ may be the one close to $t_w$ multiplied by an integer.

Figure 54:
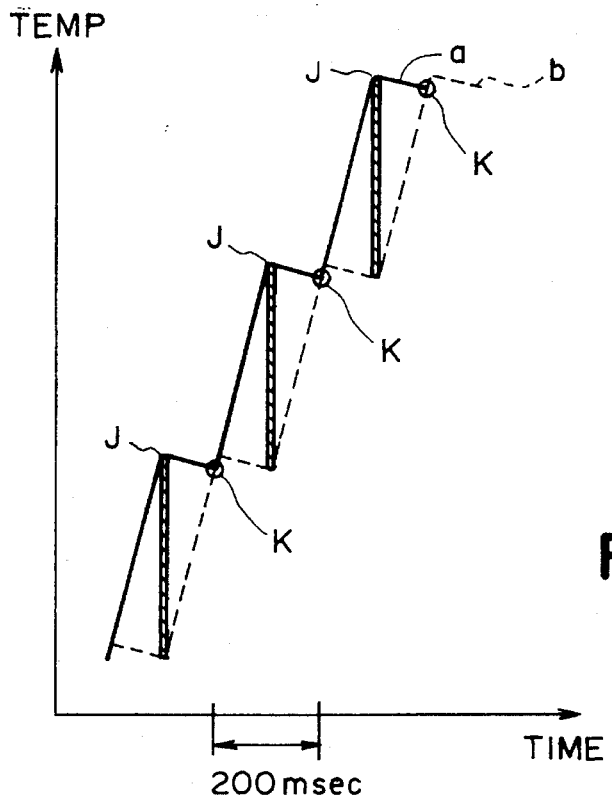
FIG. 54 shows measurement error in the basic wave number.

FIG. 54 is a graph showing two temperature increasing curve with respect to two different measuring timings.

When the temperature rising speed within a defined period, the variation of the measurements (the difference between the detectable maximum and the detectable minimum) is minimum (zero) at a position K corresponding to the measuring period is an integer multiple. It increases again with increase of the measuring time. It takes the maximum at a position J where the on/off is switched in the basic wave number in the increasing curve a.

Ideally, it is most accurate if the measurement is effected at the position in the foregoing examples. However, the variations in the measurement is practically of no problem, if the measurements are effected adjacent the position K.

More particularly, in the case of control table 16 given above, the measuring period may be in + and −10% of the basic wave number period from an integer multiple of the basic wave number period.

In this case, depending on the variation of the measurements, the control level may shifts up or down on the table. Actually, however, the variation is possible even if the measurement is effected at the ideal position depending on the performance of the A/D converter or the like, and the shifting by one level is not a practical problem.

For this reason, if the measuring period and the control table are determined so that the control level does not deviate on the table by one, two or more levels, and if there is no practical problem on the control table, the measuring time may be away from the integer multiple of the base wave number period and may be close to it.

As described hereinbefore, the longer measuring period is desirable from the standpoint of absorbing the measurement variation. However, this advantage is more significant when the measuring period is not an integer multiple of the basic wave number period than when it is an integer multiple.

For this reason, when the measuring period is long to a certain level, the selectable measurement time range (that is, the range in which the shift of the control level is only one on the table) is wider.

Figure 55:
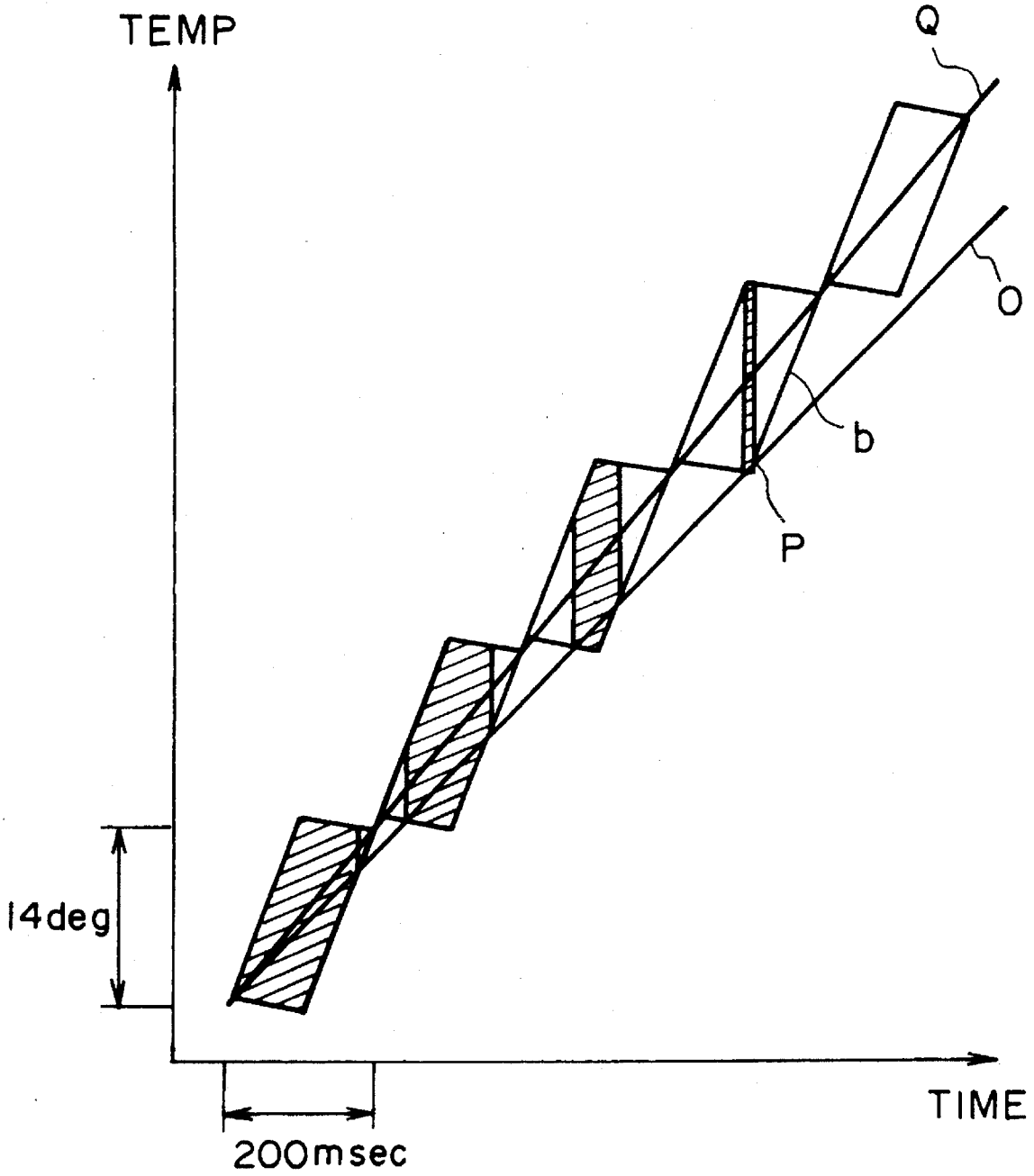
FIG. 55 is a graph showing undetectable period.

FIG. 55 shows a selectable range of the tolerable measuring time when the table 16 is used for the two measuring timings. In FIG. 55, the hatched region is unsettable region.

A line Q represents the average temperature rising speed of the 70 deg/sec, and a line O represents 60 deg/sec. The region defined by the line O, the line perpendicular to the time axis passing through an intersection of the two heater temperature increase curve, and the heater temperature increasing curve, is a range in which the variation of the measurement is not less than 10 deg/sec. Therefore, it is not proper to set the measuring time in this range.

Outside the hatched region, the measuring time can be selectable. If the measuring time is selected so as not to fall in this range, two or more level deviation does not occur even if the average temperature rising speed is shifted by one level, the control temperature deviation may be limited within 4 degrees.

Figure 56:
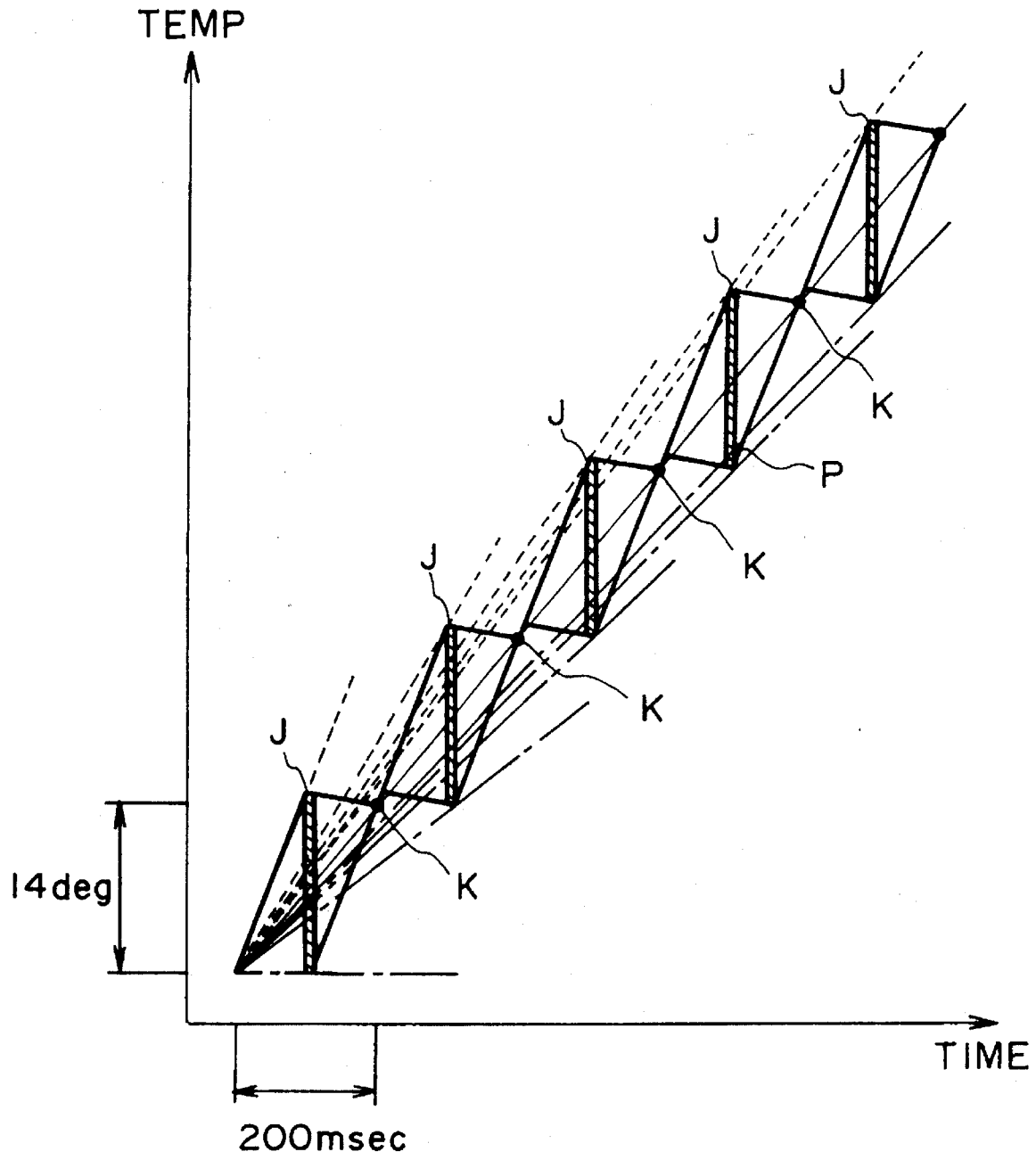
FIG. 56 illustrate decrease with time of the measurement error.

FIG. 56 shows the variation in the detecting speed depending on the measuring period. It will be understood that the detecting speed at the maximum variation position J comes close to average temperature rising speed $\zeta$, with the increase of the measuring period. This is the reason why the settable range increases with the increase of the measuring period.

It follows that in FIG. 55, if the above-described intersection is more than possible measuring time, the measuring time $t_{base}$ may be any value irrespective of the basic wave number period.

With the above-described Table 16, this condition is satisfied from the point P in FIG. 55. As will be understood, in this embodiment, the settable range of the measuring time is determined depending on the table. If a relatively rough control is satisfactory, and the number of switching levels of the table is small, the measuring period may be short.

More particularly, the table 16 tolerates only 10 deg/sec of the variation of the measurements. However, in the case of Table 17, 20 deg/sec is tolerable, which is larger.

If a correcting mechanism is provided to correct the control level against the shift of the control level before the target temperature is reached or before the sheet is introduced into the heating apparatus even after the target temperature is reached, the settable range of the measuring period becomes wider.

TABLE 17

| RISING SPEED | CONT. TEMP. |
|---|---|
| <20 deg/sec | 210° C. |
| 20 deg/sec–40 deg/sec | 200° C. |
| 40 deg/sec–60 deg/sec | 190° C. |
| >60 deg/sec | 180° C. |

In the foregoing examples, the timing of the temperature increasing speed measurement is determined simply on the basis of the measuring period, but it may be defined by the temperature range to be measured. In this case, the temperature range is selected so that the time required for the increasing heater temperature to pass through the temperature range is not less than the measuring period with which the variation of the measurements is within the tolerable range.

More particularly, the temperature range is wider if the maximum temperature increasing speed is higher, and vice versa.

The temperature increasing speed v is:

$$v=d(Tbase)/dt$$

where the temperature range is Tbase and the passing period through the Tbase is t.

In this example, the measuring temperature range is 100°–160° C., and the use is made with the heat fixing apparatus and control table described in the foregoing.

Figure 57:
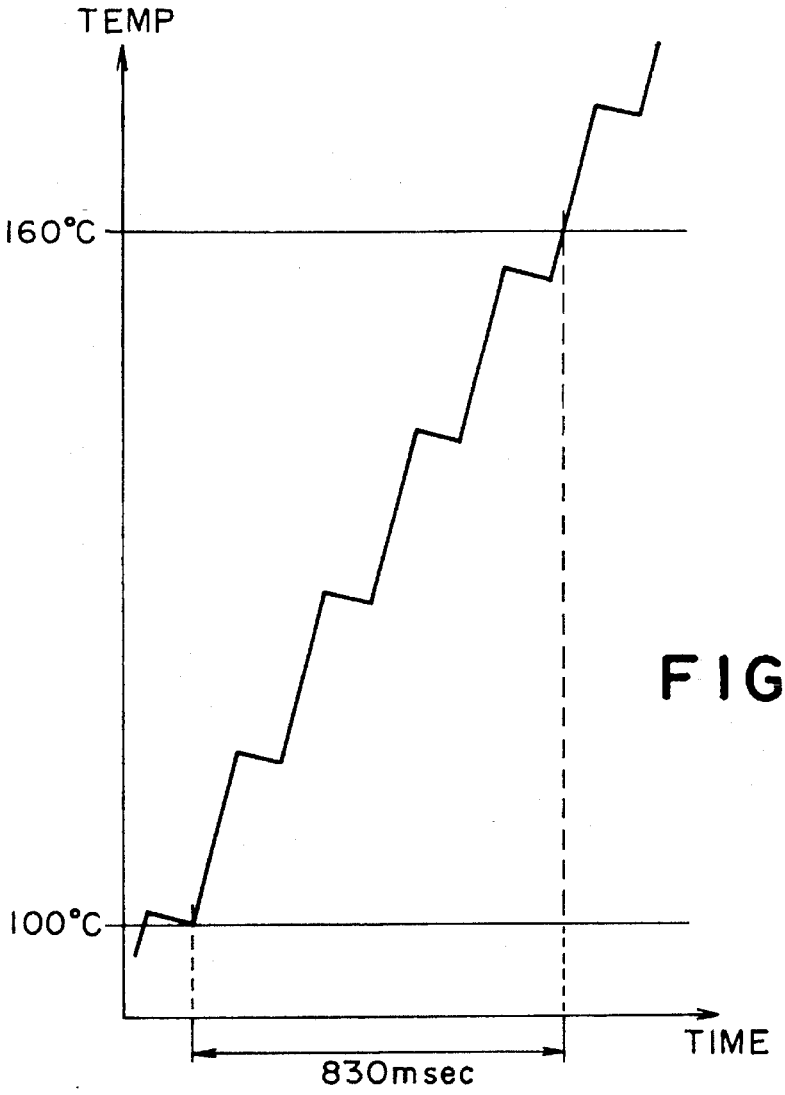
FIG. 57 illustrates measurement of the temperature rising speed.

FIG. 57 shows the measurement timing in this example.

When the temperature of the heater increases as a result of start of the electric power supply to the heater, the temperature increasing speed is detected between 100°–160° C. of the thermister detected temperature.

More particularly, from the point of time when the thermister detect 100° C. to the point of time when it detects 160° C., the time period is detected.

Figure 58:
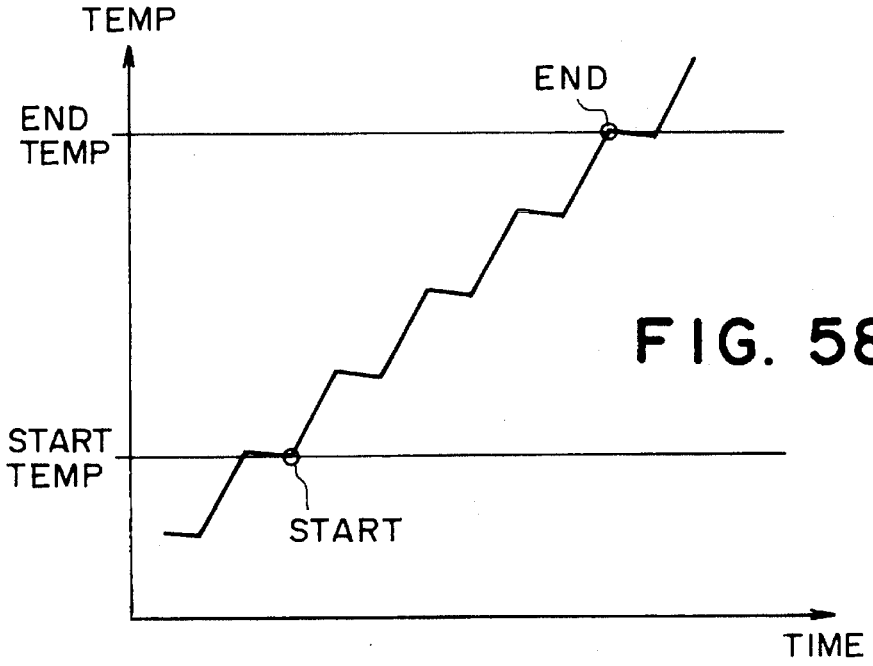
FIG. 58 illustrates the temperature rising speed.

The conditions are the same in the previous example, but as is different from the case of defining the measuring timing on the basis of the measuring period, the minimum required period for the measurement is longer when it is defined by the temperature range. FIG. 58 explains this.

As shown in FIG. 58, when the measuring timing is determined by the temperature range, the measuring period is determined as the time period from the last detection of the measurement starting temperature to the first detection of the measurement end temperature. It is apparent that the measurement end point comes within the range when the heater energization is off during the basic wave numbers.

In the previous example, the required minimum period is 716 msec including the heater-off period. However, in this example using the temperature range, the minimum required period is 800 msec which is an integer of the basic wave number period and which exceeds 716 msec under the condition that 20 wave control is carried out with 10 waves on and 10 waves off.

In this example, the time required for passing through the temperature range from 100° C.–160 ° C. is 830 msec. It contains 4 basic wave number period. The required passing period is larger than the minimum required period 800 msec, and therefore, the variation in the measurements is within the tolerable range. In this manner, the variation can be limited within the tolerable range by setting the temperature measuring range so that the minimum required measuring period can be provided at any time.

As described in the foregoing, in the foregoing examples, there is provided a heating apparatus in which when the heater is started up to a predetermined temperature with the electric power supply controlled by wave number control. The temperature increasing speed is detected, so that the levels of the subsequent controls are determined on the basis of the detected speed, and in which the detecting period for the temperature rising speed is selected to the at least equal to the time required for one period of the basic wave number of the wave number control, by which the detection error can be reduced, and therefore, the control after the start-up of the heater can be accurate.

While the invention has been described with reference to the structures disclosed herein, it is not confined to the details set forth and this application is intended to cover such modifications or changes as may come within the purposes of the improvements or the scope of the following claims.

What is claimed is:

1. An image heating apparatus comprising:

a heater;

temperature detecting means for detecting a temperature of said heater;

electric power supply control means for controlling electric power supply to said heater during image heating, so that the temperature detected by said temperature detecting means is maintained at a predetermined set temperature; and temperature determining means for determining the set temperature on the basis of a lowering rate of the temperature detected by said temperature detecting means.

2. An apparatus according to claim 1, wherein said temperature determining means determines the set temperature on the basis of the lowering rate of the temperature when a recording material is absent in a heating portion of said heater.

3. An apparatus according to claim 1, wherein said heater is stationary in use, and said apparatus further comprises a film slidable relative to said heater, wherein an image on a recording material is heated by heat from said heater through the film.

4. An apparatus according to claim 1, wherein the set temperature an increases with increase of the lowering rate of the detected temperature when the electric power supply is shut off for a predetermined period.

5. An apparatus according to claim 1, wherein said determining means determines the set temperature for each image heating operation.

6. An apparatus according to claim 1, wherein the lowering rate of the temperature is detected after stoppage of the electric power supply and before resumption of the electric power supply.

7. An image heating apparatus comprising:

a heater;

temperature detecting means for detecting a temperature of said heater;

electric power supply control means for controlling electric power supply to said heater during image heating, so that the temperature detected by said temperature detecting means is maintained at a predetermined set temperature; and temperature determining means for determining the set temperature on the basis of a time period required for the temperature detected by said temperature detecting means to change from a first temperature to a second temperature, said determining means determining the set temperature for each image heating operation.

8. An apparatus according to claim 7, wherein said temperature determining means determines the set temperature on the basis of the time period during which a recording material is absent from a heating portion of said heater.

9. An apparatus according to claim 7, wherein said heater is stationary in use, and said apparatus further comprises a film slidable relative to said heater, wherein an image on a recording material is heated by heat from said heater through the film.

10. An apparatus according to claim 7, wherein said second temperature is higher than said first temperature, and the set temperature increases with an increase of said time period.

11. An image heating apparatus comprising:

a heater;

temperature detecting means for detecting a temperature of said heater;

electric power supply control means for controlling electric power supply to said heater during image heating, so that the temperature detected by said temperature detecting means is maintained at a predetermined set temperature; and temperature determining means for determining the set temperature on the basis of a lowering rate of the temperature detected by said temperature detecting means during an interval between adjacent recording materials in continuous image heating operations.

12. An apparatus according to claim 11, wherein said temperature determining means determines the set temperature on the basis of the lowering rate while said heater is supplied with the electric power.

13. An apparatus according to claim 13, wherein said temperature determining means determines the set temperature on the basis of the lowering rate after the electric power supply to the heater is stopped.

14. An apparatus according to claim 13, wherein the set temperature increases with an increase of the changing rate of the detected temperature when the electric power supply is shut off for a predetermined period.

15. An apparatus according to claim 11, wherein said heater is stationary in use, and said apparatus further comprises a film slidable relative to said heater, wherein an image on a recording material is heated by heat from said heater through the film.

16. An image heating apparatus comprising:

a heater;

temperature detecting means for detecting a temperature of said heater; and electric power supply control means for controlling electric power supply to said heater so that the temperature detected by said temperature detecting means is maintained at a predetermined temperature during an interval between adjacent recording materials in continuous image heating operations, wherein during a power supply control operation of said control means in the interval, there is a time period in which heat generation by said heater is shut-off or decreased.

17. An apparatus according to claim 16, further comprising means for determining said time period.

18. An apparatus according to claim 17, wherein said determining means determines said time period in accordance with a number of continuous image forming operations.

19. An apparatus according to claim 17, wherein said determining means determines said time period on the basis of a change rate of the temperature detected by said temperature detecting means when the heat generation of said heater is shut-off or decreased.

20. An apparatus according to claim 17, wherein said determining means determines said time period in accordance with electric power supply to said heater.

21. An apparatus according to claim 17, wherein said determining means determines said time period in accordance with a size of the recording material.

22. An apparatus according to claim 17, wherein said determining means determines said time period in accordance with a changing rate of the temperature detected by said temperature detecting means when the temperature of said heater is increased.

23. An apparatus according to claim 16, wherein said heater is stationary in use, and said apparatus further comprises a film slidable relative to said heater, wherein an image on a recording material is heated by heat from said heater through the film.

24. An image heating apparatus comprising:

a heater;

temperature detecting means for detecting a temperature of said heater;

electric power supply control means for controlling electric power supply to said heater during image heating, so that the temperature detected by said temperature detecting means is maintained at a predetermined set temperature; and temperature determining means for determining the set temperature on the basis of a changing rate of the temperature detected by said temperature detecting means in a predetermined time period in which the temperature of the heater is increased, wherein said predetermined period is not less than a unit time period of electric power supply control.

25. An apparatus according to claim 24, wherein said predetermined time period is an integer multiple of said unit time period.

26. An apparatus according to claim 24, wherein said control means controls a number of waves in the unit time period.

27. An apparatus according to claim 24, wherein said heater is stationary in use, and said apparatus further comprises a film slidable relative to said heater, wherein an image on a recording material is heated by heat from said heater through the film.

* * * * *

UNITED STATES PATENT AND TRADEMARK OFFICE

CERTIFICATE OF CORRECTION

PATENT NO. : 5,464,964
DATED : November 7, 1995
INVENTOR(S) : KOUICHI OKUDA, ET AL.

It is certified that error appears in the above-indentified patent and that said Letters Patent is hereby corrected as shown below:

Drawing:
Figure 21A,
"CONTNUE" should read --CONTINUE--.
Column 3,
line 31, "a" (second occurrence) should read --an--.
Column 4,
line 35, "illustrate" should read --illustrates--.
Column 9,
line 29, "being" should read --being in--; and
line 42, "rollers 38" should read --rollers 138--.

Column 16,
line 13, "the/TOP" should read --the /TOP--.
Column 17,
line 39, "generating-element" should read --generating element--.
Column 18,
line 52, "reaching" should read --reaches--.
Column 19,
line 2, "is" should be deleted.
Column 21,
line 63, "informations," should read --information,--.

UNITED STATES PATENT AND TRADEMARK OFFICE

CERTIFICATE OF CORRECTION

PATENT NO. : 5,464,964
DATED : November 7, 1995
INVENTOR(S) : KOUICHI OKUDA, ET AL.

It is certified that error appears in the above-indentified patent and that said Letters Patent is hereby corrected as shown below:

Column 27,
line 18, "an" should read --a--.
Column 28,
line 39, "ζ." should read --ξ.--;
line 45, "ζ" should read --ξ--;
line 47, "ζ." should read --ξ.--;
line 49, "ζ" should read --ξ--; and
line 67, "ζ" should read --ξ--;.
Column 29,
line 45, "accurately" should read --accurate--; and
line 61, "curve" should read --curves--.
Column 30,
line 11, "shifts" should read --shift--; and
line 51, "ζ," should read --ξ,--.
Column 32,
line 47, "an increases with" should read --increases with an--.

Signed and Sealed this
Seventh Day of May, 1996

Bruce Lehman

*Attest:*

*Attesting Officer*

BRUCE LEHMAN

*Commissioner of Patents and Trademarks*